US011841653B2

(12) United States Patent
Kaino et al.

(10) Patent No.: US 11,841,653 B2
(45) Date of Patent: Dec. 12, 2023

(54) IMAGE FORMING APPARATUS

(71) Applicant: Canon Kabushiki Kaisha, Tokyo (JP)

(72) Inventors: Toshiya Kaino, Shizuoka (JP); Kenji Takagi, Kanagawa (JP); Yusuke Jinkoma, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 18 days.

(21) Appl. No.: 17/537,675

(22) Filed: Nov. 30, 2021

(65) Prior Publication Data

US 2022/0171313 A1 Jun. 2, 2022

(30) Foreign Application Priority Data

Nov. 30, 2020 (JP) ..... 2020-198739
May 27, 2021 (JP) ..... 2021-089217
Oct. 7, 2021 (JP) ..... 2021-165701

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS 7,599,637 B2 10/2009 Nanataki et al.
7,865,102 B2 1/2011 Nanataki et al.
2005/0201767 A1* 9/2005 Peng ..... G03G 15/205 399/69
2005/0207773 A1* 9/2005 Nakayama ..... G03G 15/2039 399/69
2012/0008967 A1* 1/2012 Shibuya ..... G03G 15/161 399/167

FOREIGN PATENT DOCUMENTS

JP 3125569 B2 1/2001
JP 2002287566 A 10/2002
JP 2004212968 A 7/2004
JP 2006201545 A 8/2006
JP 2007030476 A 2/2007
JP 2008216571 4 9/2008

* cited by examiner

*Primary Examiner* — Stephanie E Bloss
*Assistant Examiner* — Michael A Harrison
(74) *Attorney, Agent, or Firm* — Venable LLP

(57) ABSTRACT

An image forming apparatus includes: an image bearing member that carries a developer image; a transfer member that forms a transfer nip portion with the image bearing member and transfers the developer image in the transfer nip portion from the image bearing member to a recording material; a fixing portion that includes a heater and fixes the developer image to the recording material using heat of the heater; a temperature detection portion that detects a temperature of the fixing portion; a control portion that controls power supplied to the heater such that the temperature detected by the temperature detection portion becomes a predetermined control target temperature; and an acquisition portion that acquires a temperature of the image bearing member or the transfer member. The control target temperature is changed based on the temperature acquired by the acquisition portion.

30 Claims, 40 Drawing Sheets

IMAGE FORMING APPARATUS

BACKGROUND OF THE INVENTION

Field of the Invention

The present invention relates to an electrographic type image forming apparatus.

Description of the Related Art

In printers such as laser printers and LED printers, electrographic copy machines such as digital copy machines, or image forming apparatuses such as printers, the demand for a double-sided printing function has recently increased. For example, Japanese Patent Application Laid-open No. 2007-030476 discloses a technology for improving productivity in double-sided printing by alternatively printing both the front and rear surfaces. In double-sided printing, on the other hand, since a recording material which is temporarily heated passes through a heating device and is circulated inside an image forming apparatus, an increase in internal temperature may sometimes become a problem. To take countermeasure against the problem, for example, Japanese Patent Application Laid-open No. 2002-287566 discloses a technology for inhibiting image defects caused due to an increase in internal temperature by changing a set temperature of a heating device step by step by predetermined intervals of temperature every predetermined number of sheets. Japanese Patent No. 3125569 proposes a device that changes a set temperature in accordance with a warm state of a heating device when a plurality of sheets are passed therethrough, irrespective of one-sided printing or double-sided printing.

SUMMARY OF THE INVENTION

As in Japanese Patent Application Laid-open No. 2002-287566, the following problem occurs in some cases when the set temperature of the heating device is changed step by step by a predetermined temperature every predetermined number of sheets. For example, a case in which a double-sided printing job of hundreds of sheets is processed intermittently will be described. When an image forming apparatus body is started, double-sided printing of hundreds of sheets is completed, and then double-sided printing is performed again immediately after the double-sided printing, the image forming apparatus body is cooled in the early stage of a printing start (first to tenth sheets or the like) in the first double-sided printing. Therefore, in the first double-sided printing, to fix toner on a recording material, it is necessary to set a high target temperature of the heating device. When the same target temperature as the first double-sided printing is set in the second double-sided printing, the image forming apparatus body is warmed at this time. Therefore, an excessive amount of heat is transferred to the recording material or the toner, and thus an image defect (hot offset) occurs in some cases. A hot offset is an image defect occurring when toner on a recording material is overheated (hereinafter referred to as over-fixing), is thus attached to a fixing film, and is fixed to the recording material after one circle of the fixing film.

On the other hand, when control is performed such that a set temperature in the previous sheet-passing is inherited, the set temperature is lowered in double-sided printing, and then in some cases double-sided printing may be performed again after a long pause interval in a state in which the image forming apparatus body cooled. In these cases, a fixing defect (cold offset) occurs due to an insufficient amount of heat in some cases. Here, the cold offset indicates an omission of some of a toner image due to non-adhesion to the recording material rather than weak fixing.

When a temperature is set by independently using temperature control in double-sided printing as in Japanese Patent Application Laid-open No. 2002-287566 and control in which a temperature is set in accordance with a warmed state of a heating device (hereinafter referred to as a warming state) is performed as in Japanese Patent No. 3125569, a temperature may be lowered more than necessary in some cases. In these cases, a fixing defect sometimes occurs as well.

As in Japanese Patent Application Laid-open No. 2002-287566, the following problem occurs when the set temperature of a heating device is changed step by step by the predetermined temperature every predetermined number of sheets and a target temperature at the time of processing of a first double-sided printing job is inherited at the time of processing of a second double-sided printing job. When an image bearing member of which a temperature increases is taken out from a printer between the first double-sided printing job and the second double-sided printing job and the image bearing member is exchanged for an image bearing member which is being cooled to the room temperature, a cold offset occurs due to an insufficient amount of heat.

As a case in which an image bearing member is exchanged, for example, a case in which the lifespan of an image bearing member ends and it is being exchanged for a new image bearing member is conceivable.

As in Japanese Patent Application Laid-open No. 2002-287566, when the set temperature of the heating device transitions step by step by the predetermined temperature every predetermined number of sheets, a previous warming state is not likely to be able to be ascertained correctly upon turning on the power or after restoring from a sleep state. In this case, a hot offset or a cold offset in which a set temperature of a heating device deviates from an optimum temperature occurs in some cases.

An objective of the present invention is to be able to inhibit occurrence of an image defect caused due to over-fixing or a fixing defect when a warming state of an image forming apparatus or a heating device is changed in accordance with a difference in a pause interval of printing or double-sided printing.

To solve the above-described problems, an image forming apparatus according to an aspect of the present invention includes the followings:

- an image bearing member that carries a developer image;
- a transfer member that forms a transfer nip portion with the image bearing member and transfers the developer image in the transfer nip portion from the image bearing member to a recording material;
- a fixing portion that includes a heater and fixes the developer image to the recording material using heat of the heater;
- a temperature detection portion that detects a temperature of the fixing portion; and
- a control portion that controls power supplied to the heater such that the temperature detected by the temperature detection portion becomes a predetermined control target temperature;
- wherein an acquisition portion is provided that acquires a temperature of the image bearing member or the transfer member, and wherein
- the control target temperature is changed based on the temperature acquired by the acquisition portion.

To solve the above-described problems, an image forming apparatus according to another aspect of the present invention includes the followings:

an image bearing member that carries a developer image;

a transfer member that forms a transfer nip portion with the image bearing member and transfers the developer image in the transfer nip portion from the image bearing member to a recording material;

a fixing portion that includes a heater and fixes the developer image to the recording material using heat of the heater;

a temperature detection portion that detects a temperature of the fixing portion; and a control portion that controls power supplied to the heater such that the temperature detected by the temperature detection portion becomes a predetermined control target temperature;

wherein an acquisition portion is provided that acquires a temperature of the image bearing member or the transfer member, and wherein the control target temperature is changed based on a first temperature change amount which is based on the temperature acquired by the acquisition portion, a second temperature change amount which is based on a supply time of power to the heater, and a predetermined coefficient.

To solve the above-described problems, an image forming apparatus according to still another aspect of the present invention includes the followings:

an image bearing member that carries a developer image;

a transfer member that forms a transfer nip portion with the image bearing member and transfers the developer image in the transfer nip portion from the image bearing member to a recording material;

a fixing portion that includes a heater and fixes the developer image to the recording material using heat of the heater;

a temperature detection portion that detects a temperature of the fixing portion; and a control portion that controls power supplied to the heater such that the temperature detected by the temperature detection portion becomes a predetermined control target temperature;

wherein an acquisition portion is provided that acquires a temperature of the image bearing member or the transfer member, wherein the control target temperature is changed based on a larger temperature change amount between a first temperature change amount which is based on the temperature acquired by the acquisition portion and a second temperature change amount which is based on a supply time of power to the heater.

To solve the above-described problems, an image forming apparatus according to still another aspect of the present invention includes the followings:

an image bearing member that carries a developer image;

a transfer portion that includes a transfer member that forms a transfer nip portion with the image bearing member and transfers the developer image in the transfer nip portion from the image bearing member to a recording material;

a fixing portion that includes a heater and fixes the developer image to the recording material using heat of the heater;

a temperature detection portion that detects a temperature of the fixing portion; and a control portion that controls power supplied to the heater such that the temperature detected by the temperature detection portion becomes a predetermined control target temperature, wherein in the image forming apparatus, the fixing portion is able to perform a one-sided fixing operation of heating a first recording material where an image is formed only on one surface and a double-sided fixing operation of heating a second recording material where images are formed on both surfaces, the double-sided fixing operation of performing first heating in a state in which the developer image is transferred to only one surface of the second recording material and subsequently performing second heating in a state in which the developer image is also transferred to the other surface, and wherein the control target temperature is changed based on a larger temperature change amount between a third temperature change amount which is based on an operation time of the double-sided fixing operation repeatedly performed and a second temperature change amount which is based on a supply time of power to the heater.

To solve the above-described problems, an image forming apparatus according to still another aspect of the present invention includes the followings:

an exchangeable image bearing member;

a transfer portion that transfers a developer image formed on the image bearing member to a recording material coming into contact with the image bearing member;

a fixing portion that fixes the developer image transferred to the recording material to the recording material and is controlled such that a predetermined control target temperature is maintained during fixing processing; and a double-sided printing mechanism that also forms the developer image on a rear surface of the recording material by reversing front and rear surfaces of the recording material passing through the fixing portion, wherein the control target temperature is set in accordance with the number of double-sided prints and exchange detection of the image bearing member.

To solve the above-described problems, an image forming apparatus according to still another aspect of the present invention includes the followings:

an exchangeable first image bearing member;

an exchangeable second image bearing member;

a first transfer portion that transfers a developer image formed on the first image bearing member to the second image bearing member;

a second transfer portion that transfers the developer image from the second image bearing member to a recording material coming into contact with the second image bearing member;

a fixing portion that fixes the developer image transferred to the recording material and is controlled such that a predetermined target temperature is maintained during fixing processing; and a double-sided printing mechanism that also forms the developer image on a rear surface of the recording material by reversing front and rear surfaces of the recording material passing through the fixing portion, wherein the image forming apparatus sets the control target temperature in accordance with the number of double-sided prints and exchange detection of the first image bearing member and the second image bearing member.

To solve the above-described problems, an image forming apparatus according to still another aspect of the present invention includes the followings:

an image bearing member that carries a developer image;

a transfer member that forms a transfer nip portion with the image bearing member;

a transfer voltage application unit that applies, to the transfer member, a transfer bias for transferring the developer image from the image bearing member to a recording material;

a transfer current detecting unit that measures a transfer current value generated in the application of the transfer bias;

a transfer calculation processing unit that calculates a resistance value of the transfer nip portion to which the voltage is applied by the transfer voltage application unit from a detection result of the transfer current detecting unit;

a fixing portion that includes a heater and fixes the developer image to the recording material using heat of the heater;

a temperature detection portion that detects a temperature of the fixing portion;

a control portion that controls power supplied to the heater such that the temperature detected by the temperature detection portion becomes a predetermined control target temperature; and an acquisition portion that acquires a predicted temperature of the image bearing member predicted based on information including an activation situation of the image forming apparatus, wherein the control target temperature is changed based on the resistance value and the predicted temperature acquired by the acquisition portion.

To solve the above-described problems, an image forming apparatus according to still another aspect of the present invention includes the followings:

a first image bearing member;

a second image bearing member;

a first transfer member that forms a first transfer nip portion with the first image bearing member via the second image bearing member and transfers a developer image formed on the first image bearing member to the second image bearing member;

a second transfer member that forms a second transfer nip portion with the second image bearing member and transfers a developer image formed on the second image bearing member to a recording material when the recording material passes through the second transfer nip portion;

a fixing portion that includes a heater and fixes the developer image to the recording material using heat of the heater;

a temperature detection portion that detects a temperature of the fixing portion;

a control portion that controls power supplied to the heater such that the temperature detected by the temperature detection portion becomes a predetermined control target temperature;

an acquisition portion that acquires a predicted temperature of the second image bearing member predicted based on information including an activation situation of the image forming apparatus;

the image forming apparatus further comprising:

a transfer voltage application unit that applies a voltage for transferring developer to at least one of the first transfer member or the second transfer member;

a transfer current detecting unit that measures a transfer current value generated by allowing the transfer voltage application unit to apply the voltage; and a transfer calculation processing unit that calculates a resistance value of the transfer nip portion to which the voltage is applied by the transfer voltage application unit from a detection result of the transfer current detecting unit, wherein the control target temperature is changed based on the resistance value and the predicted temperature acquired by the acquisition portion.

As described above, according to the present invention, it is possible to inhibit an image defect from occurring due to over-fixing or a fixing defect when a warming state of the heating device or the image forming apparatus is changed in accordance with a difference in a pause interval of printing or double-sided printing.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Example

Description of Image Forming Apparatus

Figure 1:
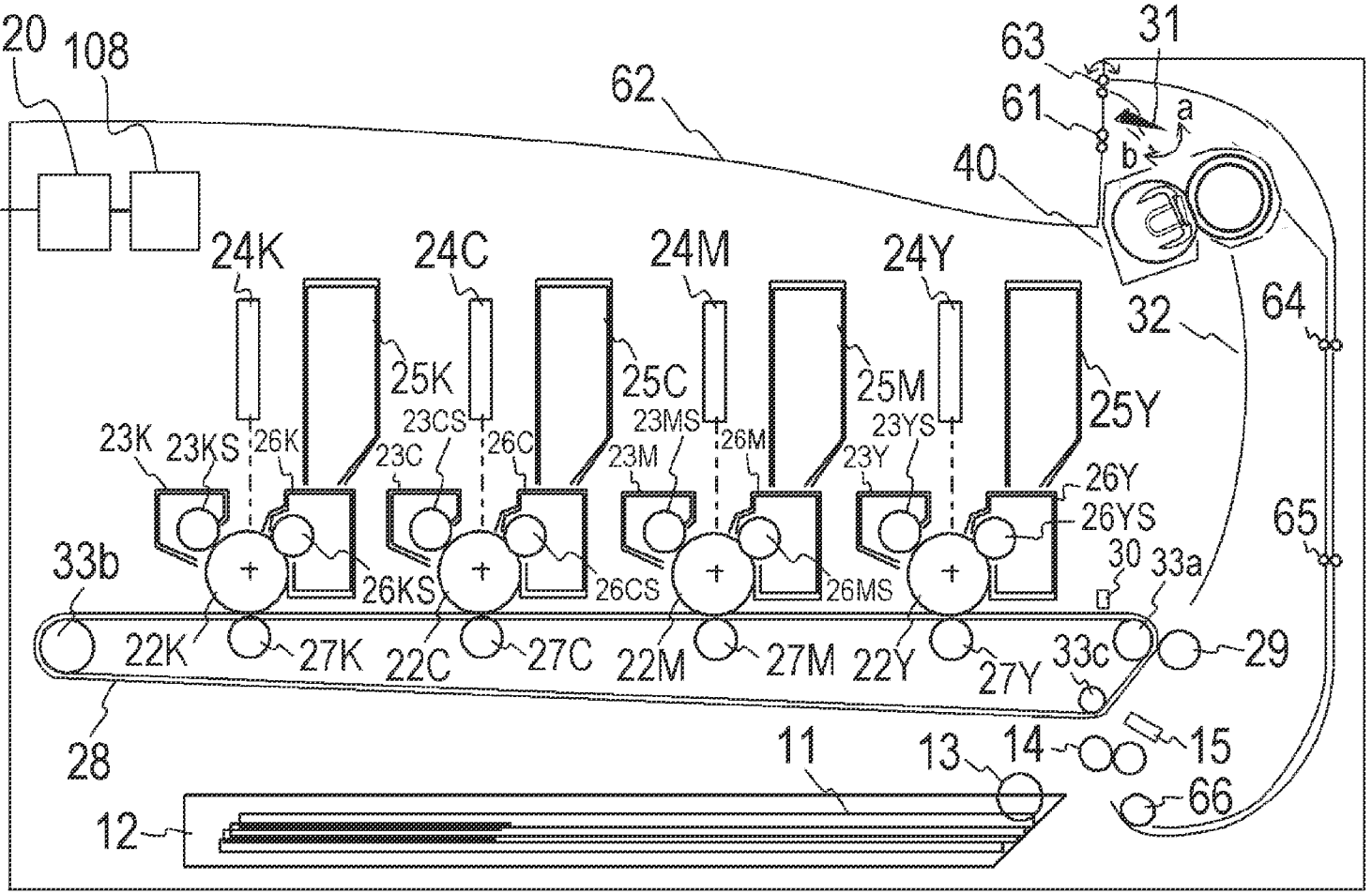
FIG. 1 is a sectional view illustrating an overall configuration of an image forming apparatus according to a first example.

FIG. 1 is a sectional view illustrating an overall configuration of an image forming apparatus according to the present example. Examples of the image forming apparatus to which the present invention can be applied include electrographic type printers or copy machines such as a laser printer, an LED printer, and a digital copy machine. In the present example, a color laser printer to which the present invention is applied will be described. The image forming apparatus according to the present example forms multi-color toner images by superimposing toner images of a plurality of colors (developer images) and forms a color image on a recording material by transferring and fixing the multi-color toner images to the recording material.

An image forming portion of the image forming apparatus according to the present example forms an electrostatic latent image with exposure light turned on based on an exposure time converted by an image processing portion for each color of monochromatic toner images with different colors of multi-color toner images, and forms a monochromatic toner image by developing the electrostatic latent image. The multi-color toner images are formed by superimposing a plurality of monochromatic toner images with different colors and the multi-color toner images are transferred to a recording material. A fixing portion of the image forming apparatus fixes the multi-color toner images to the recording material.

The image forming portion according to the present example includes four stations as image forming stations that form a plurality of monochromatic toner images with different colors (hereinafter referred to as stations). Each station includes a photosensitive drum 22 serving as a first image bearing member, an injection charger 23 serving as a primary charger, a scanner portion 24 serving as an exposure unit, a toner cartridge 25 serving as a toner container, a development unit 26, and a primary transfer roller 27. In the present example, monochromatic toner images of respective colors are first formed using toner of four colors, yellow (Y), magenta (M), cyan (C), and black (K), as constituent colors of multi-color toner images. Each station has substantially the same configuration except for a difference in the color of the toner. In FIG. 1, to distinguish corresponding colors of the stations from each other, suffixes Y, M, C, and K are attached to constituent elements of the stations. In the following description, the suffixes are omitted for description in some cases when it is not necessary to particularly distinguish the colors from each other.

The stations are arranged side by side in an inline form with respect to an intermediate transfer belt 28. As a configuration in which a recording material 11 such as a copy sheet is supplied and conveyed, a feeding tray 12, a feeding roller 13, a pair of register rollers 14, a register sensor 15, a secondary transfer roller 29, a discharging roller 61, and the like are disposed. As a fixing portion, a heating device (an image heating device) 40 is disposed. A control portion 108 performs control of an operation.

The photosensitive drum 22 is configured by coating an organic photoconductive layer on the outer circumference of an aluminum cylinder. A driving power of a driving motor (not illustrated) is delivered for rotation. The driving motor rotates the photosensitive drum 22 in a clockwise direction in accordance with an image forming operation. The outer diameter of the photosensitive drum 22 is 24 mm. As primary chargers, four injection chargers 23Y, 23M, 23C, and 23K are provided to charge yellow (Y), magenta (M), cyan (C), and black (K) photosensitive drums in the stations. Sleeves 23YS, 23MS, 23CS, and 23KS are included in the injection chargers 23Y, 23M, 23C, and 23K, respectively.

Exposure light for the photosensitive drum 22 is sent from the scanner portion 24 and the surface of the photosensitive drum 22 is selectively exposed to form an electrostatic latent image. As development units, to visualize electrostatic latent images, four development units 26Y, 26M, 26C, and 26K that perform development of yellow (Y), magenta (M), cyan (C), and black (K) are provided in the stations, respectively. The development units 26Y, 26M. 26C, and 26K include sleeves 26YS, 26MS, 26CS, and 26KS, respectively. Development voltages are applied between the sleeves 26YS, 26MS, 26CS, and 26KS and the photosensitive drums 22Y, 22M, 22C, and 22K corresponding thereto from a power supply (not illustrated). When an image is formed, the photosensitive drum 22 is rotated clockwise and the development unit 26 develops a toner image of each color in an electrostatic latent image formed on the photosensitive drum 22.

The intermediate transfer belt 28 which is a second image bearing member and serves as an intermediate transfer body comes into contact with the photosensitive drum 22 due to a pressurization force of the primary transfer roller 27 which is a first transfer member to form a primary transfer portion which is a first transfer nip portion. A primary transfer voltage is applied between the primary transfer roller 27 and the photosensitive drum 22 corresponding thereto from a power supply (not illustrated). The intermediate transfer belt 28 is an endless annular belt with an internal circumferential length of 790 mm. Polyimide is used as a main raw material and a thickness is set to 65 μm. When an image is formed, the intermediate transfer belt 28 and the primary transfer roller 27 are driven and rotated with respect to the photosensitive drum 22 to primarily transfer a toner image on the photosensitive drum 22 (on the first image bearing member) to the intermediate transfer belt 28.

The recording material 11 accommodated in the feeding tray 12 is conveyed by the feeding roller 13, arrives at the pair of register rollers 14, and is detected by the register sensor 15. When an image is formed, the recording material 11 is conveyed at a timing at which a multi-color toner image on the intermediate transfer belt 28 arrives at the secondary transfer roller 29 from a timing at which the recording material 11 is detected by the register sensor 15. Here, the recording material 11 arrives from the pair of register rollers 14 at the secondary transfer roller 29.

The intermediate transfer belt 28 is stretched by support rollers 33 (33*a*, 33*b*, and 33*c*) and comes into contact with the secondary transfer roller 29 which is a counter member (a second transfer member) to form a secondary transfer nip portion which is a second transfer nip portion in a portion stretched by the support roller 33*a*. In secondary transfer processing, the recording material 11 is pinched and conveyed in the secondary transfer nip portion and the multi-color toner images on the intermediate transfer belt 28 (on the second image bearing member) are transferred to the recording material 11. Here, the support roller 33*a* is configured by an iron pipe (with Φ18 and a thickness of 1.5 mm). The secondary transfer roller 29 is a roller that has a cross-sectional configuration in which an elastic layer formed of NBR Hydrin with a thickness of 4 mm is formed on the core grid (Φ8), and a surface length of the elastic layer (in the axial direction) is 220 mm. The secondary transfer roller 29 is brought into contact with the intermediate transfer belt 28 by an abutting mechanism (not illustrated) and an abutting pressure at that time is 30 N. Here, when the recording material 11 is not conveyed, a contact width of the secondary transfer roller 29 and the intermediate transfer belt 28 is 2.0 mm. When the recording material 11 is conveyed, a contact width of the recording material 11 and the intermediate transfer belt 28 is 5.0 mm. A secondary transfer voltage is applied between the secondary transfer roller 29 and the intermediate transfer belt 28 from a power supply (not illustrated).

Here, a belt thermistor 30 is a transfer portion temperature detecting unit that detects a temperature of the intermediate transfer belt 28. The control portion 108 includes an acquisition portion that acquires a temperature of an image bearing member or a transfer member. The belt thermistor 30 is an example a temperature detection member used when the acquisition portion acquires a temperature of the intermediate transfer belt 18 serving as an image bearing member. A specific configuration of the temperature detection member is not limited to the configuration described herein. A conveying guide 32 is a guide member that conveys the recording material 11 from the secondary transfer portion to the heating device 40.

In fixing processing, the heating device 40 is a unit that heats, melts, and fixes a toner image by pinching and conveying the toner image on the recording material 11. Then, the recording material 11 subjected to the fixing processing by the heating device 40 arrives at a double-sided flapper 31. The image forming apparatus according to the present example includes a double-sided printing mechanism capable of performing a one-sided printing operation which is a one-sided image forming operation and a double-sided printing operation which is a double-sided image forming operation. The double-sided flapper 31 is a movable guide member that switches a conveying direction of the recording material 11 in accordance with a printing operation. The double-sided flapper 31 switches between positions a and b through an operation of an electromagnetic solenoid (not illustrated) by the control portion 108.

When the recording material 11 is a recording material in which an image is formed on only one surface (a first recording material), the double-sided flapper 31 is at the position a. When the double-sided flapper 31 is at the position a, the recording material 11 is discharged to the discharging tray 62 outside of the image forming apparatus by the discharging roller 61 and the image forming operation ends. When the recording material 11 is a recording material in which images are formed on both surfaces (a second recording material), the double-sided flapper 31 is at the position b. When the double-sided flapper 31 is at the position b, the recording material 11 is conveyed to a switchback roller 63 to reverse the conveying direction after first heating and fixing in a state in which the developer image is transferred to only one surface in automatic double-sided printing. The switchback roller 63 is rotated positively (clockwise in FIG. 1) until the rear end of the recording material 11 passes through the double-sided flapper 31, and is rotated reversely (counterclockwise in FIG. 1) after the recording material 11 passes. When the double-sided flapper 31 is switched to the position a simultaneously with the reverse rotation of the switchback roller 63, the recording material 11 is conveyed in a direction of double-sided rollers 64 and 65 in a double-sided conveyance path. The recording material 11 is conveyed from the double-sided rollers 64 and 65 to a double-sided refeeding roller 66 to arrive at the pair of the register rollers 14 again. Here, an image is formed similarly by performing the above-described secondary transfer processing and fixing processing (second heating and fixing) on an unprinted recording material surface which is the other surface. The double-sided flapper 31 is switched to the position a, and the recording material 11 is discharged to the discharging tray 62. Then, the image forming operation ends. In the following description, in the double-sided printing, the surface on which the printing is performed first is referred to as a first surface and a surface on which reversing is performed by switchback and printing is performed second is referred to as a second surface.

Description of Configuration of Heating Device

Figure 2B:
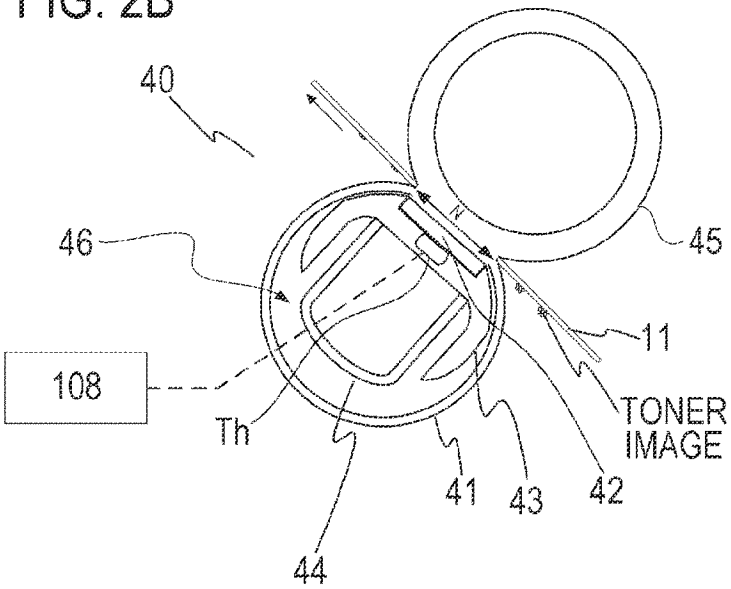
FIGS. 2A to 2C are sectional views illustrating an overall configuration of a heating device.
Figure 2A:
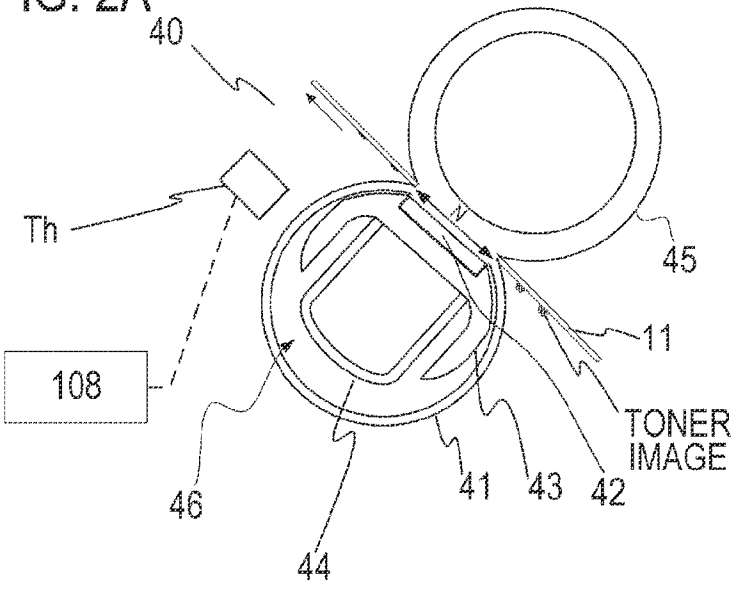

The heating device 40 will be described with reference to FIG. 2A. The heating device 40 includes a cylindrical fixing film 41 serving as a fixing member and a heater 42 that serves as a heating member and is provided in an internal space of the fixing film 41 and comes into contact with an internal surface. The heater 42 is held by a holding member 43. The holding member 43 has a guide function of guiding rotation of the fixing film 41. A stay 44 is a member that applies a pressure of a pressurization spring (not illustrated) to the holding member 43 in the direction of a pressurization roller 45 serving as a pressurization member and forms a fixing nip portion N in which toner on the recording material 11 is heated and fixed. A metal with high rigidity is used for the stay 44. A toner image is fixed to the recording material 11 pinched in the fixing nip portion N formed between the outer circumferential surface of the pressurization roller 45 and the outer circumferential surface of the fixing film 41 by using heat of the heater 42. The heater 42, the holding member 43, and the stay 44 configure a heater unit 46. Another member such as a heat transfer member may be interposed between the fixing film 41 and the heater 42.

Here, a total pressure of the pressurization spring is 250 N and the width of the fixing nip portion N in a recording material conveying direction is set to 9.0 mm. A driving gear (not illustrated) is fitted at the end of the pressurization roller 45. The pressurization roller 45 receives motive power from a motor (not illustrated) and is rotated clockwise. When the pressurization roller 45 is rotated, the fixing film 41 is driven and rotated counterclockwise. Then, the recording material 11 on which the toner images are carried is heated and subjected to the fixing processing while being pinched and conveyed in an arrow direction in the nip portion N.

Here, the fixing film 41 has an outer diameter of 24 mm and includes a base layer formed of a polyimide resin with a thickness of 60 μm, an elastic layer formed of a heat transfer rubber layer of 300 μm on the outer surface of the base layer, and a release layer formed of a PFA tube of 20 μm in the outermost layer. The pressurization roller 45 has an outer diameter of 25 mm and includes an iron core grid with an outer diameter of 17 mm, an elastic layer formed of a silicone rubber with a thickness of 4 mm, and a release layer formed of a PFA tube of 40 μm in the outermost layer. A fixing thermistor Th is a temperature detecting member that detects a surface temperature of the fixing film 41 in a contactless manner and is installed in a middle portion of the fixing film 41 in a direction orthogonal to the recording material conveying direction. The fixing thermistor Th is an example of a temperature detection portion that detects a temperature of the fixing portion. A specific configuration of the temperature detection portion is not limited to the configuration described herein. In a normal use, when supply of power to the heater 42 is started with rotation start of the pressurization roller 45, an inner surface temperature of the fixing film 41 increases with an increase in the temperature of the heater 42.

Turn-on of the heater 42 is controlled by the control portion 108 serving as a fixing target temperature controller controlling a target temperature during the fixing processing and a power controller. That is, a target value (fixing target temperature) of a temperature detected by the fixing thermistor Th is determined as a control target temperature so that a surface temperature of the fixing film 41 becomes a predetermined temperature, and a supply of power is controlled so that a detected temperature detected by the fixing thermistor Th becomes the target value.

Figure 3A:
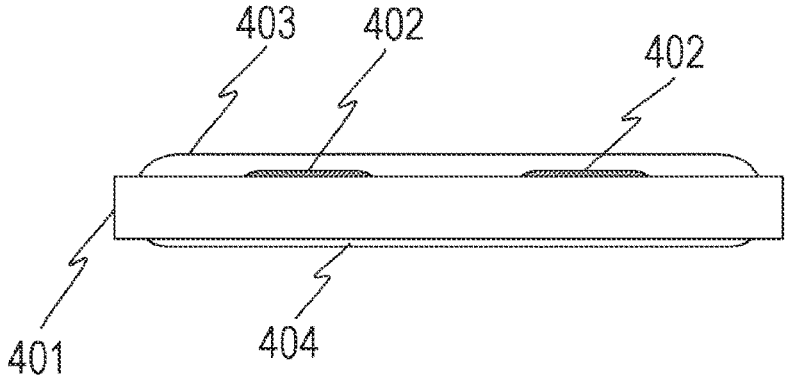
FIGS. 3A and 3B are schematic views illustrating a heater configuration used in the heating device.

A configuration of the heater 42 will be described with reference to the schematic views of FIGS. 3A and 3B. FIG. 3A is a sectional view illustrating the heater 42. A substrate (base substrate) 401 of the heater 42 is configured as an aluminum nitride substrate with a plate thickness of 0.6 mm which is a ceramic substrate disposed so that a direction orthogonal to a conveying direction of the recording material 11 is long (a longitudinal direction). A longitudinal width of the substrate 401 is 260 mm and a transverse width (a sheet passing direction) is 9 mm. A sliding glass layer 404 with a thickness of 15 μm is included on the front surface of the heater 42 coming into contact with the fixing film 41. The sliding glass layer 404 comes into contact with the fixing film 41 with a fluorine grease (not illustrated) interposed therebetween and exhibits excellent sliding. A resistance heating layer 402 with a thickness of 10 μm and a protective glass 403 with a thickness of 50 μm are included on the rear surface of the heater 42. The resistance heating layer 402 is formed by coating a conductive paste containing a sliver-palladium (Ag/Pd) alloy on the aluminum nitride substrate 401 by screen printing and baking aluminum nitride substrate 401.

Figure 3B:
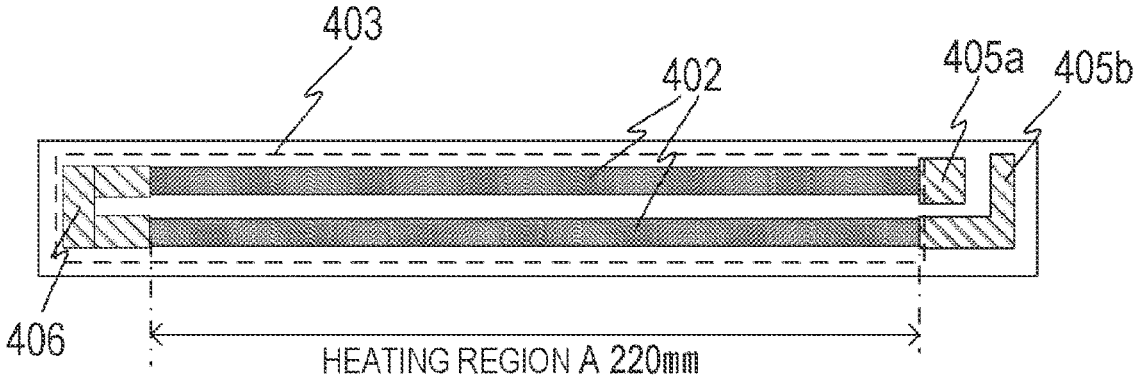

FIG. 3B is a schematic view illustrating a planar configuration of the heater when seen from the rear surface of the heater. The resistance heating layer 402 which is a resistance heating body generating heat by conduction is formed in a belt-like shape in the longitudinal direction of the substrate 401. The protective glass 403 (indicated by a dotted line) covers the resistance heating layer 402 and a conductive portion 406 to guarantee insulation. In the heater 42, electrification is performed between electrode portions 405*a* and 405*b* from an external power supply, and thus the resistance heating layer 402 generates heat. Here, a heating region A in the longitudinal direction heated by the resistance heating layer 402 is 220 mm long. In the present example, a power voltage of the external power supply is set to 120 V and resistance of the heater 42 is set to 10Ω. To measure fixing consumption power to be described below, a power meter WT310 manufactured by Yokogawa Test & Measurement Corporation is relayed and connected via a cable (not illustrated) which supplies power to the electrode portions 405*a* and 405*b*.

The heating device performs a one-sided fixing operation of heating the first recording material in which an image is formed on only one surface in one-sided printing, and performs a double-sided fixing operation of heating the second recording material in which images are formed on both surfaces in double-sided printing. In the double-sided fixing operation, first heating is performed on the printing material subject to the double-sided printing in a state in which the developer image is transferred to only one surface. Thereafter, second heating is performed in a state in which a developer image is also transferred to the other surface. When the double-sided printing is performed continuously on a plurality of recording materials, it is possible to also perform a double-sided consecutive fixing operation in which the second heating of a preceding recording material is performed after the first heating of a subsequent recording material is performed.

Figure 25:
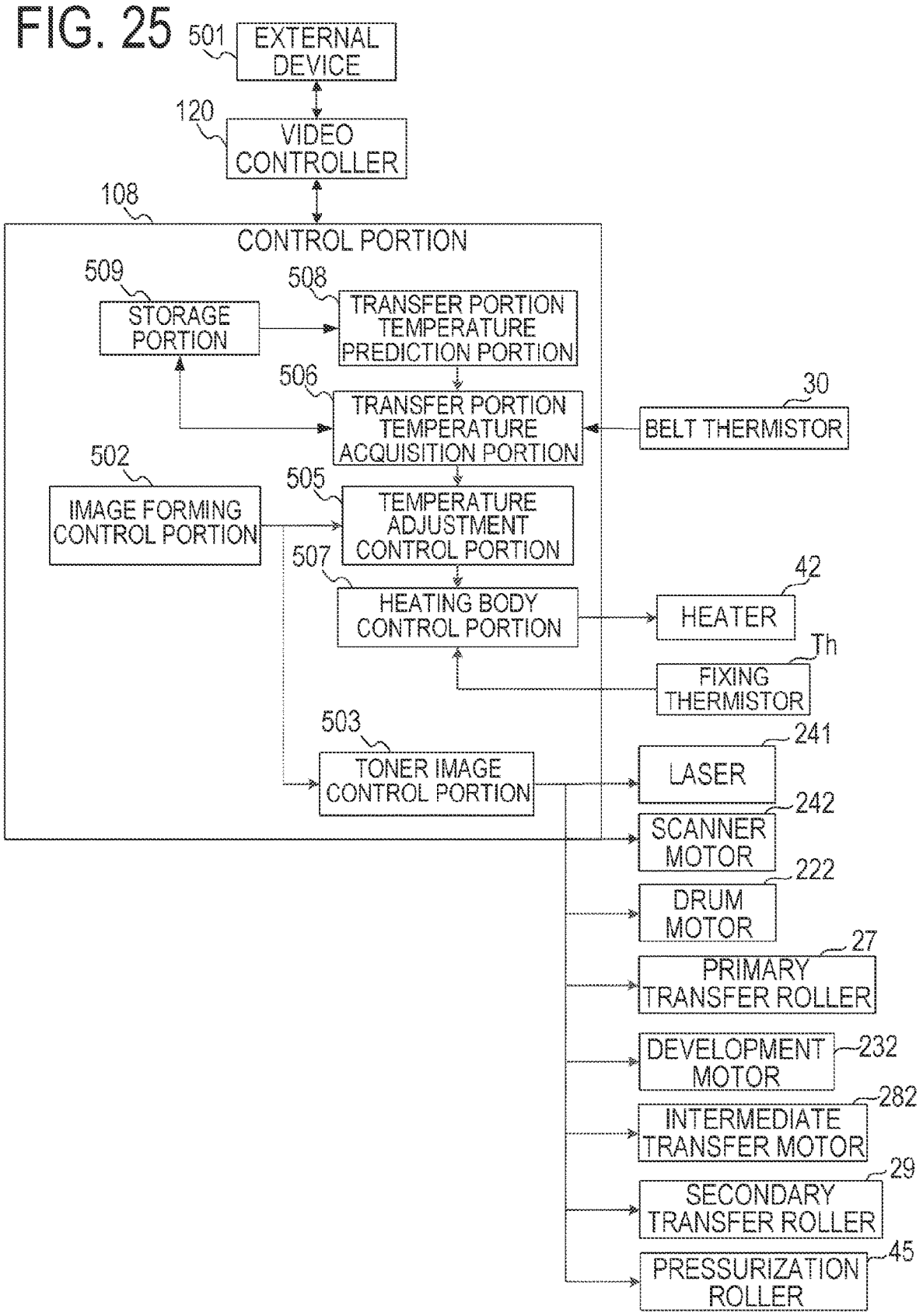
FIG. 25 is a control block diagram according to the first example.

FIG. 25 is a block diagram schematically illustrating a control configuration of the image forming apparatus according to the present example.

Configuration of Control Block

FIG. 25 is a control block diagram according to the present example. A video controller 120 receives and processes image information and a printing instruction transmitted from an external device 501 such as a host computer. When the image information and the printing instruction transmitted from the external device 501 are received, the video controller 120 generates information such as sheet size information and number-of-prints information necessary for the image forming apparatus to perform a printing operation, and transmits the information to the control portion 108. Based on the information, the control portion 108 performs printing by operating a temperature adjustment control portion 505, a toner image control portion 503, and the like.

In response to an instruction form the video controller 120, an image forming control portion 502 controls a first preparation operation in response to a preparation operation instruction before the image forming operation is instructed, a second preparation operation in accordance with a printing mode after the image forming operation is instructed, and an image forming operation. In the preparation operation, the heating device 40 and the scanner portion 24 start to be driven. In the second preparation operation, a preparation operation necessary for an image forming operation not performed in the first preparation operation is performed. Specifically, in the second preparation operation, the photosensitive drum 22, the primary transfer roller 27, the development unit 26, the intermediate transfer belt 28, and the secondary transfer roller 29 start to be driven. The printing mode has image forming condition in accordance with a kind of recording material and includes a conveying speed, a transfer condition, and a fixing target temperature.

The toner image control portion 503 controls driving of various configurations of the image forming portion and the fixing portion to form a toner image in accordance with an image forming instruction of the image forming control portion 502. Examples of control targets include a laser 241 and a scanner motor 242 of the scanner portion 24, a drum motor 222, a transfer bias of the primary transfer roller 27, a development motor 232, an intermediate transfer motor 282, and a transfer bias of the secondary transfer roller 29. The temperature adjustment control portion 505 determines a control target temperature of the heater 42 controlled by the heating body control portion 507 in accordance with a preparation operation instruction or an image forming instruction of the image forming control portion 502. The heating body control portion 507 includes a power circuit supplying power supplied from an external alternating-current power supply to the heater 42 and controls power supplied to the heater 42 in accordance with an instruction of the temperature adjustment control portion 505. A transfer portion temperature acquisition portion 506 acquires a temperature of the intermediate transfer belt 28 using the belt thermistor 30 or acquires a predicted temperature of the intermediate transfer belt 28 predicted by a transfer portion temperature prediction portion 508 from information such as an activation situation of the image forming apparatus. A storage portion 509 stores various kinds of information necessary for control and particularly stores various kinds of information related to temperature adjustment control of the heating device 40 to be described below.

Method of Setting Fixing Target Temperature

Figure 4:
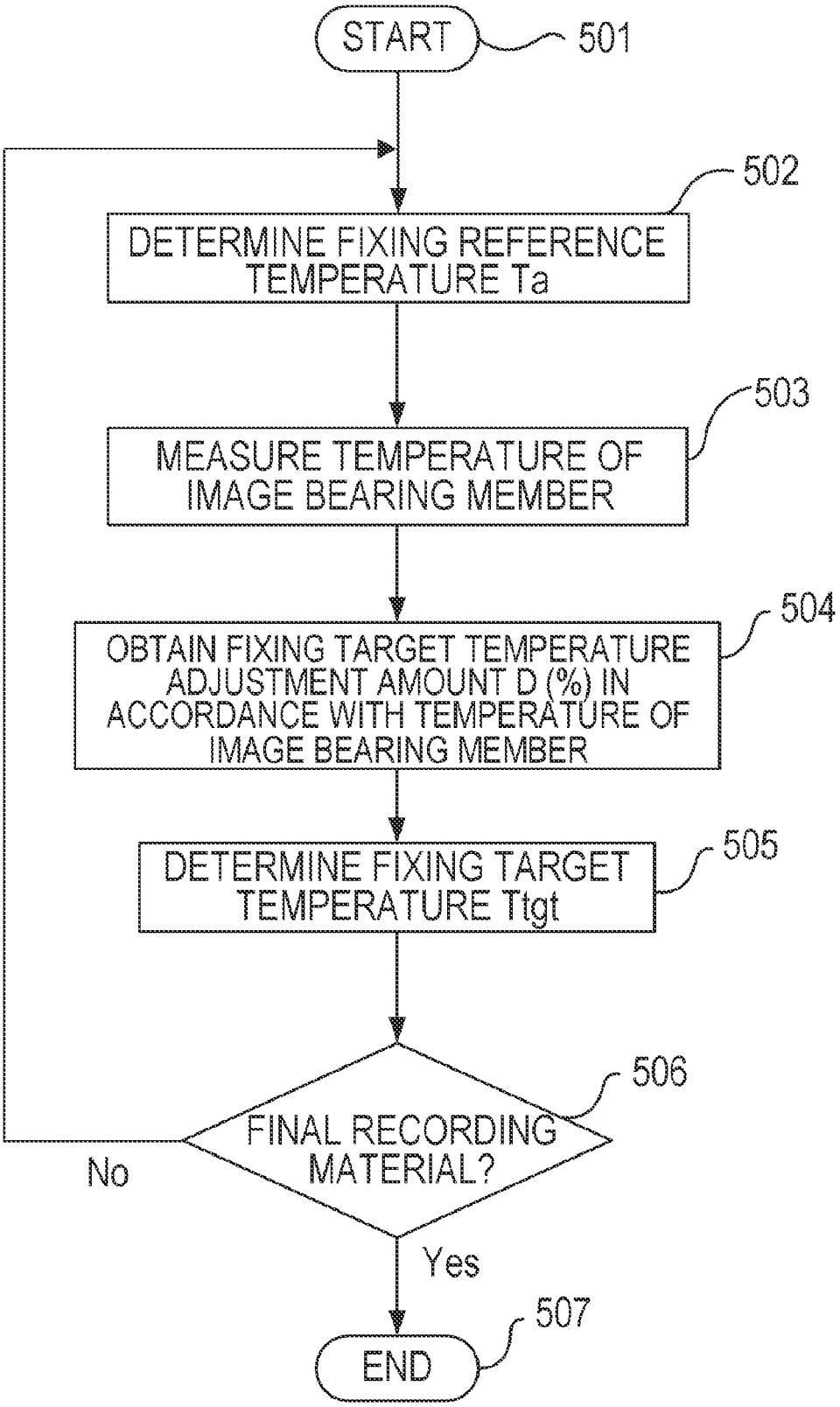
FIG. 4 is a flowchart illustrating a method of setting a fixing target temperature.

Next, a method of setting the fixing target temperature, which is a characteristic of the present example, will be described. FIG. 4 is a flowchart according to the present example. When a printing job (501) starts, a fixing reference temperature Ta is first determined as a reference target temperature (502). In the present example, the fixing temperature Ta is a parameter determined based on a sheet basis weight. The user inputs the sheet basis weight of the recording material 11 to be used to an operation panel (not illustrated) and the control portion 108 sets the fixing reference temperature Ta in accordance with the sheet basis weight based on Table 1.

TABLE 1

Relation between sheet basis weight and fixing reference temperature Ta

| Sheet basis weight | Fixing reference temperature Ta |
|---|---|
| 60 g/m$^2$ | 170° C. |
| 70 g/m$^2$ | 175° C. |
| 80 g/m$^2$ | 180° C. |

In the present example, the fixing reference temperature is determined based on the sheet basis weight. However, for example, the fixing reference temperature may be determined in accordance with a size or smoothness of a sheet or a toner mounting amount of each print image.

Figure 5A:
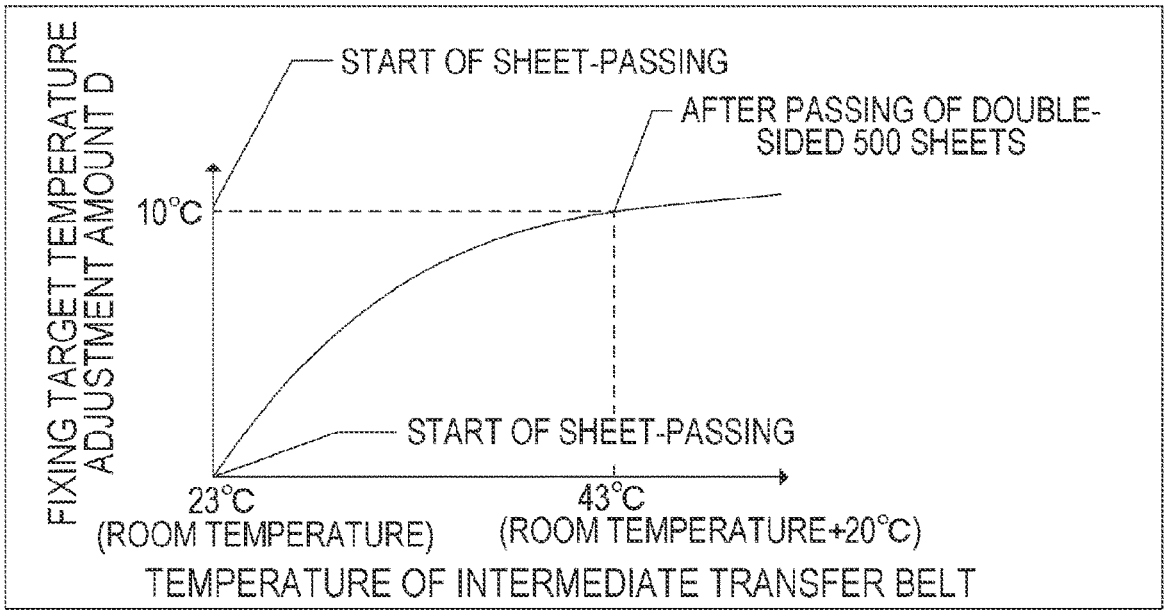
FIGS. 5A and 5B are diagrams illustrating a relation between a temperature of an image bearing member and a fixing target temperature adjustment amount D.

Subsequently, the belt thermistor 30 measures a temperature of the intermediate transfer belt 28 (503) and a fixing target temperature adjustment amount D in accordance with the temperature of the intermediate transfer belt 28 is obtained (504). As illustrated in FIG. 5A, the fixing target temperature adjustment amount D is a parameter set in advance in accordance with the temperature of the intermediate transfer belt 28. The fixing target temperature adjustment amount D is larger as the temperature of the intermediate transfer belt 28 is raised. Finally, a fixing target temperature Ttgt is calculated and determined by Expression (1) (505).

$$Ttgt = Ta - D \tag{1}$$

502 to 505 are repeated until the final recording material 11 is printed, and then the printing job ends (506).

Here, to check an advantageous effect when the fixing target temperature of the heating device is controlled based on the temperature of the intermediate transfer belt 28 according to the present example, the following comparative experiment is carried out to make comparison with the technology of the related art. Conditions of the comparative experiment are that a conveying speed of the recording material is 300 mm/sec, a printing speed (throughput) is 60 ppm, and the recording material is RedLabel manufactured by Canon Oce and is an A4 sheet with a sheet basis weight of 80 g/m$^2$. The fixing reference temperature Ta of RedLabel is 180° C. from Table 1.

Figure 6:
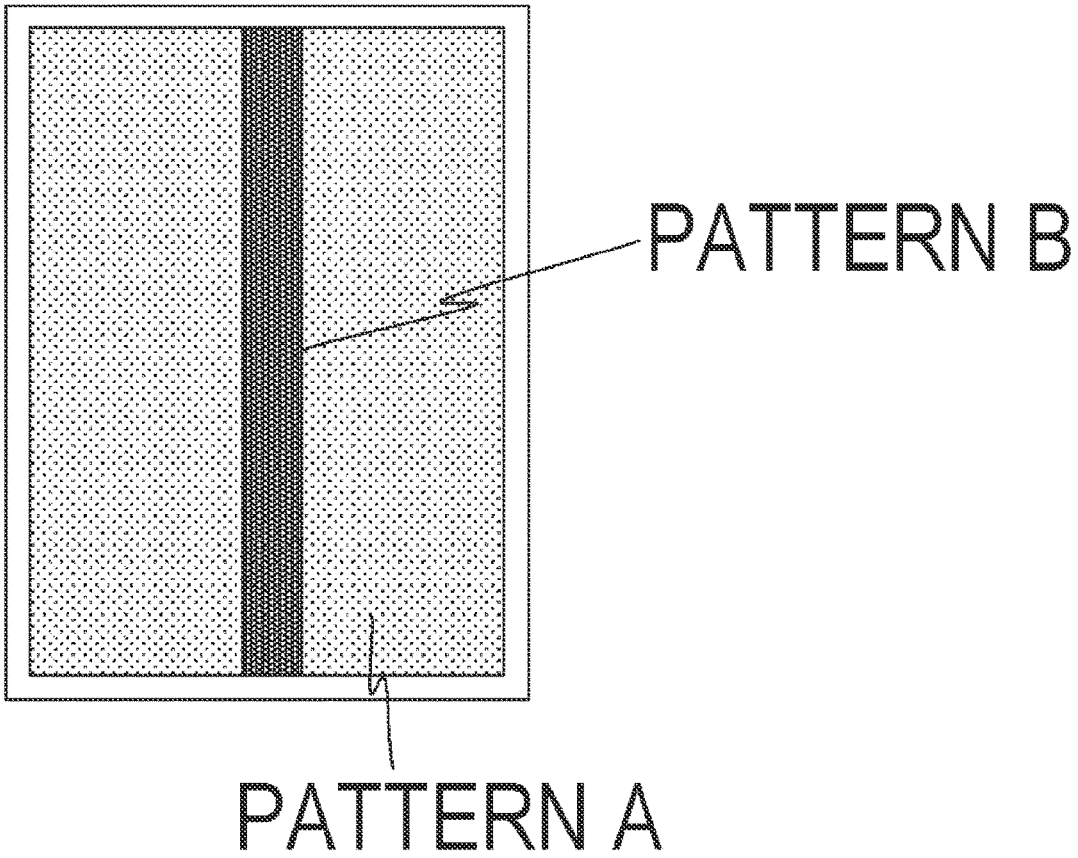
FIG. 6 is a schematic view illustrating an image pattern used for a comparative experiment.

FIG. 6 is a schematic view illustrating an image pattern used for a comparative experiment. A high-print image (Y: 100% and M: 100%) with a pattern B is printed in addition to a low-print halftone image (Bk: 5%). The image is generated using a YMCK color mode of Photoshop CS4 manufactured by Adobe corporation.

The comparative experiment is preferably carried out in an environment managed under constant temperature and humidity conditions by air conditioning of an air conditioner or the like. In the present example, the comparative experiment is carried out in an environment of a temperature of 23° C. and a relative humidity of 50%. After the image forming apparatus body is left unattended and cooled until 23° C., intermittent printing of pausing 10 seconds every one-sided printing is performed repeatedly until 20 sheets are printed. The one-sided intermittent printing is performed to warm the heating device and to warm the pressurization roller with a large thermal capacity, which is a constituent member of the heating device, substances inside the fixing film, and an atmosphere inside the heating device. While the heating device is warmed, the comparative experiment is carried out under the conditions that inner components such as the intermediate transfer belt and the photosensitive drum other than the heating device are as cool as possible. By doing so, it is possible to exclude an influence of a variation in a warming state of the heating device during the comparative experiment and clearly ascertain an influence of an increase in the temperature of the internal components such as the intermediate transfer belt or the photosensitive drum and an advantageous effect of the present example corresponding to this influence.

Figure 7A:
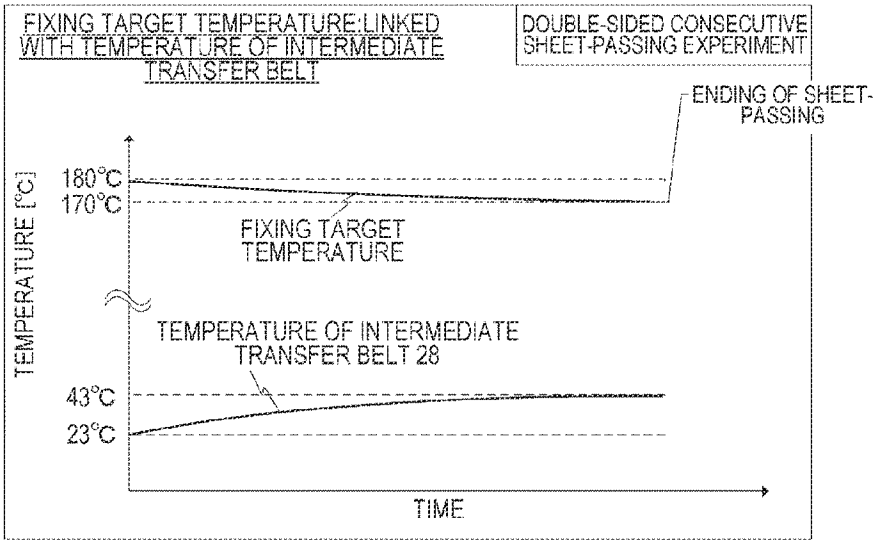
FIGS. 7A and 7B are diagrams illustrating a result of the comparative experiment when control of the first example is used.
Figure 8:
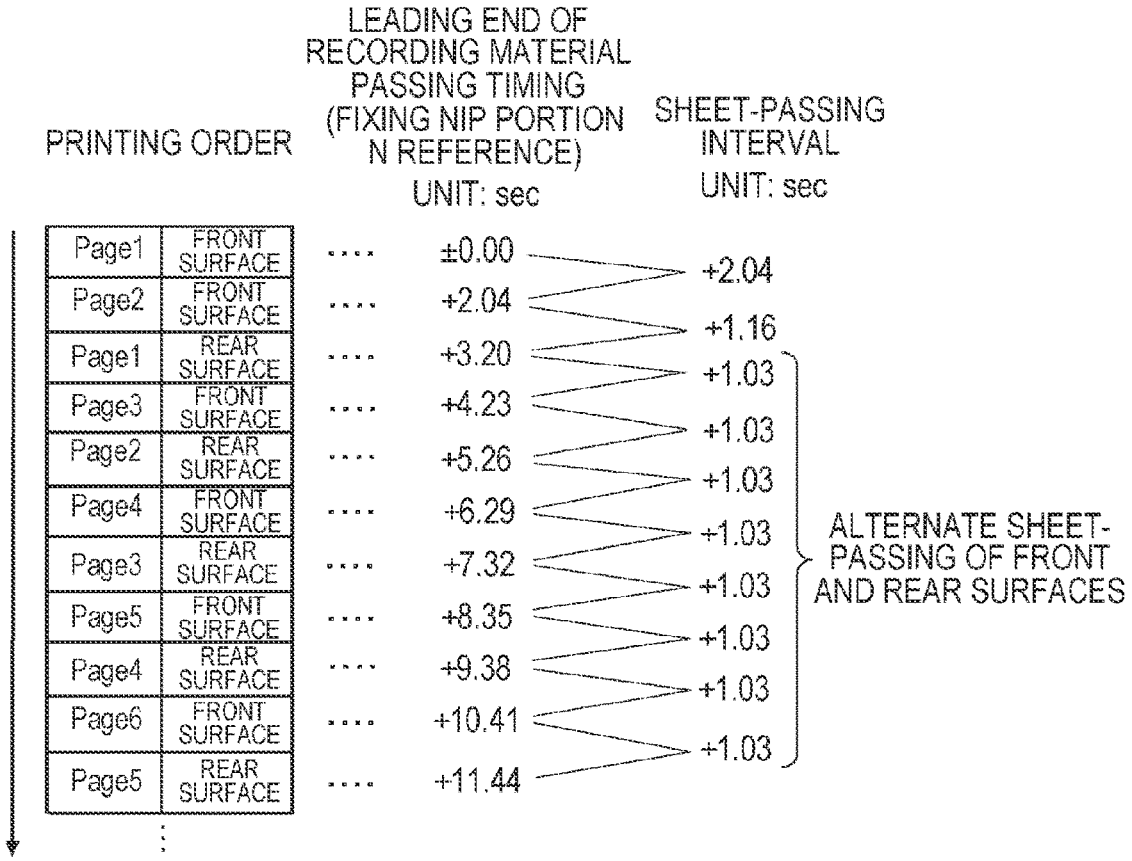
FIG. 8 is a table illustrating a sheet-passing sequence and a sheet-passing interval in the comparative experiment (double-sided two-sheet waiting)

FIG. 7A illustrates a result of a double-sided consecutive sheet-passing experiment using the control of the present example, and the fixing target temperature and a temperature transition of the intermediate transfer belt 28 when consecutive passing of 500 sheets (a total of 1000 images of the first and second surfaces) is performed on double sides. FIG. 8 is a table illustrating a sheet-passing sequence and a sheet-passing interval in the double-sided consecutive printing in this experiment. A sheet-passing method of printing both front and rear surfaces alternatively (front and rear alternate sheet-passing of double-sided two-sheet waiting) in a state in which two A4 recording materials are ready in the conveyance path of the image forming apparatus body is performed. An interval between the recording materials in the recording material conveying direction in the alternate sheet-passing is 12 mm.

As illustrated in FIG. 7A, it can be understood that the temperature of the intermediate transfer belt 28 increases simultaneously with start of the double-sided consecutive sheet-passing and the fixing target temperature is lowered with the increase in the temperature of the intermediate transfer belt 28. Specifically, before and after the double-sided consecutive printing, the temperature of the intermediate transfer belt 28 is raised from the room temperature (23° C.) to 43° C. and the fixing target temperature is lowered from 180° C. to 170° C. in the meanwhile. This is because the fixing target temperature adjustment amount D is set to be large in accordance with a warming state of the intermediate transfer belt 28, as described above. By doing so, the fixing target temperature can be lowered as the temperature of the intermediate transfer belt 28 is raised, and therefore excellent fixing can be maintained without over-fixing or a fixing defect. Here, a main cause of the increase in the temperature of the intermediate transfer belt in double-sided printing is an influence of the recording material 11 warmed once by the heating device and passing again in secondary transfer processing for the second surface image forming. Besides, heat released from the heating device or frictional heat in the development unit or a rotational portion of the primary or secondary transfer portion can be another cause.

TABLE 2

| Temperature of recording material in image forming apparatus | | |
|---|---|---|
| | First surface | Second surface |
| A. in feeding tray 12 | 23° C. | — |
| B. right after secondary transfer processing | 30° C. | 50° C. |
| C. right after passing fixing nip portion N | 100° C. | 110° C. |
| D. near switchback roller 63 | 78° C. | — |
| E. near double-sided roller 65 | 55° C. | — |
| F. near discharging roller 61 | — | 85° C. |

Table 2 shows a temperature of the recording material 11 in the image forming apparatus when 490 sheets are passed in the double-sided consecutive sheet-passing experiment using the control of the present example. The temperature of the recording material is raised from the room temperature of 23° C. to 30° C. (B) right after the secondary transfer processing in the first surface image forming, and is heated up to 100° C. by the heating device 40 (C) right after passing through the fixing nip portion N. Further, the temperature is lowered up to 78° C. (D) near the switchback roller 63 and is lowered up to 55° C. near (E) the double-sided roller 65, and the recording material 11 reaches the secondary transfer processing. Further, the temperature of the recording material becomes 50° C. (B) right after the secondary transfer processing in the second surface image forming, and is heated by the heating device 40 up to 110° C. (C) right after passing through the fixing nip portion N. and becomes 85° C. (F) near the discharging roller 61. Then, the recording material is discharged to the discharging tray 62. The temperatures A to F of the recording material are obtained by disposing a thermocouple in a recording material conveyance path for the experiment and measuring the temperature of the recording material during an image forming operation.

As understood from Table 2, when the recording material 11 passes through the secondary transfer processing again for the second surface image forming, the temperature becomes about 50° C. Then, the temperature of the intermediate transfer belt 28 is gradually raised from the room temperature (23° C.) because of the warmed recording material 11 which is a main cause. Because the intermediate transfer belt 28 of which the temperature is raised warms the recording material 11 of the first surface in the secondary transfer processing, it is possible to inhibit an amount of heat added to the recording material 11 by the heating device 40. Thus, the fixing target temperature can be lowered. On the other hand, when the fixing target temperature is not lowered, the recording material 11 is further warmed. Therefore, the increase in the internal temperature including an increase in the temperature of the intermediate transfer belt 28 is further worsened. The increase in the internal temperature including the intermediate transfer belt in double-sided printing is easily worsened because many recording materials 11 are circulated in the apparatus as a conveying speed of the recording material or a printing speed (throughput) in the image forming apparatus body is faster. As the image forming apparatus body is miniaturized, the amount of heat of a member serving as the intermediate transfer belt 28 decreases, the temperature inside the apparatus is easily raised, and therefore the increase in the internal temperature is easily worsened.

Figure 7B:
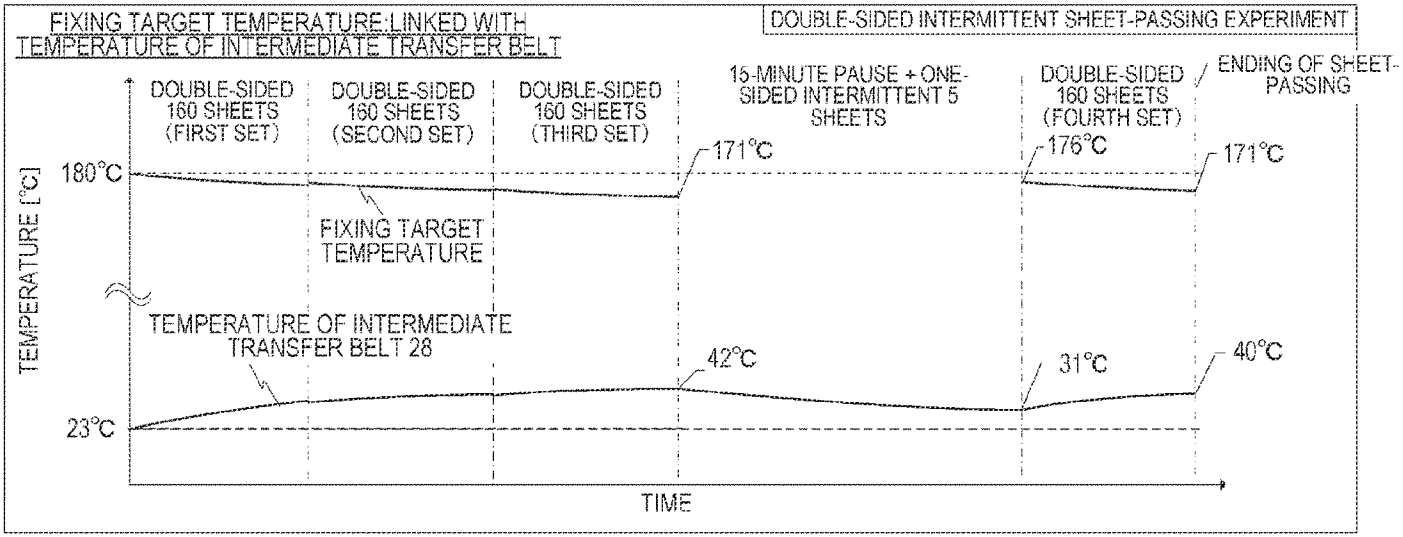

FIG. 7B illustrates a result of a double-sided intermittent sheet-passing experiment using the control of the present example. That is, FIG. 7B illustrates the fixing target temperature and a temperature transition of the intermediate transfer belt 28 in an experiment in which double-sided printing of two-sheet waiting is performed in four sets of 160 consecutive sheets (a sum of 320 images on the first and second surfaces) with a pause. The pause time is set to 10 seconds between the first and second sets, 10 seconds between the second and third sets, and 15 minutes between the third and fourth sets. Before the fourth set starts, intermittent printing of pausing 10 seconds every one-sided printing is performed repeatedly until 5 sheets are printed, and then the heating device 40 is warmed again. Between the first to fourth sets, the temperature of the intermediate transfer belt 28 is raised intermittently and the temperature is raised to 40° C. at the time of ending of the fourth set. Meanwhile, the fixing target temperature is lowered from the initial temperature of 180° C. to 171° C. In the experiment using the control of the present example, no fixing defect occurs in both the double-sided consecutive sheet-passing experiment and the double-sided intermittent sheet-passing experiment.

Figure 9A:
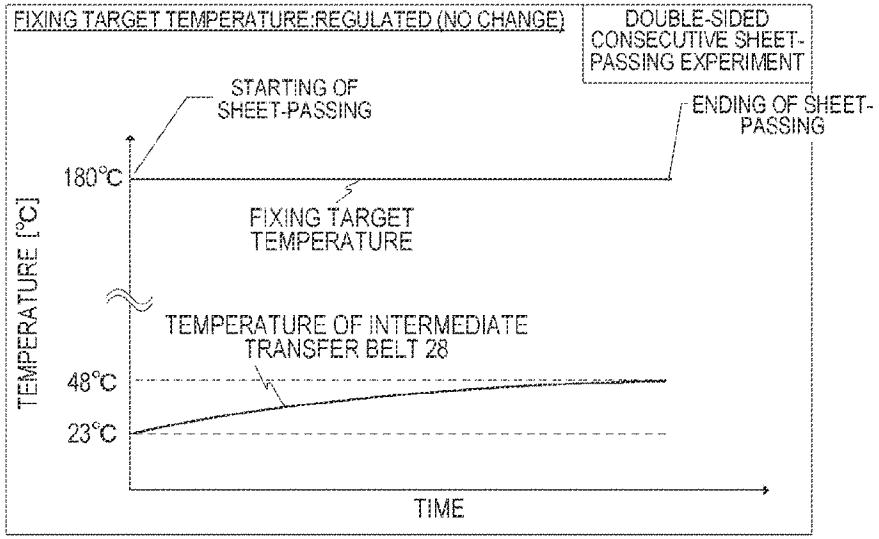
FIGS. 9A and 9B are diagrams illustrating a result of a comparative experiment when control (fixing target temperature regularization control) of a first comparative example is used.

FIG. 9A illustrates a fixing target temperature and a temperature transition of the intermediate transfer belt 28 when a double-sided consecutive sheet-passing experiment is carried out using control of a first comparative example. Here, fixing target temperature control in that the fixing target temperature is regularized from the initial stage of the sheet-passing start is performed. As illustrated in FIG. 9A, when the fixing target temperature is regulated, the temperature of the intermediate transfer belt 28 is raised to 48° C., and thus it can be understood that the temperature is raised more than in the present example. This is a result in which the temperature of the intermediate transfer belt 28 is also excessively raised because the recording material 11 of the double-sided first surface enters a state in which an amount of heat is excessively added (an over-fixing state) and the recording material 11 is circulated in the apparatus when the fixing target temperature is regularized and the temperature of the intermediate transfer belt 28 is raised.

Figure 9B:
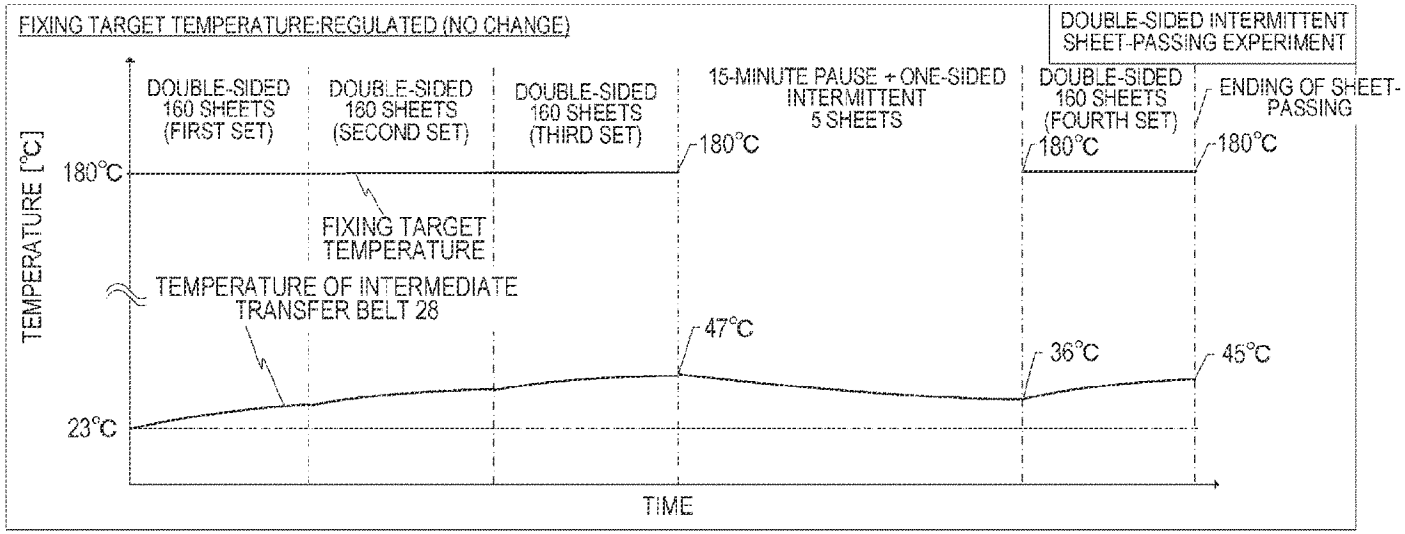

FIG. 9B illustrates a fixing target temperature and a temperature transition of the intermediate transfer belt 28 when a double-sided intermittent sheet-passing experiment is carried out using the control of the first comparative example (fixing target temperature regularization). The temperature of the intermediate transfer belt 28 is raised intermittently between the first to fourth sets and is raised to 45° C. at the time of ending of the fourth set. In the experiment of the first comparative example using fixing target temperature regularization control, no fixing defect occurs in both the double-sided consecutive sheet-passing experiment and the double-sided intermittent sheet-passing experiment. However, in the sheet-passing latter half of the double-sided consecutive sheet-passing experiment or the double-sided intermittent sheet-passing experiment, an image defect (hot offset) due to over-fixing occurs. To take countermeasures against the hot offset in the sheet-passing latter half of the double-sided consecutive sheet-passing in the fixing target temperature regularization control, a method of lowering the fixing target temperature uniformly can be used. However, in this case, a fixing defect is likely to occur in the initial stage (first to tenth sheets) of the consecutive sheet-passing start.

Figure 10A:
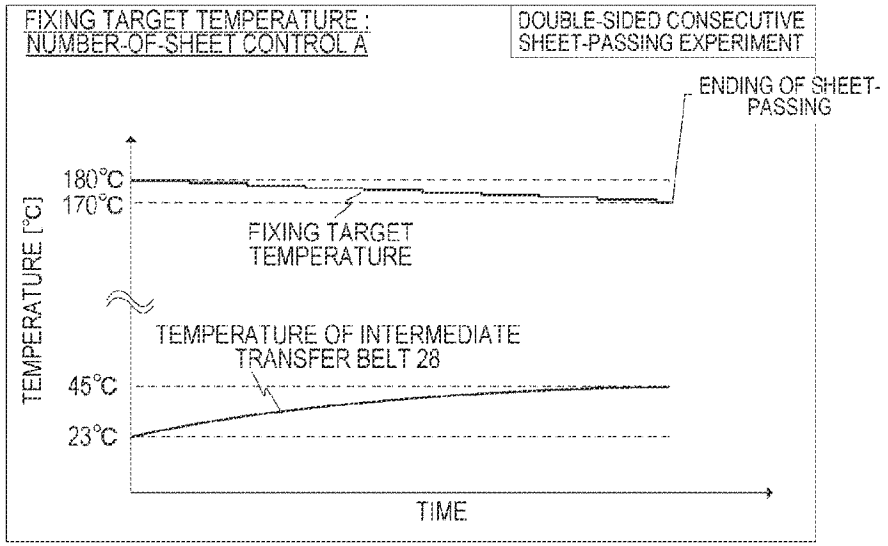
FIGS. 10A and 10B are diagrams illustrating a result of a comparative experiment when control (number-of-sheets control A) of a second comparative example is used.

FIG. 10A illustrates a fixing target temperature and a temperature transition of the intermediate transfer belt 28 when a double-sided consecutive sheet-passing experiment is carried out using control of a second comparative example. Here, fixing target temperature control (number-of-sheets control A) in which a target temperature is lowered by 1° C. step by step every 50 double-sided sheets (a sum of 100 images on the first and second surfaces) using a sheet-passing start of the fixing target temperature as a reference will be described. A maximum of a temperature lowering amount is set to 15° C. In the fixing target temperature control (number-of-sheets control A), when sheet-passing is stopped temporarily, a temperature lowering amount is reset through the number-of-sheets control and returns to an initial value (in the present case, 180° C.) at the time of a subsequent sheet-passing start. As illustrated in FIG. 10A, when the fixing target temperature is subjected to the number-of-sheets control, the fixing target temperature can be lowered step by step from 180° C. to 170° C. in the double-sided consecutive sheet-passing experiment. As a result, a temperature of the intermediate transfer belt 28 after the experiment is 45° C. which is higher than in the present example. However, the temperature is reduced to be lower than in the fixing target temperature regularization control.

Figure 10B:
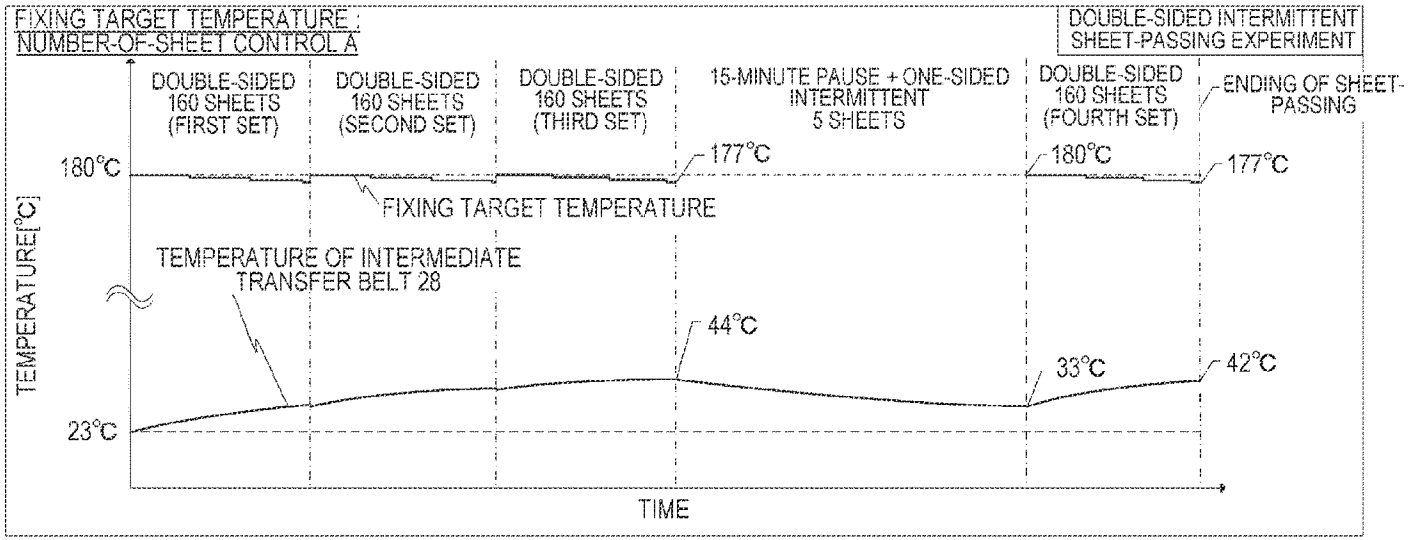

FIG. 10B illustrates a fixing target temperature and a temperature transition of the intermediate transfer belt 28 when a double-sided intermittent sheet-passing experiment is carried out using the control of the second comparative example (number-of-sheet control A). The temperature of the intermediate transfer belt 28 is raised intermittently between the first to fourth sets and is raised to 42° C. at the time of ending of the fourth set. This is because, in the present fixing target temperature control, the fixing target temperature in the double-sided intermittent sheet-passing experiment is lowered from 180° C. to 177° C. since the temperature lowering amount is reset by the number-of-sheets control with the ending of each set. As a result, the over-fixing condition is satisfied for the recording material 11 in a state in which the temperature of the intermediate transfer belt 28 and the image forming apparatus is raised in the fourth set or the like. At this time, an image defect (hot offset) occurs. To take countermeasures against the hot offset in the sheet-passing latter half of the double-sided intermittent sheet-passing using the number-of-sheets control, a method of lowering the fixing target temperature from the initial stage can be used. However, in this case, a fixing defect is likely to occur in the initial stage (first to tenth sheets) of the consecutive sheet-passing start.

Figure 11A:
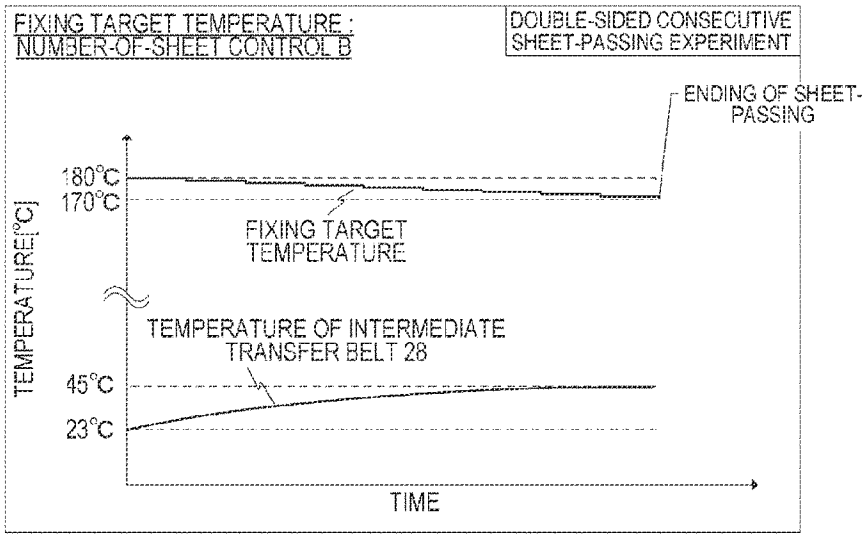
FIGS. 11A and 11B are diagrams illustrating a result of a comparative experiment when control (number-of-sheets control B) of a third comparative example is used.

FIG. 11A illustrates a fixing target temperature and a temperature transition of the intermediate transfer belt 28 when a double-sided consecutive sheet-passing experiment is carried out using control of a third comparative example 3. Here, fixing target temperature control (number-of-sheets control B) in which a target temperature is lowered by 1° C. step by step every 50 double-sided sheets (a sum of 100 images on the first and second surfaces) using a sheet-passing start of the fixing target temperature as a reference will be described. A maximum of a temperature lowering amount is set to 15° C. As illustrated in FIG. 11A, as in the second comparative example, the fixing target temperature can be lowered step by step from 180° C. to 170° C. in the double-sided consecutive sheet-passing experiment. As a result, a temperature of the intermediate transfer belt 28 after the experiment is 45° C. which is higher than in the present example. However, the temperature is reduced to be lower than in the fixing target temperature regularization control.

Figure 11B:
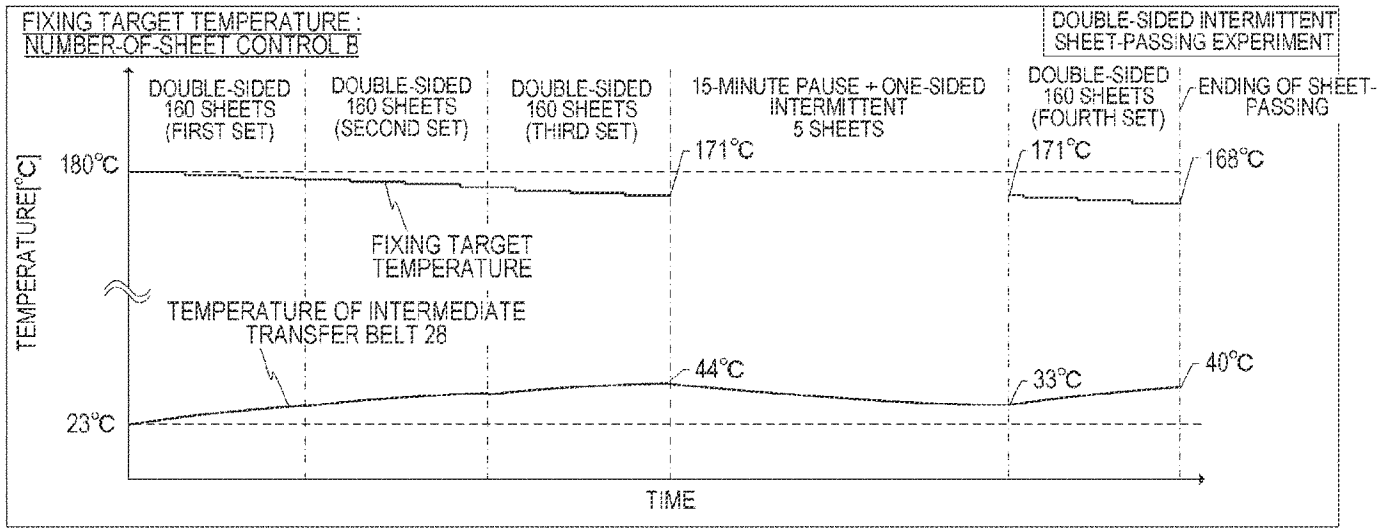

FIG. 11B illustrates a fixing target temperature and a temperature transition of the intermediate transfer belt 28 when a double-sided intermittent sheet-passing experiment is carried out using the control of the third comparative example (number-of-sheet control B). The temperature of the intermediate transfer belt 28 is raised intermittently between the first to fourth sets and is raised to 40° C. at the time of ending of the fourth set. In the fixing target temperature control (number-of-sheet control B), a cold offset occurs due to a fixing defect in the initial stage (first to tenth sheets) of the sheet-passing start of the fourth set. This is because the fixing target temperature is lowered to 171° C. at the time of ending of the third set, the temperature of the intermediate transfer belt 28 is lowered from 44° C. to 33° C. in a long pause time (for 15 minutes) of the third set to the fourth set, and the sheet-passing of the fourth set is performed at the same fixing target temperature (171° C.) as that of the third set.

Table 3 is a list table in which results of the comparative experiments are summarized.

TABLE 3

List of results of comparative experiments

| | Fixing target temperature control | Comparative experiment | Fixing target temperature | Temperature of intermediate transfer belt | Whether image defect occurs | Fixing consumption power |
|---|---|---|---|---|---|---|
| This example | Linked with intermediate transfer belt | Double-sided consecutive sheet-passing | 180° C. → 170° C. | 43° C. | No | 500 W |
| | | Double-sided intermittent sheet-passing | 180° C. → 171° C. | 40° C. | No | 510 W |
| First comparative example | Regulated | Double-sided consecutive sheet-passing | Regulated to 180° C. | 48° C. | Hot offset | 600 W |
| | | Double-sided intermittent sheet-passing | Regulated to 180° C. | 45° C. | Hot offset | 600 W |
| Second comparative example | Number-of-sheet control A | Double-sided consecutive sheet-passing | 180° C. → 170° C. | 45° C. | No | 500 W |
| | | Double-sided intermittent sheet-passing | 180° C. → 177° C. | 42° C. | Hot offset | 570 W |
| Third comparative example | Number-of-sheet control B | Double-sided consecutive sheet-passing | 180° C. → 170° C. | 45° C. | No | 500 W |
| | | Double-sided intermittent sheet-passing | 180° C. → 168° C. | 40° C. | Cold offset | 480 W |

In Table 3, transitions of the fixing target temperatures, the temperatures after the increase in the temperatures of the intermediate transfer belt 28 in the comparative experiments, whether an image defect occurs, and an average fixing consumption power of last five sheets in the comparative experiments are compared. The transitions of the fixing target temperatures, the temperatures after the increase in the temperatures of the intermediate transfer belt 28 in the comparative examples, the results of whether an image defect occurs have been described above. For the fixing consumption power, in the present example, the fixing target temperature is set in accordance with an increase in the temperature of the intermediate transfer belt. Therefore, the fixing consumption power is set to be low since an amount of heat (power) is not excessively added to the recording material 11.

As described above, by setting the fixing target temperature suitable for the intermediate transfer belt according to the present example, it is possible to appropriately set the fixing target temperature in the condition of the double-sided consecutive sheet-passing or the like accompanied with the increase in the internal temperature. As a result, the fixing processing can be performed by applying an appropriate amount of heat appropriate for the recording material 11, and thus it is possible to obtain advantages of inhibiting an image defect such as over-fixing or a fixing defect, inhibiting an increase in the temperature of the intermediate transfer belt, and inhibiting the fixing consumption power. For the change in the fixing target temperature based on the temperature of the intermediate transfer belt, in the present example, the method of changing the fixing target temperature in only the double-sided printing has been described, but it is not necessarily limited to the double-sided printing. Since a minimum amount of heat necessary to fix a recording material at a temperature of the intermediate transfer belt is also changed in one-sided printing, the fixing target temperature may also be changed based on the temperature of the intermediate transfer belt in one-sided printing.

Figure 2C:
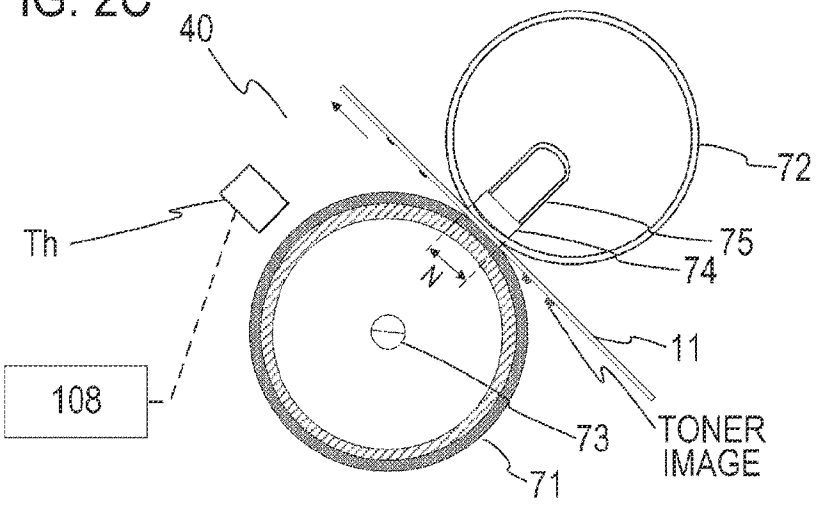

In the configuration of the heating device 40, in the present example, the fixing thermistor Th serving as a temperature detecting member is disposed at a position at which a surface temperature of the fixing film 41 is measured in a contactless manner, but another configuration may be used. For example, as illustrated in FIG. 2B, the heating device 40 may be disposed on the rear surface of the heater 42 and a temperature of the fixing film 41 may be controlled to match the fixing target temperature. The configuration of the heating device 40 is not limited to the configuration illustrated in FIG. 2A either. For example, the configuration illustrated in FIG. 2C may be used. That is, a fixing roller 71 serving as a fixing member, a pressurization film 72 serving as a pressurization member, a halogen heater 73 serving as a heating member, a holding member 74 that is pressurized by a pressurization mechanism (not illustrated) from the inner surface of the pressurization film 72 to the fixing roller 71, and a stay 75 are included. A target temperature of the fixing roller 71 is controlled by the fixing thermistor Th. That is, for the heating device, a configuration suitable for requirements such as cost and a size of the image forming apparatus may be selected.

Figure 12A:
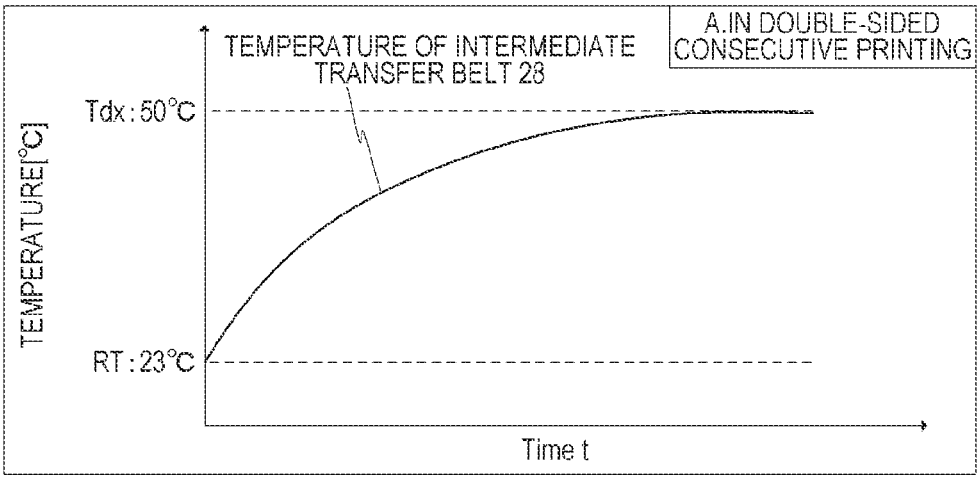
FIGS. 12A to 12C are diagrams illustrating a transition of a temperature of an intermediate transfer belt in double-sided/one-sided/body stopping.
Figure 12B:
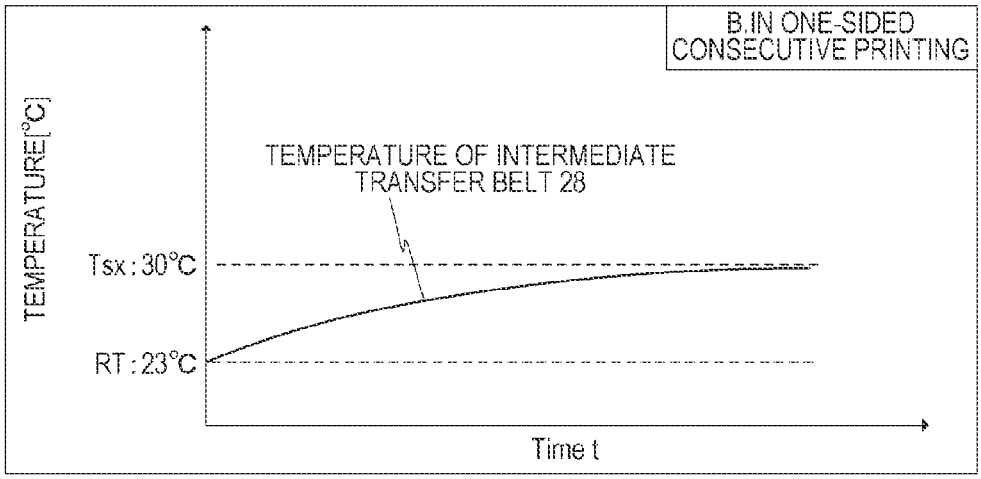
Figure 12C:
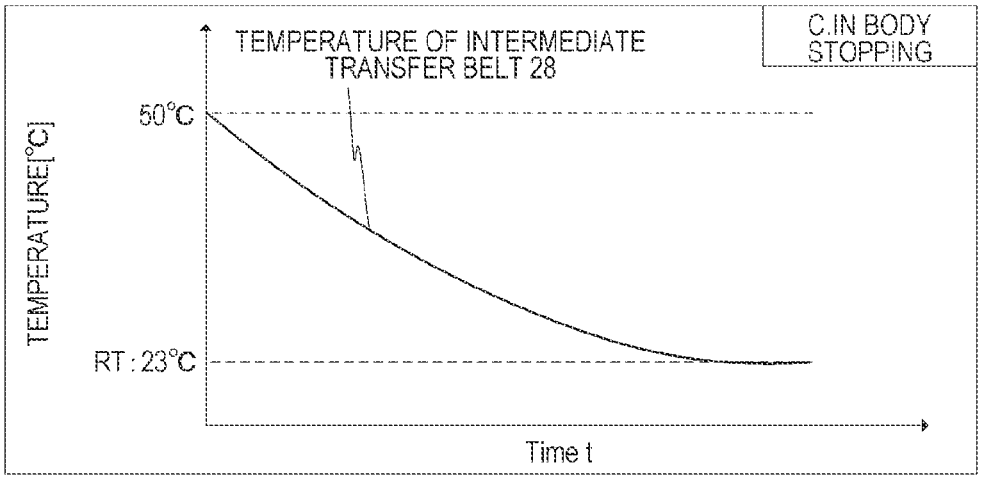

A temperature of the intermediate transfer belt 28 is actually measured using the belt thermistor 30 in the present example, but the temperature detecting unit that directly acquires a temperature of the intermediate transfer belt 28 may not be provided and a temperature of the intermediate transfer belt 28 may be predicted and acquired from information such as an activation situation of the image forming apparatus. For example, an increase in the temperature in pre-printing, a decrease in the temperature at the time of waiting, or the like may be ascertained in detail in advance and a predicted temperature of the intermediate transfer belt 28 may be acquired in combination with an activation situation of the image forming apparatus (a transfer portion temperature prediction method). FIGS. 12A to 12C illustrate temperatures of the intermediate transfer belt measured in advance in the following three states. FIG. 12A illustrates a phase of an increase in the temperature of the intermediate transfer belt in double-sided consecutive printing. The temperature of the intermediate transfer belt is raised from a room temperature (RT) of 23° C. to a saturation temperature (Tdx) of 50° C. FIG. 12B illustrates a phase of an increase in the temperature of the intermediate transfer belt in one-sided consecutive printing. The temperature of the intermediate transfer belt is raised from the room temperature (RT) of 23° C. to a saturation temperature (Tsx) of 30° C. FIG. 12C illustrates a phase of a decrease in the temperature of the intermediate transfer belt in body stopping. The temperature of the intermediate transfer belt is raised from a temperature increase state (50° C.) to a saturation temperature (Twx) of 23° C. (room temperature). At this time, the temperature of the intermediate transfer belt can be predicted by the following prediction Expressions (2) and (3).

$$Tb(1) = Tb(t-1) + \Delta Tb \tag{2}$$

$$\Delta Tb = [Tdx - Tb(t-1)] \times Kd \times Ed + [Tsx - Tb(t-1)] \times Ks \times Es + [Twx - Tb(t-1)] \times Kw \times Ew \tag{3}$$

Here, Tb(t) indicates a predicted value of the temperature of the intermediate transfer belt at a time t. The time t is a time of every second. From Expression (2). Tb(t) is obtained by summing ΔTb and a predicted value Tb(t−1) of the temperature of the intermediate transfer belt at a time t−1. From Expression (3), ΔTb can be expressed by the saturation temperature (Tdx) in the double-sided consecutive printing, the saturation temperature (Tdx) in the one-sided consecutive printing, a difference between the Tb(t−1) and the saturation temperature (Twx) in the body stopping, constants K (Kd, Ks, and Kw), and variables E (Ed, Es, and Ew). Here, the variables E vary in accordance with an activation situation of the image forming apparatus body. Ed=1, Es=0, and Ew=0 are satisfied in the double-sided printing. Ed=0, Es=1, and Ew=0 are satisfied in the one-sided printing, and Ed=0. Es=0, and Ew=1 are satisfied in the body stopping. That is, in Expression (3), terms are divided in the double-sided printing, the one-sided printing, and the body stopping. The variables E determine which terms are validated. The terms are expressed by the differences between the saturation temperatures (Tdx, Tsx, and Twx) and Tb(t−1). For example, when the double-sided printing continues for a long time, Tb(t−1) In Expression (3) becomes close to Tdx and ΔTbF≈0 is satisfied. Therefore, Tb(t) in Expression (2) approaches the saturation temperature Tdx in the double-sided printing as much as possible. When this continues for a long time in the one-sided printing or the body stopping similarly, Tb(t) approaches Tsx and Twx. The constants K (Kd, Ks, and Kw) are constants for adjusting the estimated values and the actually measured values to be matched in the double-sided printing, the one-sided printing, and the body stopping.

Figure 13:
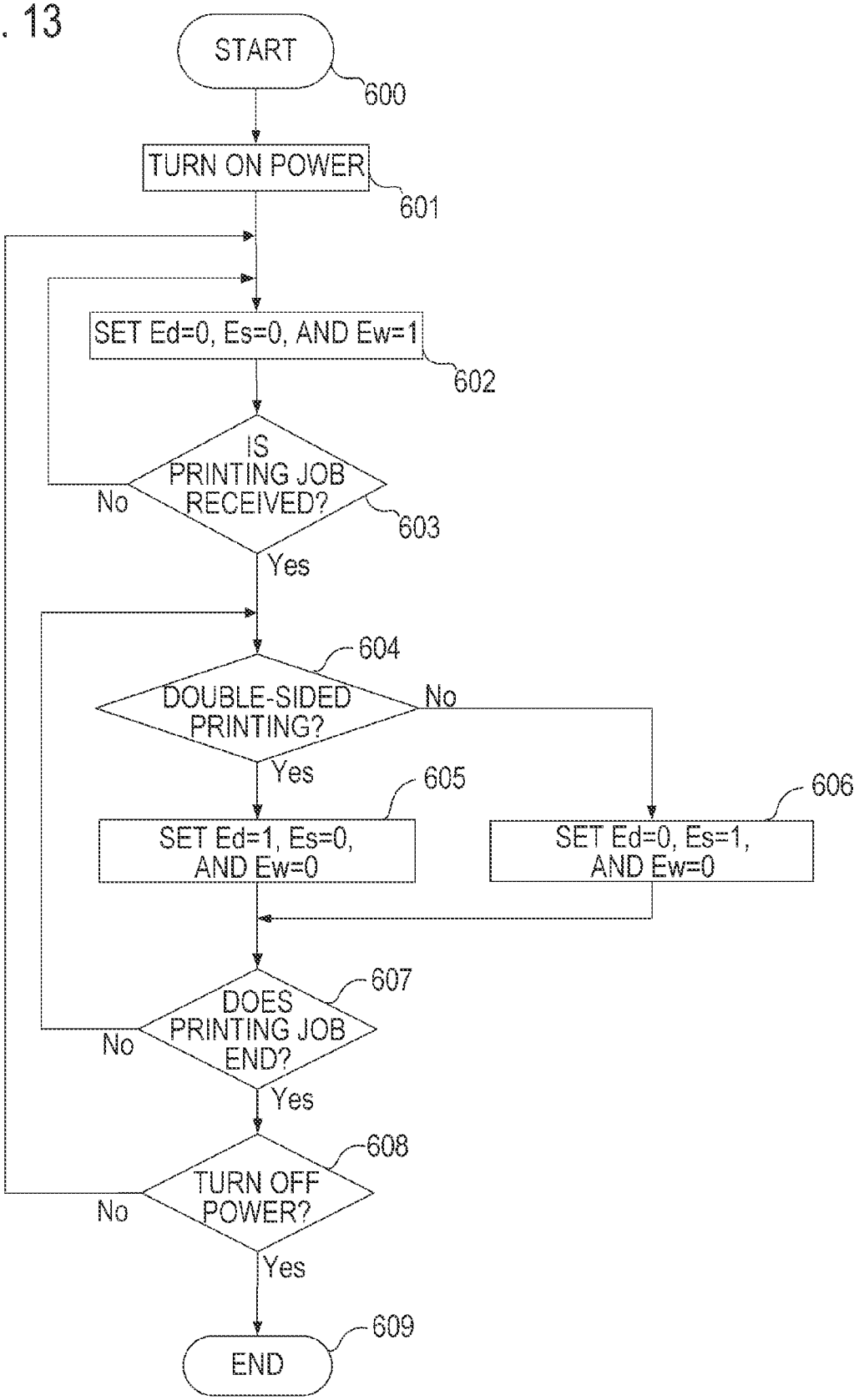
FIG. 13 is a flowchart illustrating determination of a variable E for calculating an intermediate transfer belt predicted value.

The variables E (Ed, Es, and Ew) in Expression (3) are determined in the flowchart of FIG. 13 based on the activation situation of the image forming apparatus body. When a power switch (not illustrated) of the image forming apparatus is turned on (601), a belt temperature prediction expression Tx(t) is set to a prediction expression Tw(t) in the waiting (602). When a printing job is received (603), it is determined whether the printing job is double-sided printing (604). In the case of the double-sided printing, the belt temperature prediction expression Tx(t) is set in the prediction expression Td(t) in the waiting (605). In the case of the one-sided printing, the belt temperature prediction expression Tx(t) is set in the prediction expression Ts(t) in the waiting (606). When the processing of 604 to 606 is repeated until the printing job ends (607) and the printing job ends, the processing of 602 to 607 is repeated until the power is turned off (608). When the power is turned off the flow ends (609). It is possible to set the variables E in accordance with the activation state of the image forming apparatus body and predict the temperature of the intermediate transfer belt in detail by Expressions (2) and (3).

When the fixing target temperature is set, an appropriate configuration may be selected to match required precision. In the present example, the method of setting the fixing target temperature based on the temperature of the intermediate transfer belt serving as the image bearing member has been described. However, the fixing target temperature may be set based on a temperature of the secondary transfer roller serving as a counter member of the image bearing member. In the appropriate setting of the fixing target temperature at which excellent fixing can be obtained, a suitable method may be selected.

Second Example

In the first example, the method of setting the fixing target temperature based on the temperature of the intermediate transfer belt serving as the image bearing member coming into contact with the recording material 11 in a color image forming apparatus using a secondary transfer scheme has been described. In a second example, a method of setting a fixing target temperature based on a temperature of a photosensitive drum serving as an image bearing member coming into contact with the recording material 11 in a monochromic image forming apparatus using a direct transfer scheme of directly transferring an image from a photosensitive drum to the recording material 11 will be described.

Figure 14:
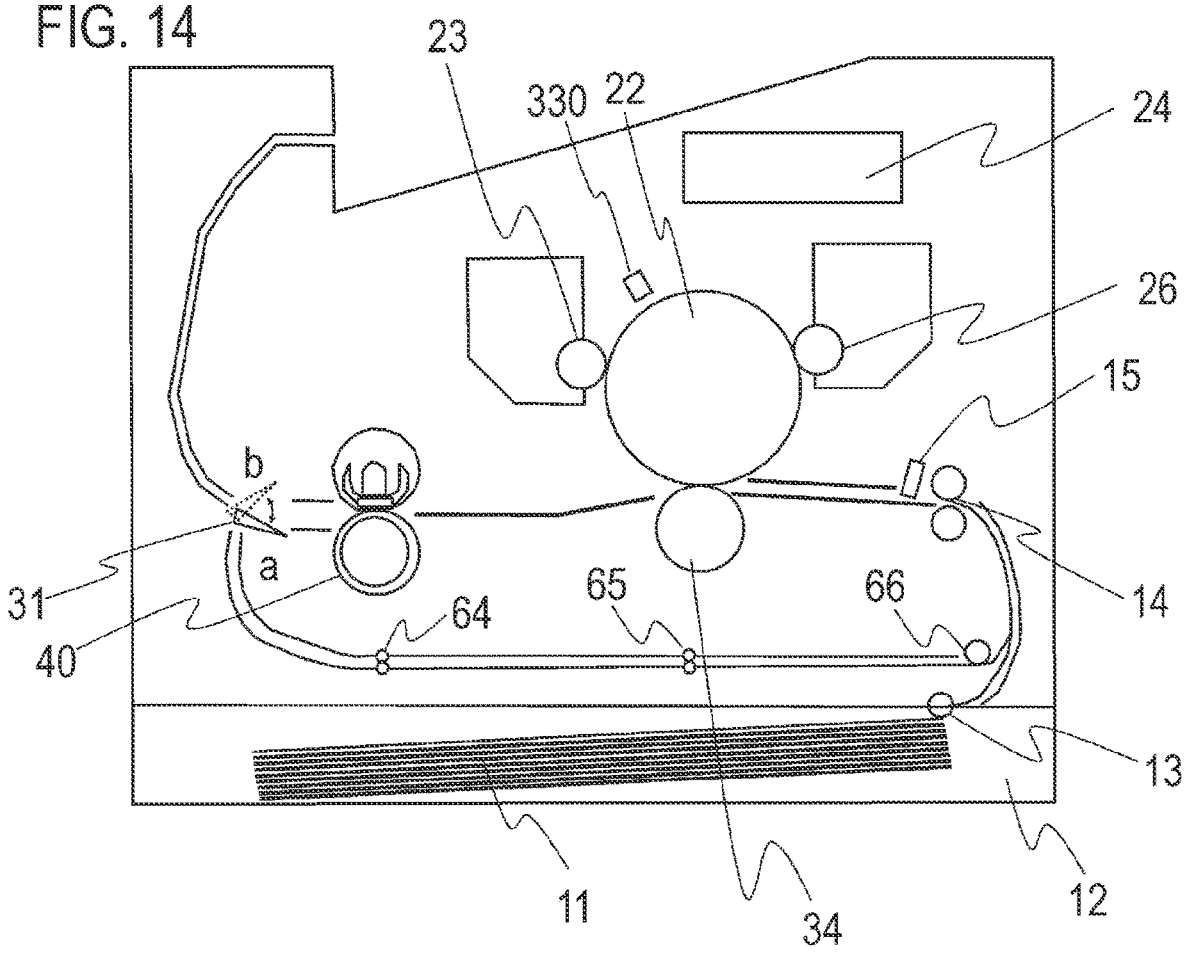
FIG. 14 is a sectional view illustrating an overall configuration of an image forming apparatus according to a second example.

FIG. 14 is a sectional view illustrating an overall configuration of a monochromic image forming apparatus according to the present example. The description of the content described above in the first example will be omitted. The drum thermistor 330 is a transfer portion temperature detecting unit that detects a temperature of the photosensitive drum 22. The photosensitive drum 22 has a configuration in which an organic photoconductive layer (with a thickness of 60 μm) is coated on the outer circumference of a hollow aluminum cylinder (with Φ30 and a thickness of 1.0 mm). The transfer roller 34 is a counter member coming into contact with the photosensitive drum 22 and has a cross-sectional configuration in which an elastic layer formed of NBR Hydrin with a thickness of 4 mm is formed on the core grid (Φ6), and a surface length of the elastic layer (in the axial direction) is 220 mm. The transfer roller 34 is brought into contact with the photosensitive drum 22 by an abutting mechanism (not illustrated) and an abutting pressure is 13 N at that time. Here, a contact width between the transfer roller 34 and the photosensitive drum 22 is 2.0 mm.

Figure 5B:
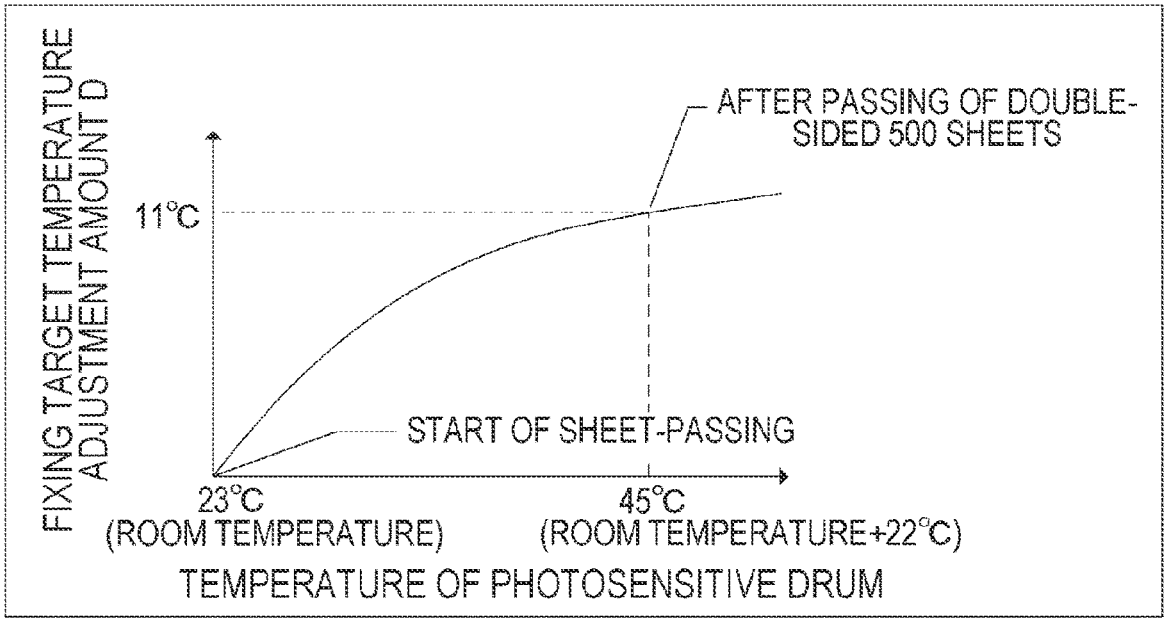

In the present example, the fixing target temperature adjustment amount D is a parameter that is set in advance in accordance with the temperature of the photosensitive drum 22, as illustrated in FIG. 5B. The fixing target temperature adjustment amount D is larger as the temperature of the photosensitive drum 22 is higher. In the present example, a fixing target temperature is linked based on the temperature of the photosensitive drum serving as an image bearing member. Thus, in the present example, for the reason similar to that of the first example, compared to the fixing target temperature regularization control or the number-of-sheets control which is existing control, it is possible to achieve inhibition of an increase in the temperature of the photosensitive drum, inhibition of the consumption power, and inhibition of an image defect such as over-fixing or a fixing defect. A temperature of the photosensitive drum is actually measured using the drum thermistor 330 in the present example. However, for example, since a photosensitive drum temperature detecting unit may not be provided, an increase in the temperature in printing, heat released at the time of waiting, or the like may be ascertained in detail in advance and a temperature of the photosensitive drum may be predicted in combination with an activation situation of the image forming apparatus. In the setting of the fixing target temperature, a configuration suitable for required precision may be selected.

In the present example, the method of setting the fixing target temperature based on a temperature of the photosensitive drum serving as an image bearing member has been described. However, the fixing target temperature may be set based on a temperature of the transfer roller serving as a counter member of the image bearing member. In the appropriate setting of the fixing target temperature at which excellent fixing can be obtained, a suitable method may be selected.

Third Example

Next, a third example of the present invention will be described. A basic configuration and an operation of an image forming apparatus and a heating device according to the third example are the same as those of the first example. Accordingly, the same reference numerals are given to elements that have the same or equivalent functions and configurations to those of the first example, and detailed description thereof will be omitted. In the first example, a warming state of the heating device 40 is fixed to clearly ascertain an influence of an increase in the temperature of the intermediate transfer belt or the photosensitive drum. The third example is an example in which a warming state of the heating device 40 is also changed and a fixing target temperature is changed in accordance with the change.

In the third example, the fixing reference temperature Ta shown in Table 4 is used. Table 1 shows the fixing reference temperature Ta in the warming state after 20 sheets are printed intermittently. Table 4 shows the fixing reference temperature Ta in a cooled state (a room temperature state) of the heating device 40.

TABLE 4

Relation between sheet basis weight and fixing reference temperature Ta (the room temperature state of the heating device 40)

| Sheet basis weight | Fixing reference temperature Ta |
|---|---|
| 60 g/m$^2$ | 180° C. |
| 70 g/m$^2$ | 185° C. |
| 80 g/m$^2$ | 190° C. |

Figure 15:
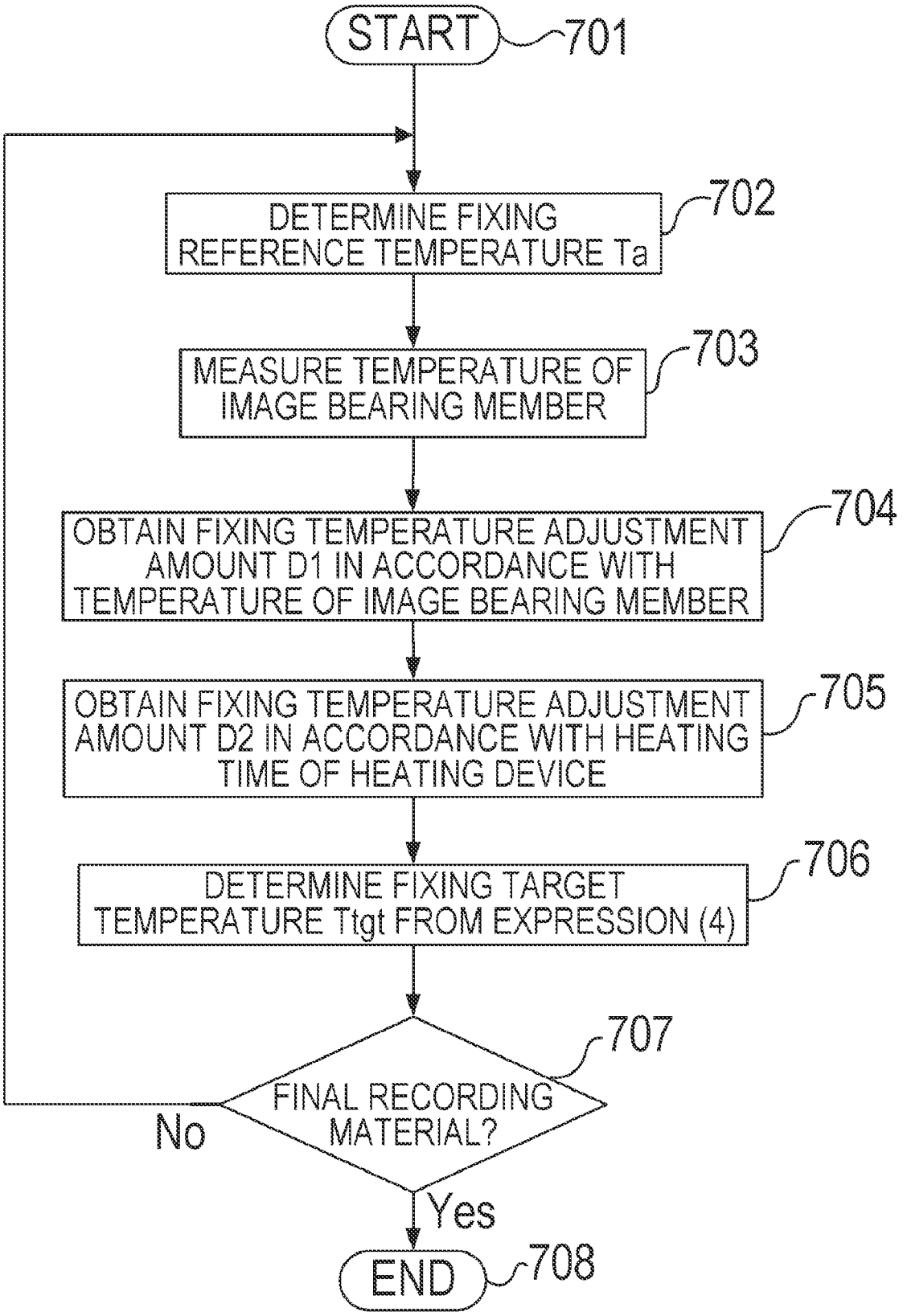
FIG. 15 is a flowchart illustrating a method of setting a fixing target temperature according to a third example.
Figure 16:
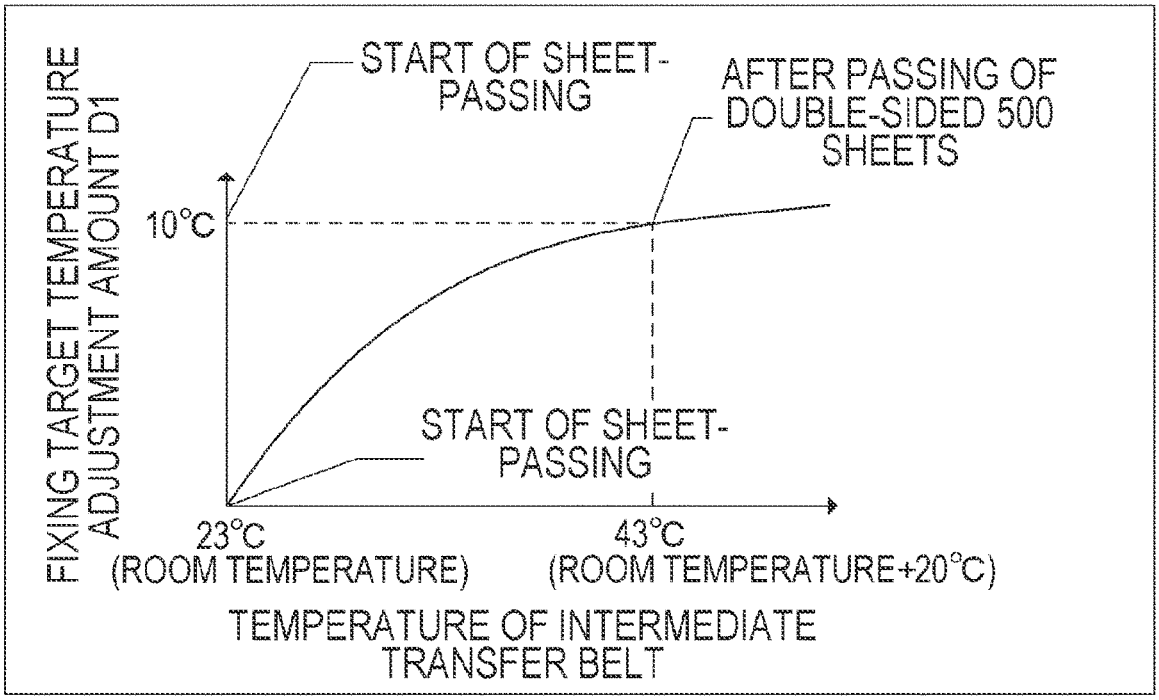
FIG. 16 is a diagram illustrating a relation between a temperature of an intermediate transfer belt and a fixing target temperature adjustment amount D1.

A method of setting the fixing target temperature will be described with reference to the flowchart of FIG. 15. When printing job (701) starts, the fixing reference temperature Ta is first determined (702). Subsequently, the belt thermistor 30 measures a temperature of the intermediate transfer belt 28 (703) and a fixing target temperature adjustment amount D1 in accordance with the temperature of the intermediate transfer belt 28 is obtained (704). As illustrated in FIG. 16, the fixing target temperature adjustment amount D1 is a parameter set in advance in accordance with the temperature of the intermediate transfer belt 28. The fixing target temperature adjustment amount D1 is larger as the temperature of the intermediate transfer belt 28 is raised. Adjustment of the fixing target temperature in accordance with the temperature of the intermediate transfer belt 28 is a first temperature changing method. The fixing target temperature adjustment amount D1 is a first temperature change amount.

Figure 17A:
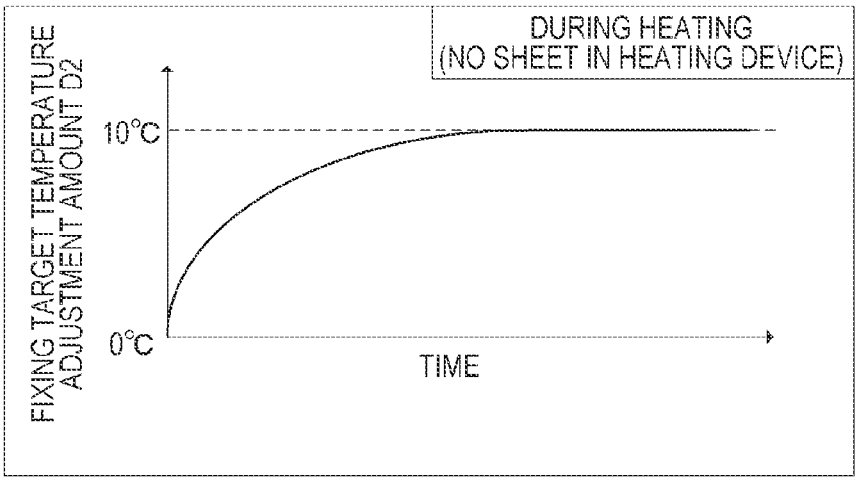
FIGS. 17A to 17C are diagrams illustrating a relation between a heating device rotation time and a fixing target temperature adjustment amount D2.
Figure 17B:
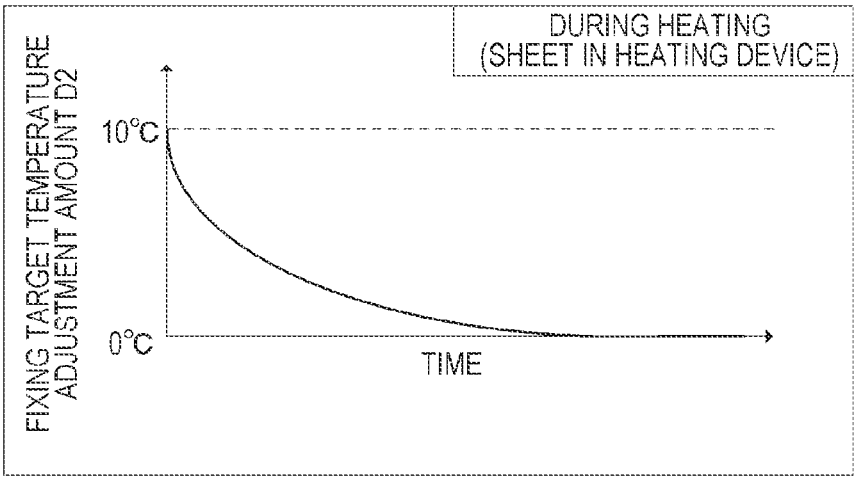
Figure 17C:
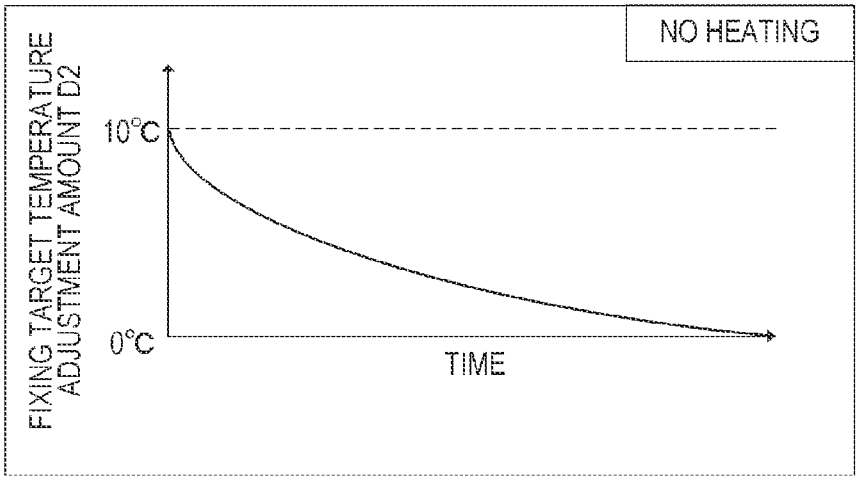

Subsequently, a fixing target temperature adjustment amount D2 is obtained in accordance with a heating time (a power supply time to the heater 42) of the heating device 40 (705). The fixing target temperature adjustment amount D2 will be described with reference to FIGS. 17A to 17C. When a temperature of a member in the heating device 40 is raised (hereinafter expressed as warming which progresses), the value of the fixing target temperature adjustment amount D2 increases and the fixing target temperature is set to be low. FIG. 17A illustrates a transition of the fixing target temperature adjustment amount D2 while heating is performed and when there is no recording material in the heating device 40. Since heat of the heater 42 is transferred to a member such as the pressurization roller 45 and warming progresses, the fixing target temperature adjustment amount D2 is raised with an increase in a heating time of the heating device 40. Conversely, FIG. 17B illustrates a transition of the fixing target temperature adjustment amount D2 when a recording material passes inside the heating device 40. Since the member such as the pressurization roller 45 is cooled due to the recording material, the fixing target temperature adjustment amount D2 decreases. Since the heating device 40 is cooled due to released heat or in stopping (non-heating) of the heating device 40, the fixing target temperature adjustment amount D2 decreases as in FIG. 17C. Adjustment of the fixing target temperature in accordance with the heating time of the heating device 40 is a second temperature changing method and the fixing target temperature adjustment amount D2 is a second temperature change amount. In the third example, a maximum value of the fixing target temperature adjustment amount D2 is set to 10° C.

Finally, a fixing target temperature Ttgt is calculated and determined by $$Ttgt = Ta - (\alpha D1 + \beta D2) \quad (4)$$

Here, α and β are coefficients and are values which can be set arbitrarily in accordance with a sheet-passing condition or the like. In addition, α and β are values equal to or greater than 0 and equal to or less than 1. For example, as in the first example, when the warming state of the heating device 40 is fixed and the fixing target temperature Ttgt is determined through only temperature adjustment in accordance with the intermediate transfer belt 28, α=1 and β=0 are set and the same expression as Expression (1) is made. 702 to 706 are repeated until the final recording material 11 is printed upon, and then the printing job ends (707).

To show the advantages of the third example, a comparative experiment is carried out under the same conditions as those of the first example. Here, when a recording material with a sheet basis weight of 80 g/m$^2$ is used, the fixing reference temperature Ta is 190° C. from Table 4. An experiment is carried from a state in which an image forming apparatus including the heating device 40 is cooled up to the room temperature of 23° C. As comparative examples of the third example, experiments are also carried out under the conditions of fourth and fifth comparative examples. The fourth comparative example is an example in which the fixing target temperature Ttgt is adjusted only based on a heating time of the heating device 40. The fifth comparative example is an example in which adjustment in accordance with a temperature of the intermediate transfer belt 28 and adjustment in accordance with a heating time of the heating device 40 independently function and the fixing target temperature Ttgt is adjusted.

Figure 18A:
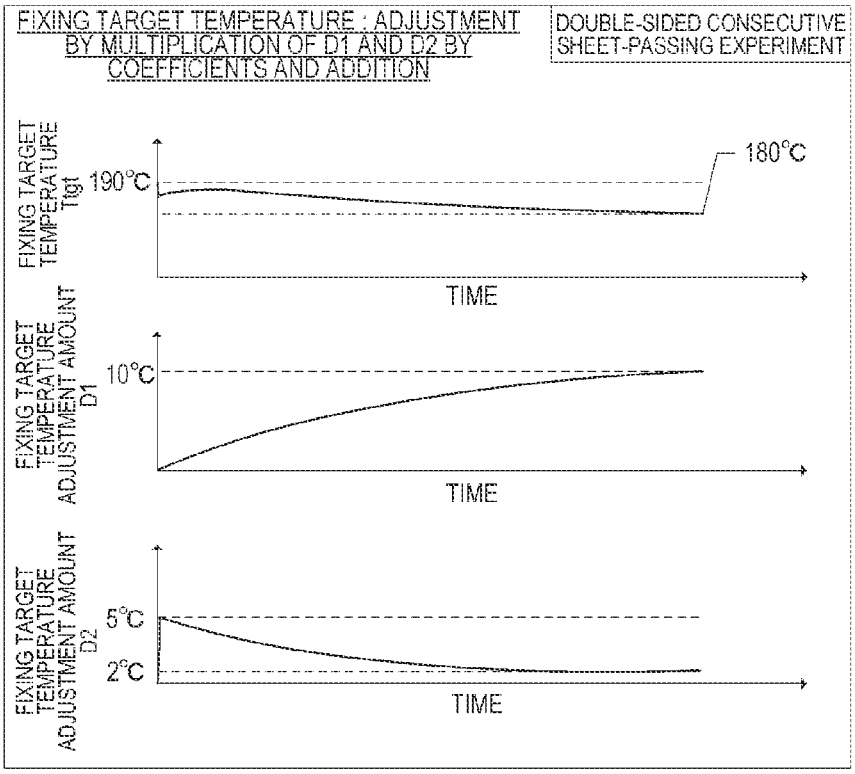
FIGS. 18A and 18B are diagrams illustrating a result of a comparative experiment when control of the third example is used.

FIG. 18A illustrates the fixing target temperature Ttgt, the fixing target temperature adjustment amount D1, and the fixing target temperature adjustment amount D2 in a double-sided consecutive sheet-passing experiment according to the third example. The temperature of the intermediate transfer belt 28 is raised when sheet-passing progresses. Therefore, the fixing target temperature adjustment amount D1 increases. The fixing target temperature adjustment amount D2 increases when the heating device 40 starts up. However, in the consecutive sheet-passing, a time in which there is no recording material (an inter-sheet time) is shorter than a time in which the recording material is in the heating device 40. Therefore, the value decreases with the sheet-passing. The coefficients in the double-sided consecutive sheet-passing experiment are set to α=0.8 and β=0.9. In the final consecutive sheet-passing, the fixing target temperature Ttgt is lowered to 180° C. The reason why the final fixing target temperature is higher than that of the first example is that the warming of the heating device 40 does not progress in the third example.

Figure 18B:
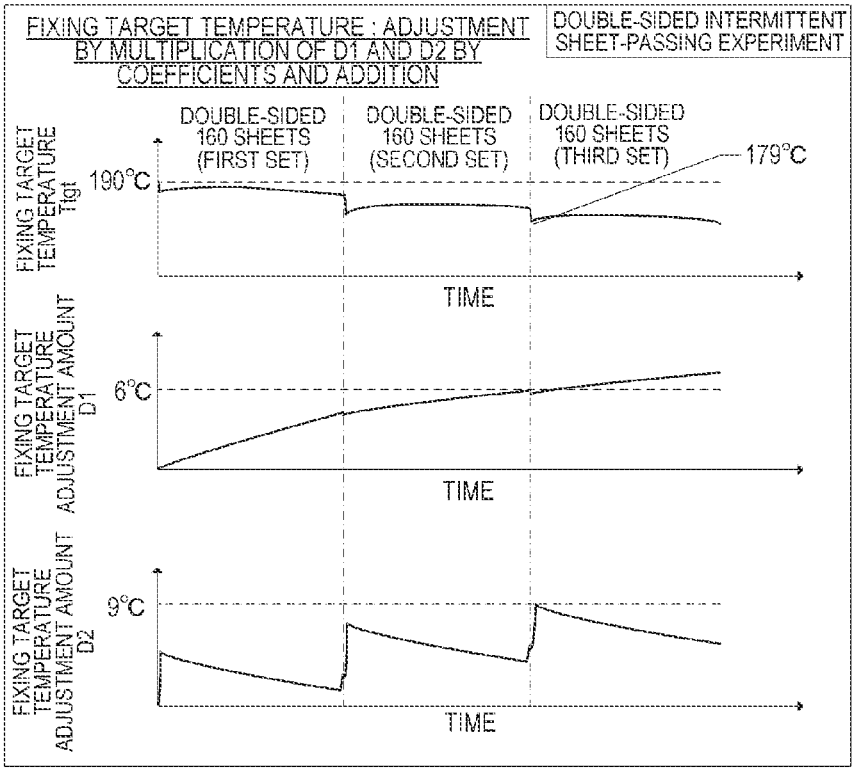

FIG. 18B illustrates the fixing target temperature Ttgt, the fixing target temperature adjustment amount D1, and the fixing target temperature adjustment amount D2 in a double-sided intermittent sheet-passing experiment according to the third example. In the third example, double-sided printing of two-sheet waiting is performed in three sets of 160 consecutive sheets (a sum of 320 images on the first and second surfaces) with a 10-seconds pause. During the consecutive sheet-passing and a pause between the respective sets, the fixing target temperature adjustment amount D2 is lowered. Here, in the consecutive sheet-passing of 160 sheets, the fixing target temperature adjustment amount D2 is not excessively lowered and there is a heating (forward rotation and backward rotation) time in a state in which there the recording material is not in the heating device 40 in the beginning and the final of each set. Therefore, when the intermittent sheet-passing continues, the value of the fixing target temperature adjustment amount D2 gradually increases. The coefficients in the double-sided consecutive sheet-passing experiment are set to α=0.8 and β=0.7. In the experiment in which the control of the third example is used, no image defect occurs in both the double-sided consecutive sheet-passing experiment and the double-sided intermittent sheet-passing experiment. The coefficient α and β are not limited to the values in the third example, and may be changed in accordance with a printing mode, a kind of recording material, an environment (for example, an environmental information such as a temperature or humidity) in which the image forming apparatus is used, as an operation condition of the image forming operation or may be changed during one printing job.

Figure 19A:
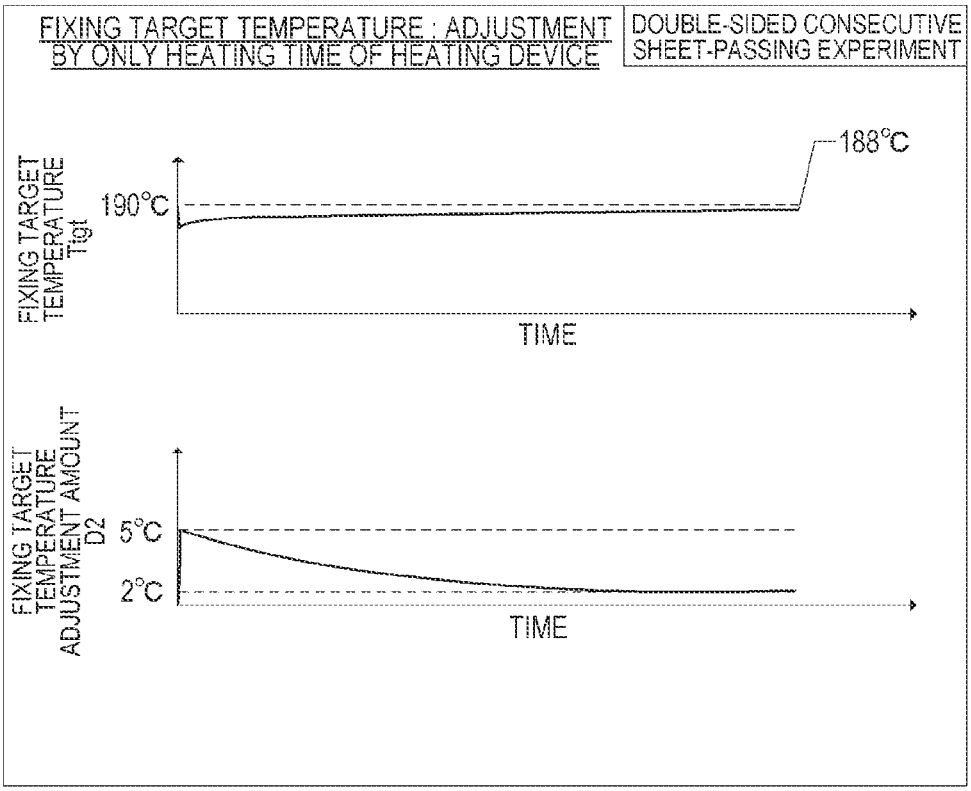
FIGS. 19A and 19B are diagrams illustrating a result of a comparative experiment when control of a fourth comparative example is used.
Figure 19B:
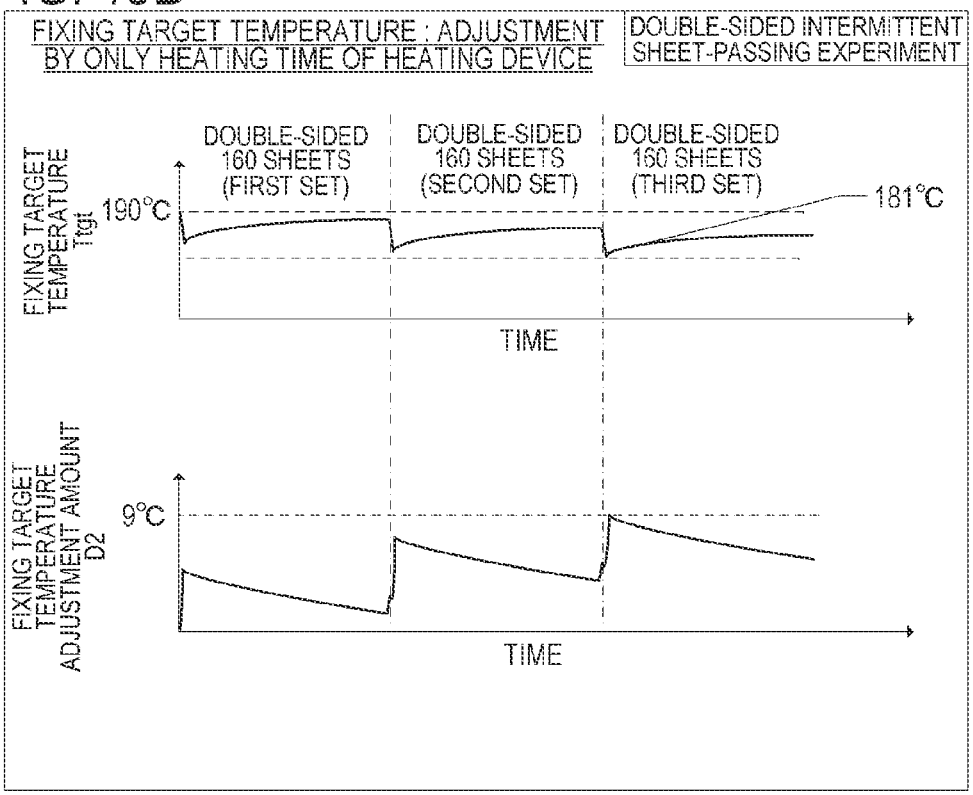

FIG. 19A illustrates the fixing target temperature Ttgt and the fixing target temperature adjustment amount D2 when a double-sided consecutive sheet-passing experiment is carried out using control of the fourth comparative example. In the fourth comparative example, the fixing target temperature Ttgt is changed in accordance with only a heating time of the heating device 40. That is, the target temperature is not adjusted in accordance with the temperature of the intermediate transfer belt 28. In FIG. 19A, as the sheet-passing progresses, the fixing target temperature Ttgt becomes higher than the temperature illustrated in FIG. 18A and reaches 188° C. (180° C. in the third example) at the end of the sheet-passing. As a result, in the sheet-passing latter half, the hot offset occurs. As described in the first example, when the double-sided consecutive sheet-passing continues, the intermediate transfer belt 28 becomes warm and the temperature of the recording material before entering the heating device 40 is raised. Therefore, when the fixing target temperature Ttgt is not lowered to that extent, an image defect occurs in some cases. FIG. 19B illustrates the fixing target temperature Ttgt and the fixing target temperature adjustment amount D2 when a double-sided intermittent sheet-passing experiment is carried out using control of the fourth comparative example. In FIG. 19B, the fixing target temperature Ttgt becomes 181° C. in the beginning of the third set of the intermittent sheet-passing. Although the temperature is higher than that of FIG. 18B, no image defect occurs.

Figure 20A:
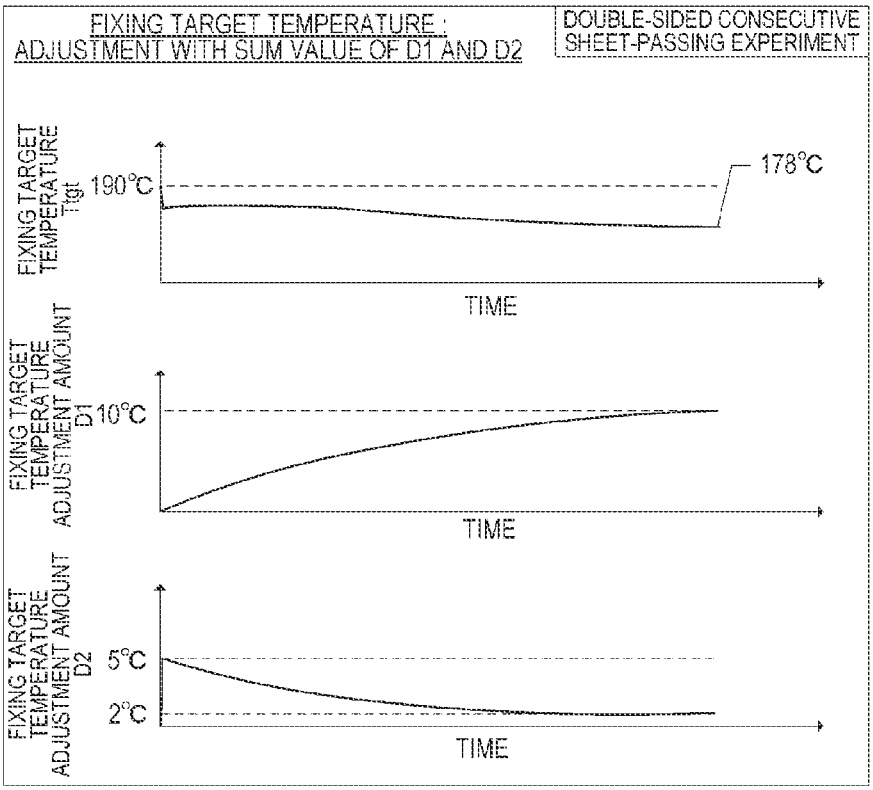
FIGS. 20A and 20B are diagrams illustrating a result of a comparative experiment when control of a fifth comparative example is used.

FIG. 20A illustrates the fixing target temperature Ttgt, the fixing target temperature adjustment amount D1, and the fixing target temperature adjustment amount D2 when a double-sided consecutive sheet-passing experiment is carried out using control of the fifth comparative example. In the fifth comparative example, adjustment of the fixing target temperature in accordance with the intermediate transfer belt 28 and adjustment of the fixing target temperature in accordance with a heating time of the heating device 40 independently function and the fixing target temperature Ttgt is changed. That is, a sum value of the fixing target temperature adjustment amount D1 and the fixing target temperature adjustment amount D2 is used and the fixing target temperature Ttgt is calculated with the coefficients α=1 and β=1 in Expression (4). In FIG. 20A, the fixing target temperature Ttgt is 178° C. at the end of the sheet-passing and the cold offset occurs although a cold offset is slight.

Figure 20B:
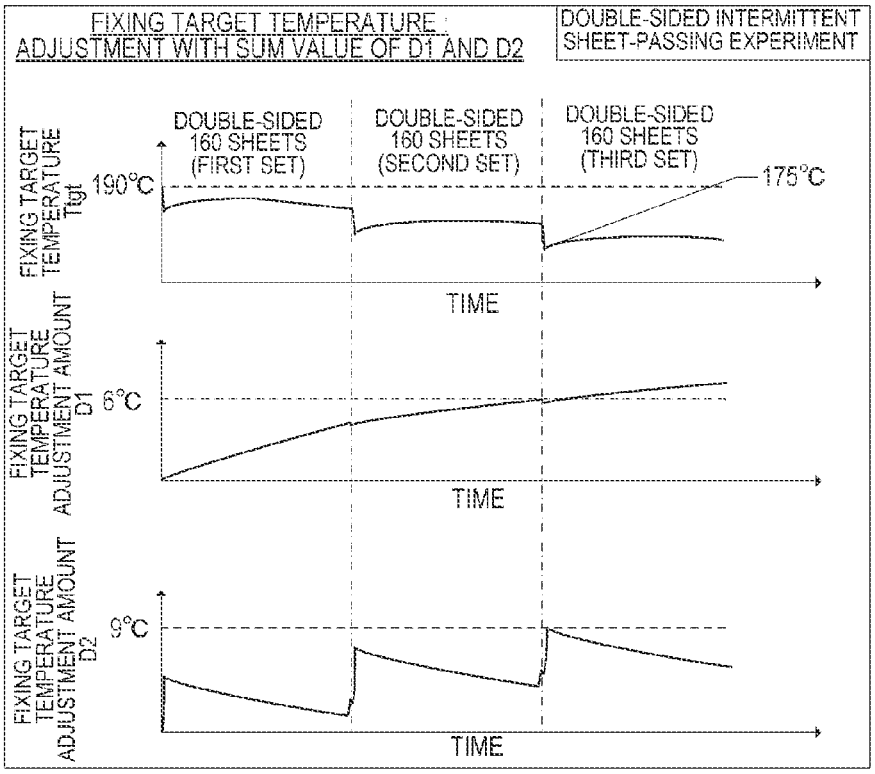

FIG. 20B illustrates the fixing target temperature Ttgt, the fixing target temperature adjustment amount D1, and the fixing target temperature adjustment amount D2 when a double-sided intermittent sheet-passing experiment is carried out using control of the fifth comparative example. In FIG. 20B, the fixing target temperature Ttgt is 175° C. at the beginning of the third set of the intermittent sheet-passing and a cold offset occurs. As described above, when warming progresses in both the intermediate transfer belt 28 and the heating device 40, the fixing target temperature is lowered to be equal to or less than a temperature at which fixing is possible and an image defect occurs in some cases. Therefore, it is better to change the fixing target temperature by multiplying appropriate coefficients as in the third example.

In the comparative experiment, a cold offset occurs in the fifth comparative example. However, depending on a configuration or a sheet-passing condition of the image forming apparatus, an image defect does not occur in some cases either in the control method of the fifth comparative example. Accordingly, when an image defect does not occur, the fixing target temperature Ttgt may be determined in accordance with the method of the fifth comparative example. The values of the coefficient α and β in Expression (4) are not limited.

Table 5 is a list table in which the results of the comparative experiments are summarized. The comparative results in the number of passing sheets in which the advantages of the third example are conspicuous are summarized, a result at the time of ending of the sheet-passing in the double-sided consecutive sheet-passing experiment is written, and a result of the beginning of the third set is written in the double-sided intermittent sheet-passing experiment. As the fixing consumption power, average power in five passing sheets is written.

TABLE 5

Results of comparative experiments in third example

| | Fixing target temperature control | Comparative experiment | Fixing target temperature | Whether image defect occurs | Fixing consumption power |
|---|---|---|---|---|---|
| Third example | Adjustment by multiplication of D1 and D2 by coefficients and addition | Double-sided consecutive sheet-passing | 180° C. | No | 600 W |
| | | Double-sided intermittent sheet-passing | 179° C. | No | 590 W |
| Fourth comparative example | Adjustment by only heating time of heating device | Double-sided consecutive sheet-passing | 188° C. | Hot offset | 680 W |
| | | Double-sided intermittent sheet-passing | 188° C. | No | 610 W |
| Fifth comparative example | Adjustment with sum value of D1 and D2 | Double-sided consecutive sheet-passing | 178° C. | Cold offset (slight) | 580 W |
| | | Double-sided intermittent sheet-passing | 175° C | Cold offset | 550 W |

As the results of the comparative examples, the example in which an image defect does not occur is only the third example, as described above. The fixing consumption power is low because an amount of heat (power) is not added excessively in the third example.

As described above, in the third example, the fixing target temperature Ttgt is changed in accordance with both the fixing target temperature adjustment amount D1 in accordance with the temperature of the intermediate transfer belt 28 and the fixing target temperature adjustment amount D2 in accordance with the heating time of the heating device 40. Thus, it is possible to inhibit an image defect due to over-fixing or a fixing defect and inhibit fixing consumption power. More specifically, in the third example, the fixing target temperature Ttgt is changed in accordance with the result obtained by multiplication of the fixing target temperature adjustment amount D1 and fixing target temperature adjustment amount D2 by the coefficients and addition of the multiplied values, and thus it is possible to obtain the foregoing advantages. In the third example, the temperature of the intermediate transfer belt 28 is actually measured using the belt thermistor 30. As described in the first example, however, the temperature of the intermediate transfer belt 28 may be predicted and the fixing target temperature adjustment amount D1 may be determined in accordance with the predicted temperature. As in the second example, the fixing target temperature adjustment amount D1 may be determined in accordance with the temperature of the photosensitive drum.

Fourth Example

Next, a fourth example of the present invention will be described. A basic configuration and an operation of an image forming apparatus and a heating device according to the fourth example are the same as those of the first and third examples. Accordingly, the same reference numerals are given to elements that have the same or equivalent functions and configurations to those of the first and third examples, and detailed description thereof will be omitted.

In the third example, the fixing target temperature has been determined by multiplying the fixing target temperature adjustment amount D1 and the fixing target temperature adjustment amount D2 by the coefficients α and β and adding the multiplied values. The fourth example is an example in which the fixing target temperature is determined using only a larger temperature change amount between the fixing target temperature adjustment amount D1 and the fixing target temperature adjustment amount D2. The coefficients α and β are values to be changed in accordance with the sheet-passing condition or a kind of recording material. There is a case in which optimization of all the conditions is difficult or a case in which the temperature control is complicated. In the fourth example, by using only a larger temperature change amount between the fixing target temperature adjustment amount D1 and the fixing target temperature adjustment amount D2, it is possible to inhibit an image defect by simple temperature control.

Figure 21:
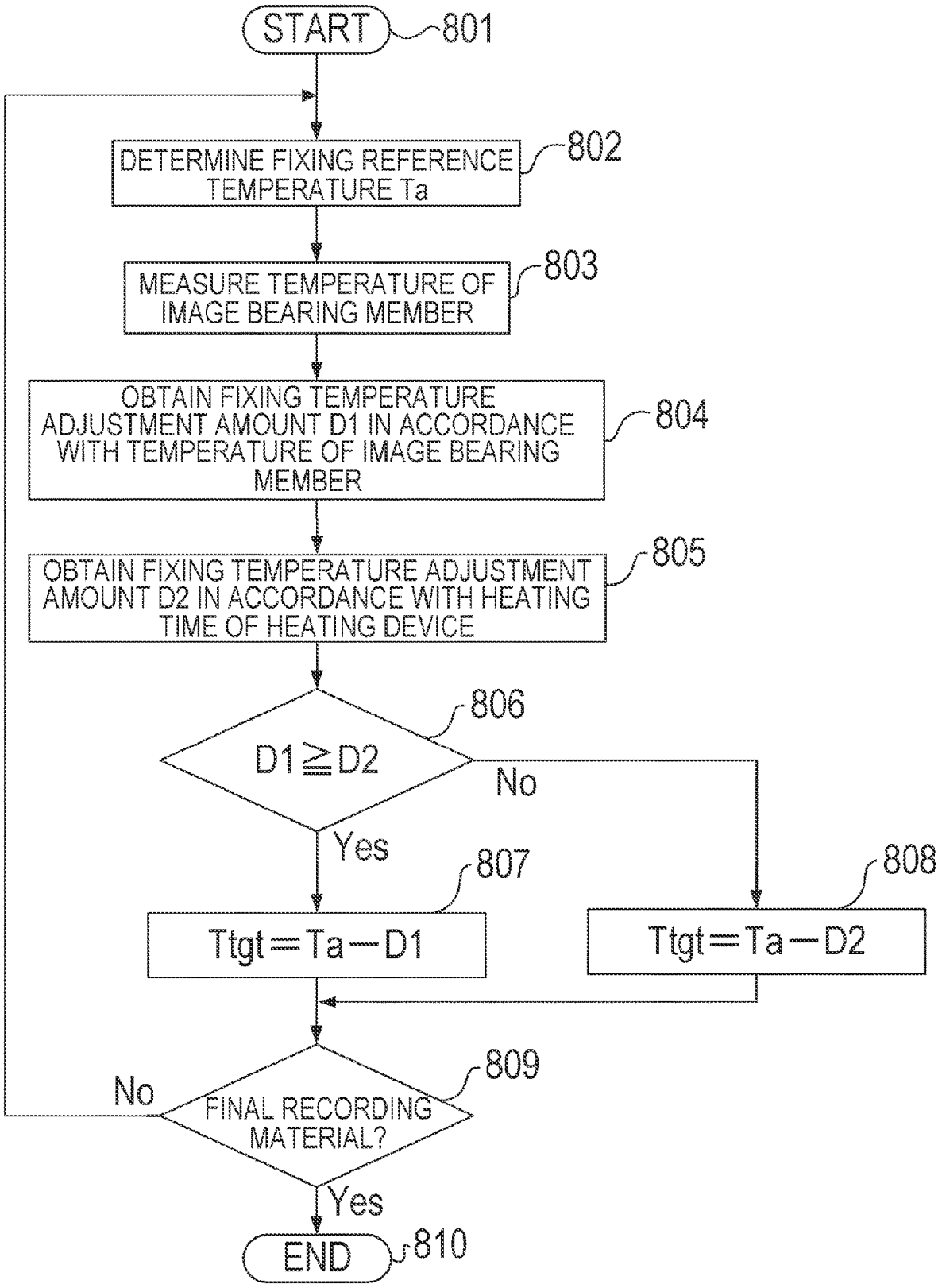
FIG. 21 is a flowchart illustrating a method of setting a fixing target temperature according to a fourth example.

FIG. 21 is a flowchart illustrating the fixing target temperature Ttgt determined in the fourth example. When printing job (801) starts, the fixing reference temperature Ta is first determined (802). As the fixing reference temperature Ta, a value in Table 4 described in the third example is used. Subsequently, the belt thermistor 30 measures a temperature of the intermediate transfer belt 28 (803) and the fixing target temperature adjustment amount D1 in accordance with the temperature of the intermediate transfer belt 28 is obtained (804). Subsequently, the fixing target temperature adjustment amount D2 in accordance with the heating time of the heating device 40 is obtained (805). The obtained fixing target temperature adjustment amounts D1 and D2 are compared. When D1≥D2 is satisfied, the fixing target temperature Ttgt=Ta−D1 is set (806 and 807). When D1<D2 is satisfied, the fixing target temperature Ttgt=Ta-D2 is set (808). 802 to 808 are repeated until the final recording material 11 is printed, and then the printing job ends (809).

Figure 22A:
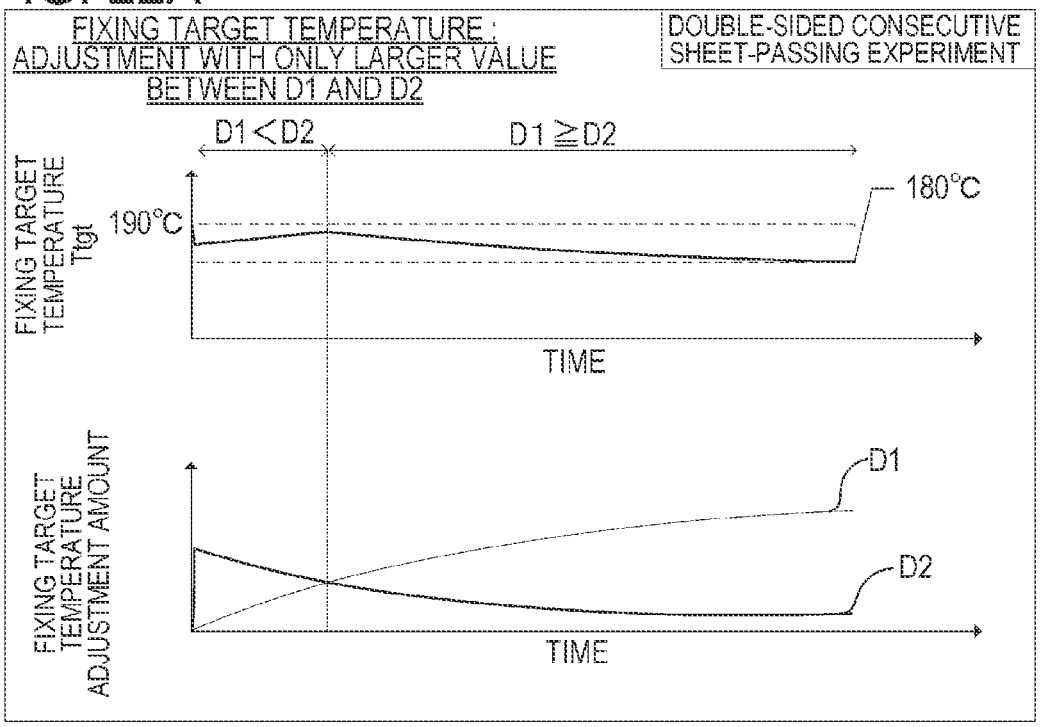
FIGS. 22A and 22B are diagrams illustrating a result of a comparative experiment when the control of the fourth example is used.
Figure 22B:
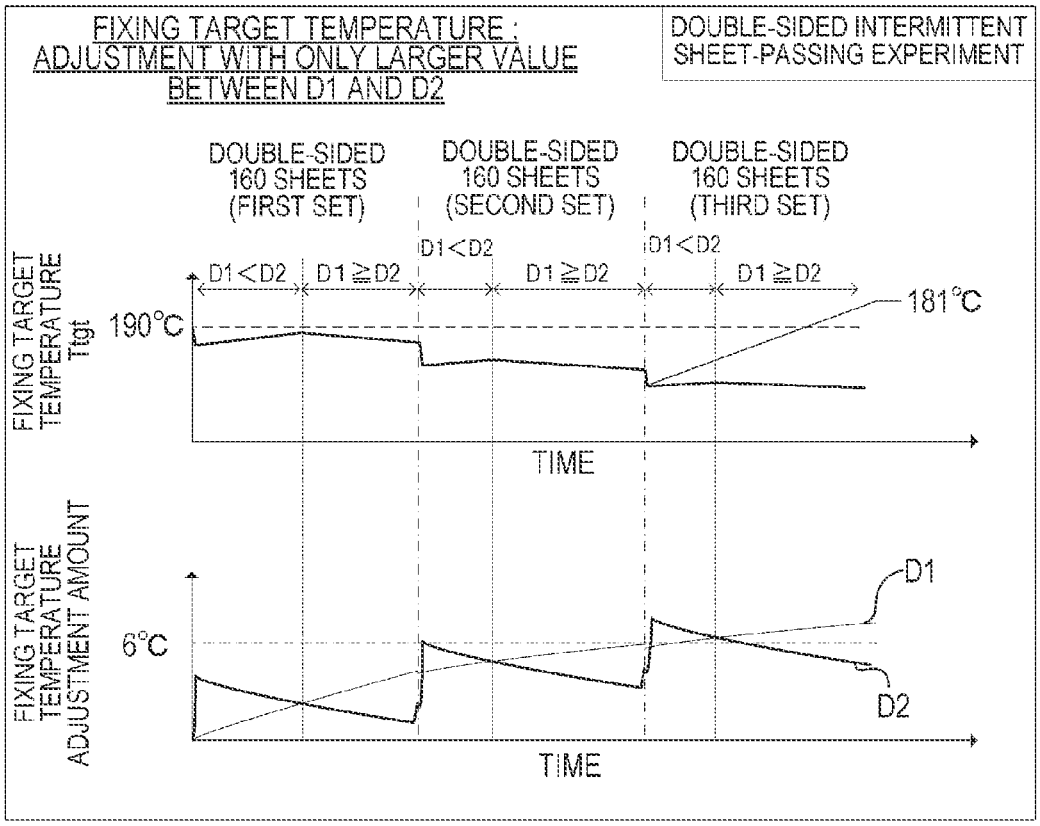

FIGS. 22A and 22B illustrate transitions of the fixing target temperature Ttgt, the fixing target temperature adjustment amount D1, and the fixing target temperature adjustment amount D2 when the fixing target temperature Ttgt is determined in accordance with the method of the fourth example. To easily compare a magnitude relation, the fixing target temperature adjustment amount D1 and the fixing target temperature adjustment amount D2 are described on the same graph. The same conditions of a comparative experiment as those of the third example are set. FIG. 22A illustrates a result in the double-sided consecutive sheet-passing. In the beginning of the sheet-passing start, the temperature of the intermediate transfer belt 28 is low and the fixing target temperature adjustment amount D1<the fixing target temperature adjustment amount D2 is satisfied. Therefore, the fixing target temperature Ttgt=Ta−D2 is set. As the sheet-passing progresses, the temperature of the intermediate transfer belt 28 increases. However, the heating device 40 is gradually cooled, and when the fixing target temperature adjustment amount D1≥the fixing target temperature adjustment amount D2 is satisfied, the fixing target temperature Ttgt=Ta−D1 is set. FIG. 22B illustrates a result in the double-sided intermittent sheet-passing experiment. In the beginning of each set of the intermittent sheet-passing, there is an influence of the heating time in a state in which the recording material is not inside the heating device 40. Therefore, the fixing target temperature adjustment amount D1<the fixing target temperature adjustment amount D2 is satisfied, and the fixing target temperature Ttgt=Ta-D2 is set. When the sheet-passing of each set progresses, the fixing target temperature adjustment amount D1≥the fixing target temperature adjustment amount D2 is satisfied, and the fixing target temperature Ttgt=Ta−D1 is set as in the double-sided consecutive sheet-passing experiment.

When the fixing target temperature Ttgt is set in accordance with the method of the fourth example, an image defect did not occur in both the double-sided consecutive sheet-passing experiment and the double-sided intermittent sheet-passing experiment. In the fourth comparative example with respect to the third example, the fixing target temperature Ttgt is changed in accordance with only the heating time of the heating device 40. Therefore, when the influence of the temperature of the intermediate transfer belt 28 is large, a hot offset occurs. In the fifth comparative example, the fixing target temperature Ttgt is too lowered and a cold offset occurs. In the fourth example, by using the temperature of the intermediate transfer belt 28 or the heating time of the heating device 40 of which an influence is larger and changing the fixing target temperature Ttgt, it is possible to inhibit an image defect occurring due to over-fixing and a fixing defect.

The methods of determining the fixing target temperature Ttgt according to the third and fourth examples may be used in combination. For example, when the fixing target temperature adjustment amounts D1 and D2 are equal to or less than a preset value, the fixing target temperature Ttgt is changed using the temperature of the intermediate transfer belt 28 or the heating time of the heating device 40 of which an influence is larger as in the fourth example. Conversely, when the fixing target temperature adjustment amounts D1 and D2 exceed the preset value, the fixing target temperature Ttgt is changed using Expression (4) described in the third example. In this way, the combined control may be used.

Fifth Example

Next, a fifth example of the present invention will be described. A basic configuration and an operation of an image forming apparatus and a heating device according to the fifth example are the same as those of the first example. Accordingly, the same reference numerals are given to elements that have the same or equivalent functions and configurations to those of the first example, and detailed description thereof will be omitted. In the first to fourth examples, the temperature of the intermediate transfer belt or the photosensitive drum is actually measured or predicted and the fixing target temperature is changed in accordance with the temperature. The fifth example is an example in which the fixing target temperature is changed in accordance with an execution time of the double-sided printing when the temperature of the intermediate transfer belt or the photosensitive drum cannot exactly be ascertained. That is, adjustment of the fixing target temperature in accordance with the execution time of the double-sided printing (during an operation time of the double-sided fixing operation) is the first temperature change method in the fifth example. A fixing target temperature adjustment amount D1*x* is the first temperature change amount in the fifth example and is a third temperature change amount in the present invention.

Figure 23A:
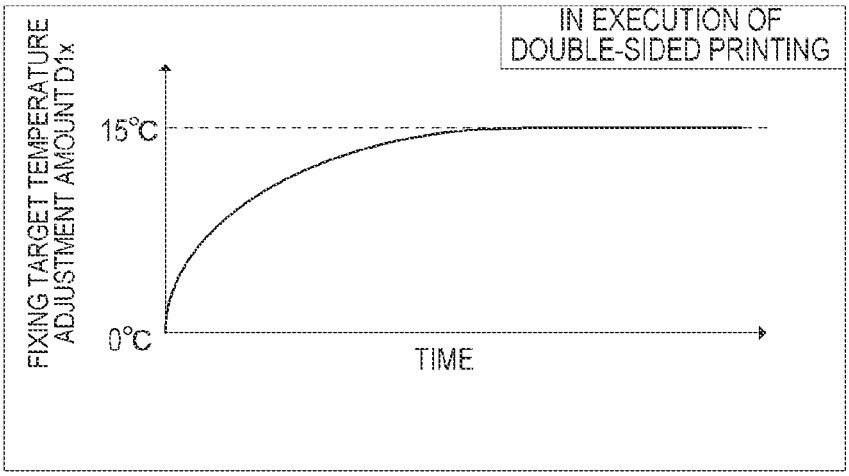
FIGS. 23A to 23C are diagrams illustrating a relation between a double-sided sheet-passing time and a fixing target temperature adjustment amount D1 according to a fifth example.

The fixing target temperature adjustment amount D1*x* (the first temperature change amount in the fifth example) in accordance with the execution time of the double-sided printing will be described with reference to FIGS. 23A to 23C. As illustrated in FIG. 23A, as the double-sided printing is performed many times, the value of the fixing target temperature adjustment amount D1*x* is larger and the fixing target temperature Ttgt is set to be low. The reason is the same as that when the temperature of the intermediate transfer belt 28 is raised as described in the first example. That is, this is because the temperature of the member (for example, the intermediate transfer belt 28) inside the image forming apparatus is raised by the recording material 11 warmed once by the heating device 40 and the temperature of the recording material 11 is raised before entering the heating device 40. In the fifth example, a saturation temperature of the fixing target temperature adjustment amount D1*x* is set to 15° C.).

Figure 23B:
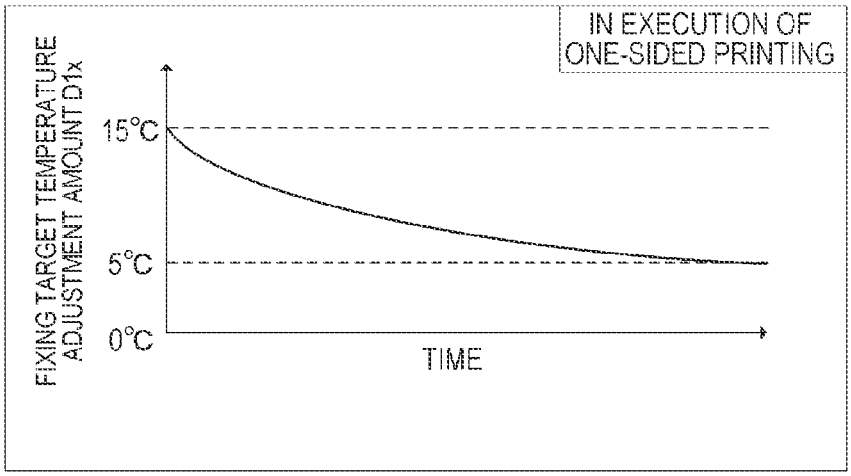
Figure 23C:
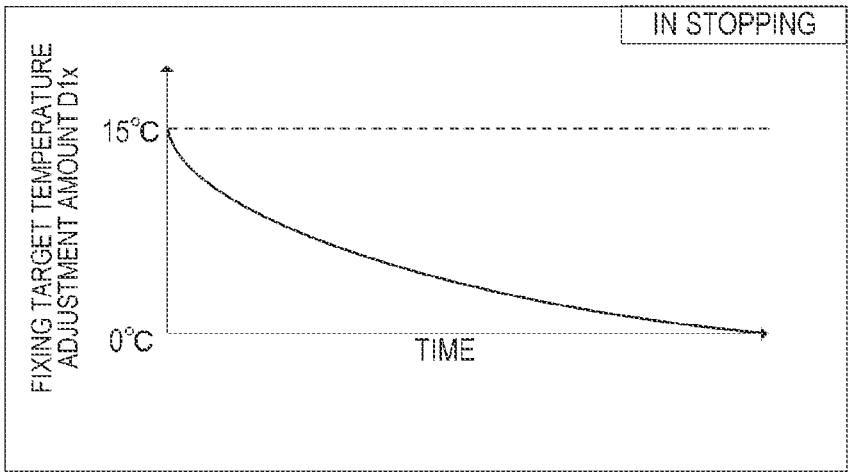

FIG. 23B illustrates a transition of the fixing target temperature adjustment amount D1*x* in the one-sided printing in which an image is formed on only one surface of the recording material 11. FIG. 23C illustrates a transition of the fixing target temperature adjustment amount D1*x* when the image forming apparatus is stopped. Since the double-sided printing is not performed in either case, the fixing target temperature adjustment amount D1*x* decreases over time. Here, in the case of the one-sided printing, the fixing target temperature adjustment amount D1*x* is not lowered up to (PC differently from the time at which the image forming apparatus is stopped. This is because, as in FIG. 12B in the first example, the member inside the image forming apparatus is also warmed due to radiant heat or the like of the heating device 40 in the one-sided printing. Strictly speaking, in first surface sheet-passing of the double-sided printing, the member inside the image forming apparatus is not warmed and is rather cooled as in the one-sided printing in some cases. However, compared to the cooling in first surface sheet-passing, the influence of the increase in the temperature due to second surface sheet-passing is larger.

Therefore, as in FIG. 23A, the fixing target temperature adjustment amount D1$x$ monotonously increases with respect to an execution time of the double-sided printing.

In the fifth example, the fixing target temperature adjustment amount D1$x$ described above is compared to the fixing target temperature adjustment amount D2 in accordance with the heating time of the heating device 40 described in the third example, and the fixing target temperature Ttgt is changed using a larger amount. That is, as in the fourth example, when D1≥D2 is satisfied, Ttgt=Ta−D1$x$ is set. When D1$x$<D2 is satisfied, Ttgt=Ta-D2 is set.

Figure 24A:
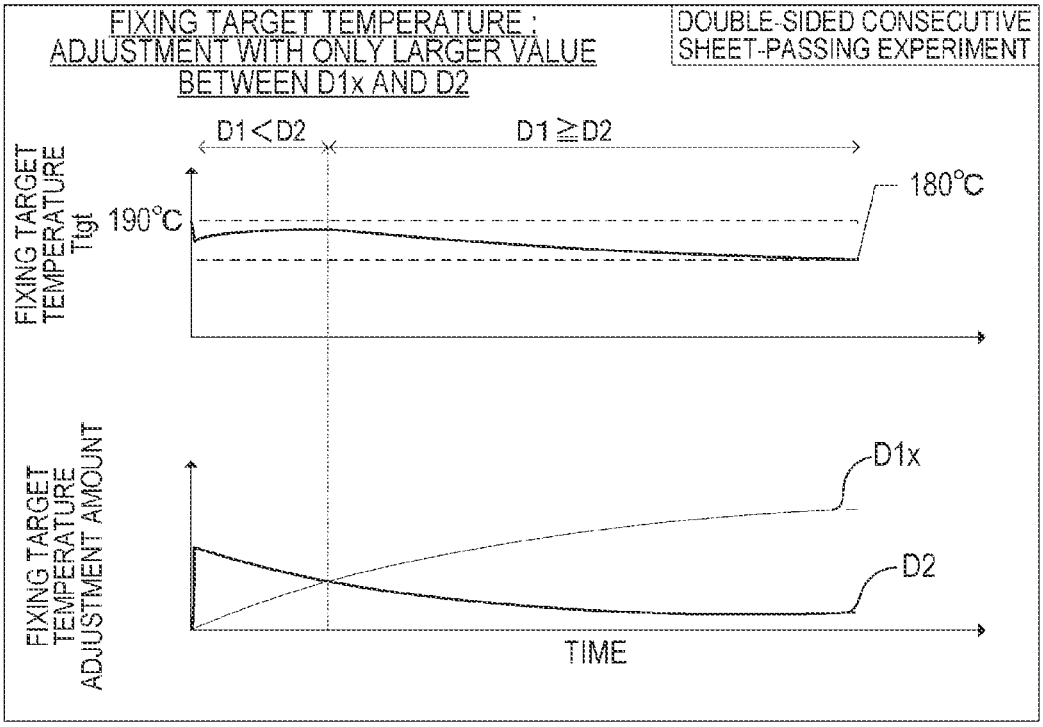
FIGS. 24A and 24B are diagrams illustrating a result of a comparative experiment when control of the fifth example is used.
Figure 24B:
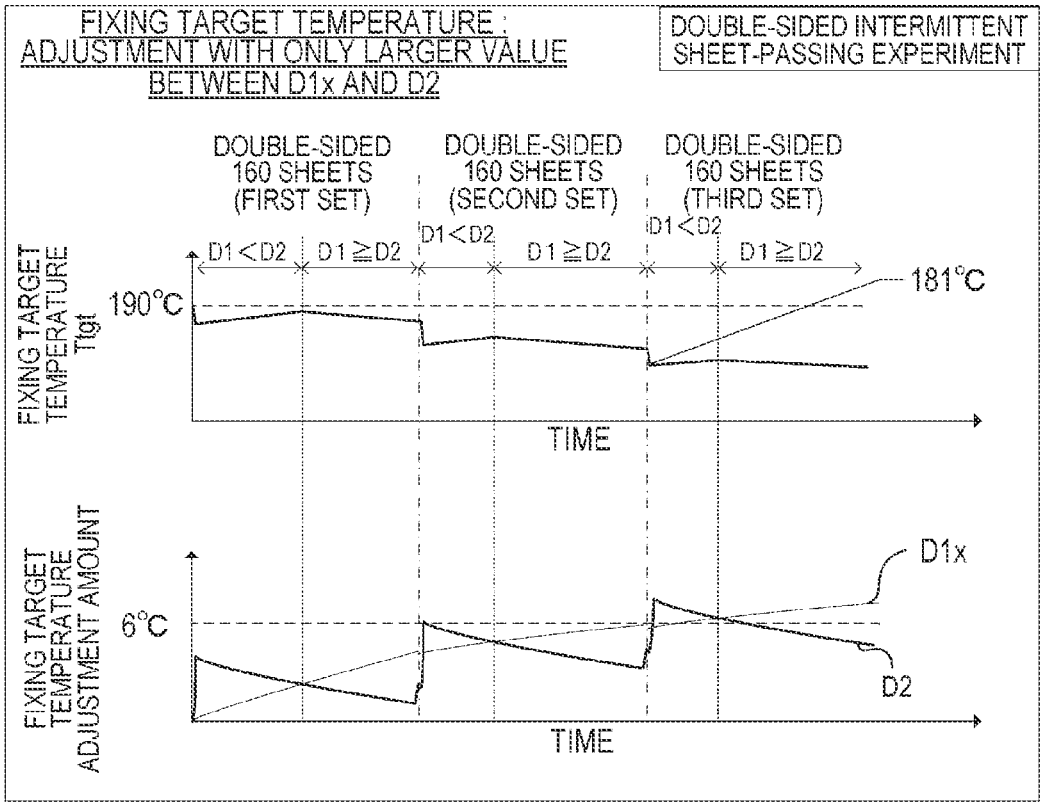

FIGS. 24A and 24B illustrate transitions of the fixing target temperature Ttgt, the fixing target temperature adjustment amount DIx, and the fixing target temperature adjustment amount D2 when the fixing target temperature Ttgt is determined in accordance with the method of the fifth example. The conditions of an experiment are the same as those of the fourth example. In FIG. 24A of a double-sided consecutive sheet-passing experiment and FIG. 24B of a double-sided intermittent sheet-passing experiment, a transition in which there is no large difference from the fixing target temperature Ttgt in FIGS. 23A to 23C in the fourth example is shown, and thus an image defect does not occur.

As described above, although the temperature of the intermediate transfer belt 28 is not measured or predicted, it is possible to inhibit an image defect occurring due to over-fixing and a fixing defect by changing the fixing target temperature in accordance with the execution time of the double-sided printing. As in the third example, the fixing target temperature Ttgt may be changed in accordance with a result obtained by multiplying the fixing target temperature adjustment amount D1$x$ and the fixing target temperature adjustment amount D2 by the coefficients and adding the multiplied values. In particular, when the warming of the image forming apparatus body and the heating device 40 is in progress and the fixing target temperature adjustment amount D1$x$ and the fixing target temperature adjustment amount D2 are added, it is possible to inhibit an image defect efficiently.

Sixth Example

Figure 26:
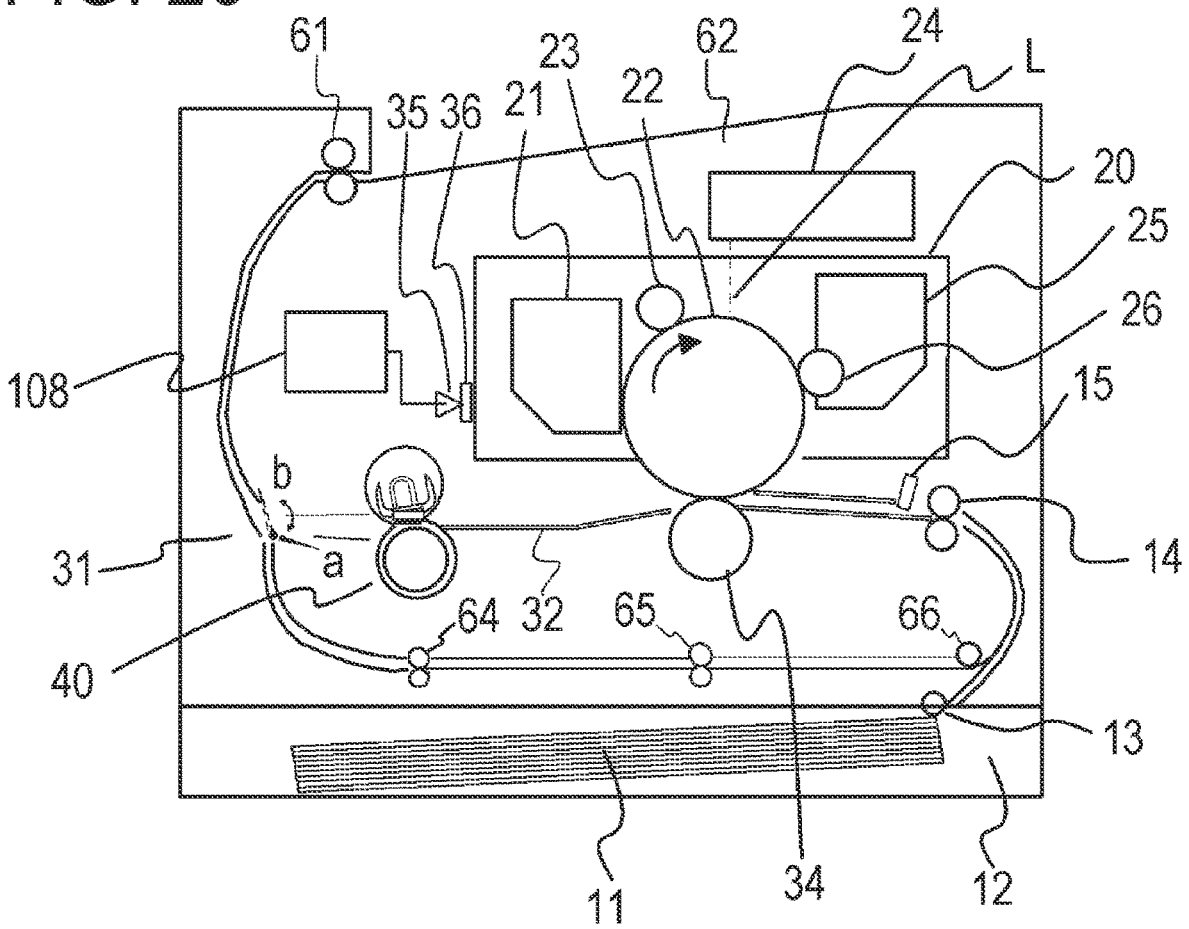
FIG. 26 is a sectional view illustrating an image forming apparatus according to a sixth example.

A sixth example is an example in which the fixing target temperature is set in the image forming apparatus where the photosensitive drum 22 serving as a photoreceptor can be exchanged in a monochromatic printer. FIG. 26 is a sectional view illustrating a monochromatic printer in which the photosensitive drum 22 can be exchanged. In the present example, the photosensitive drum 22, the charger 23, the development unit 26, the toner container 25, and a cleaner 21 are unitized as a cartridge (CRG) 20. The CRG 20 can be exchanged with respect to the body of a printer 1. When the CRG 20 is provided in the body of the printer 1, a contact connector 35 in the body of the printer 1 is electrically connected to a memory chip 36 disposed in the CRG 20 so that communication is possible. By reading information in the memory chip 36 to the control portion 108, image quality or maintenance of the CRG 20 is further improved. A basic configuration and an operation of the image forming apparatus and the heating device other than the CRG 20 are the same as those of the second example.

Method of Setting Target Temperature

Figure 27:
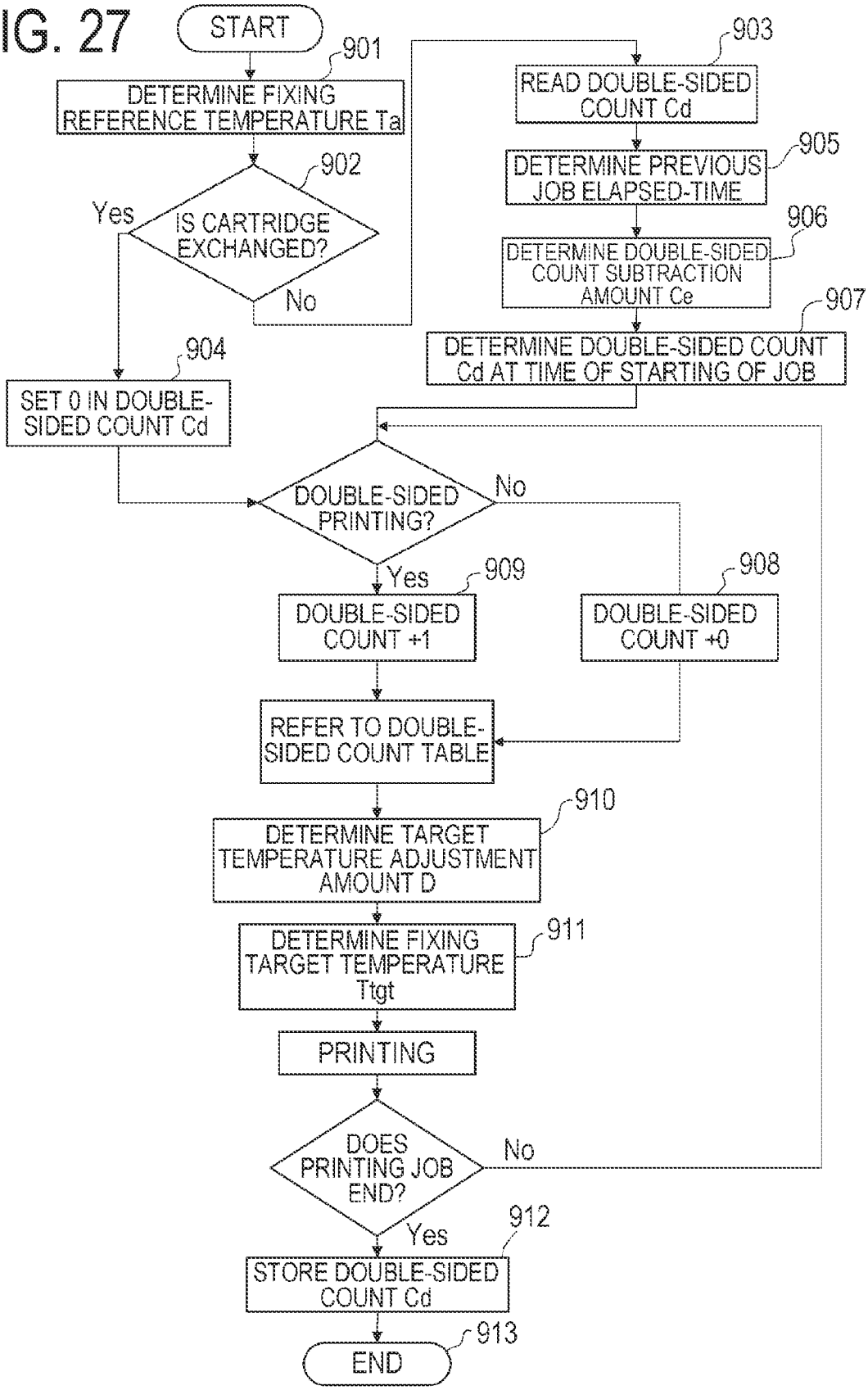
FIG. 27 is a flowchart illustrating a method of setting a target temperature according to the sixth example.

Next, a method of setting the target temperature in fixing processing will be described. FIG. 27 is a flowchart illustrating control when printing job is processed.

The reference temperature Ta in the fixing processing is first determined (901). Subsequently, it is detected whether the photosensitive drum 22 is exchanged, that is, whether the CRG 20 is exchanged (902). The control portion 108 detects whether the CRG 20 is changed by accessing the memory chip 36 mounted in the CRG 20, reading information such as a serial number, and comparing the information with information stored in the control portion 108. When the information stored in the control portion 108 matches information newly extracted from the memory chip 36, that is, the CRG 20 newly mounted in the printer 1 is the same as the CRG 20 before the new mounting, a double-sided count Cd at the time of ending of previous job stored in the control portion 108 is read (903). Conversely, when the newly mounted CRG 20 is different from the CRG 20 before the new mounting, that is, the CRG 20 is exchanged, 0 is set in the double-sided count Cd (904). Here, the double-sided count Cd is a numerical value added whenever the double-sided printing of one sheet is processed and is a warming index indicating the degree of the increase in the temperature of the photosensitive drum 22. The double-sided count Cd is set in a range in which a minimum value is 0 and a maximum value is 750.

When an elapsed time from the time of ending of the previous job is measured (905), a subtraction amount Ce of the double-sided count determined in advance and illustrated in Table 6 is determined based on the elapsed time (906). The double-sided count subtraction amount Ce is a numerical value in which a temperature of the photosensitive drum 22 lowered over time from the ending of the previous job is reflected in the double-sided count Cd. In the present example, when 120 minutes has passed from the previous job, zero is set in any double-sided count Cd.

TABLE 6

Relation between double-sided count subtraction amount Ce and elapsed time from previous job

| | Elapsed time from time of ending of previous job [min] | | | | | |
|---|---|---|---|---|---|---|
| | 5 | 15 | 30 | 60 | 90 | 120 |
| Double-sided count subtraction amount Ce | 25 | 75 | 150 | 300 | 450 | 750 |

The double-sided count Cd at the time of starting of the job is determined by subtracting the double-sided count subtraction amount Ce from the read double-sided count Cd at the time of ending of the previous job (907).

Subsequently, when the job is a one-sided print, 0 is set in the double-sided count Cd (908). When the job is a double-sided print, 1 is added to the double-sided count Cd (909). Based on the determined double-sided count Cd, an adjustment amount D of the target temperature illustrated in Table 7 is determined (910).

TABLE 7

In double-sided counter, target temperature adjustment amount D [° C.]

| | Double-sided count Cd | | | | | |
|---|---|---|---|---|---|---|
| | 0 | 25 | 71 | 151 | 301 | 701 |
| Target temperature adjustment amount D | 0 | 2 | 4 | 6 | 8 | 10 |

The target temperature adjustment amount D is a parameter set in advance in accordance with the double-sided count Cd, as shown in Table 7. As the processed number of sheets of the double-sided printing progresses, the target temperature adjustment amount D increases. In the present example, the double-sided count subtraction amount Ce or the target temperature adjustment amount D for the number of sheets of the double-sided printing is set discretely, but may be set continuously. The setting is not limited thereto. Finally, the target temperature Ttgt at the time of fixing processing is calculated and determined based on Expression (5) (911).

$$Ttgt = Ta - D \quad (5)$$

Steps 908 to 911 are repeated until the final recording material 11 is printed. When the printing job ends, the double-sided count Cd is recorded in the control portion 108 (912) and the processing ends (913).

Next, differences in advantages of the present example and a comparative example in which the target temperature of the heating device (fixing portion) 40 is set based on the double-sided count Cd and exchange detection of the CRG 20 will be described. In the setting of the experimented printer, a conveying speed of the recording material is 300 mm/sec and a printing speed (throughput) is 60 ppm. A used recording material is an A4 size sheet of RedLabel manufactured by Canon Oce and a sheet basis weight is 80 g/m$^2$. The reference temperature Ta of RedLabel is 180° C. The experiment is preferably carried out in an environment managed under constant temperature and humidity conditions by air conditioning of an air conditioner or the like. The experiment is carried out in an environment of a temperature of 23° C. and a relative humidity of 50%. The experiment starts from a state in which the internal temperature of the printer 1 becomes 23° C. which is the same as the room temperature.

As printing conditions of this experiment, double-sided printing of 500 sheets is performed. Next, a CRG access door (a door of the printer 1 used to extract the CRG 20) is once opened and closed and the double-sided printing of 10 sheets is performed. Thereafter, after the CRG access door is opened again and the CRG 20 is exchanged for a new product, the double-sided printing of 10 sheets is further performed.

In a sixth comparative example, without using information regarding the exchange detection of the CRG, without using information regarding the double-sided count either, and irrespective of an event such as exchange of the CRG, the reference temperature Ta of 180° C. is set as a target temperature and the printing is successively performed.

In a seventh comparative example, the target temperature is adjusted using the double-sided count in accordance with the temperature of the photosensitive drum 22 and the information regarding the exchange detection of the CRG is not used. Therefore, although the CRG access door is opened and closed, the double-sided count is not reset irrespective of whether the CRG is exchanged, the double-sided count of the previous job is taken over to set the target temperature, and the printing is performed.

In an eighth comparative example, the target temperature is adjusted using the double-sided count, but the exchange detection of the CRG is not performed. Whenever the CRG access door is opened and closed, the CRG is considered to be exchanged, the double-sided count Cd is set to 0, and the printing is performed.

TABLE 8

| | | Experiment result | | | |
|---|---|---|---|---|---|
| | | Sixth example | Sixth comparative example | Seventh comparative example | Eighth comparative example |
| Double-sided 500 sheets | Cold offset | ○ | ○ | ○ | ○ |
| | Hot offset | ○ | X | ○ | ○ |
| After door is opened and closed, double-sided 10 sheets | Cold offset | ○ | ○ | ○ | ○ |
| | Hot offset | ○ | X | ○ | X |
| After cartridge is exchanged, double-sided 10 sheets | Cold offset | ○ | ○ | X | ○ |
| | Hot offset | ○ | ○ | ○ | ○ |

Table 8 shows an image defect occurrence situation in the double-sided printing in the sixth example and the sixth to eighth comparative examples. In the table, O indicates that an image defect does not occur and X indicates that an image defect occurs.

Figure 28:
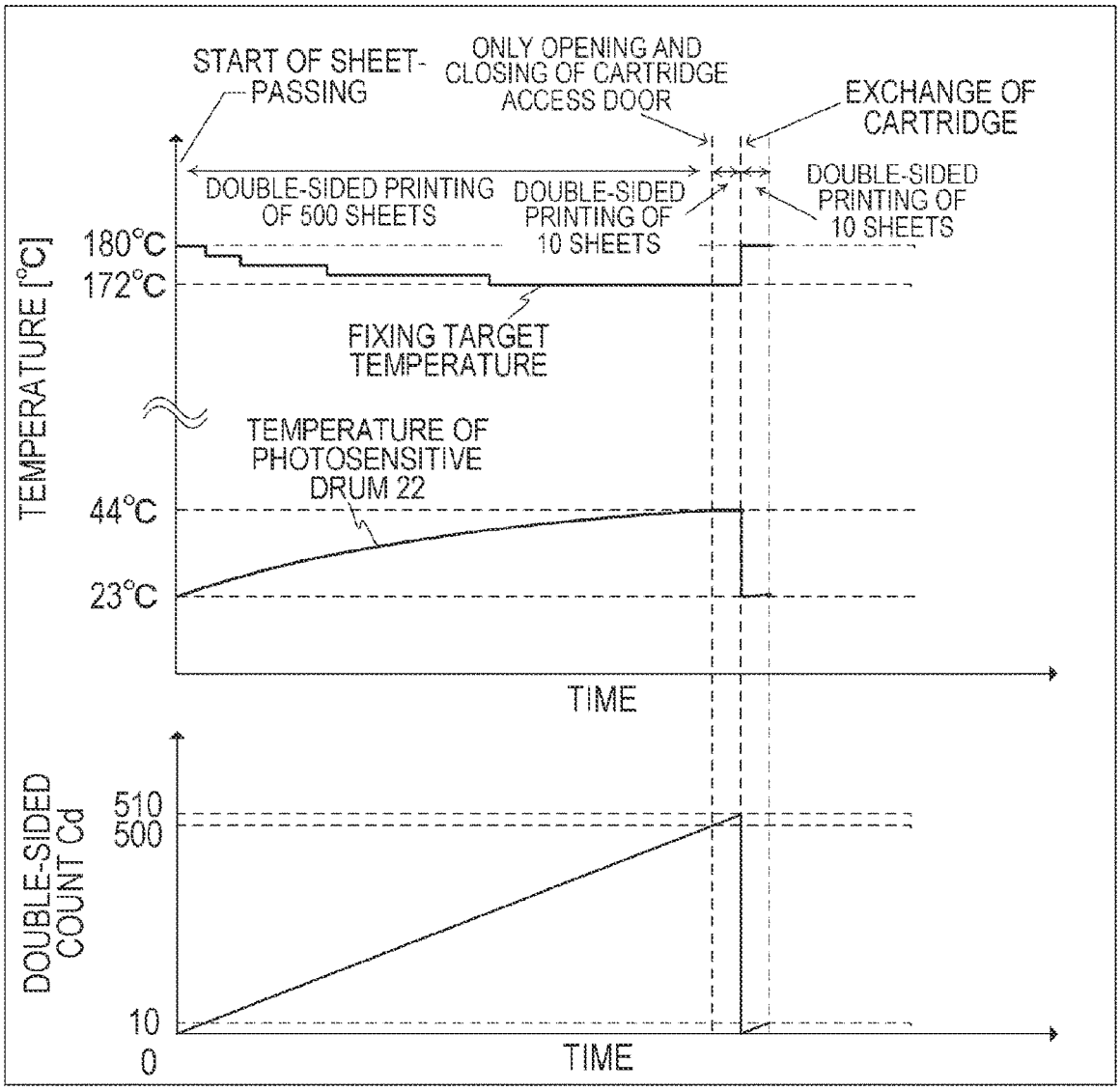
FIG. 28 is a diagram illustrating an experiment when control of the sixth example is used.

FIG. 28 illustrates temporal transitions of the target temperature Ttgt and the temperature of the photosensitive drum in the present example when the above-described experiment is carried out. At the time of starting the double-sided printing of 500 sheets, the double-sided count Cd is 0 and the target temperature adjustment amount D is also 0. Therefore, the target temperature Ttgt is 180° C. which is the reference temperature Ta. At this time, the temperature of the photosensitive drum 22 is the room temperature of 23° C. As the double-sided printing progresses, the double-sided count Cd increases, the target temperature adjustment amount D increases according to Table 7, and the target temperature Ttgt is lowered. When the double-sided printing of 500 sheets ends, the double-sided count Cd becomes 500 and the target temperature adjustment amount is 8. Therefore, the target temperature Ttgt is 172° C. At this time, the temperature of the photosensitive drum is 44° C.

In the present example, after the double-sided printing of 500 sheets, the CRG access door is opened and closed (here, the CRG 20 is not exchanged) and the double-sided printing of 10 sheets is subsequently performed. In this case, the control portion 108 determines that the CRG 20 is not exchanged in accordance with memory information of the CRG 20. Therefore, as in FIGS. 5A and 5B, the final target temperature Ttgt of 172° C. in the previous job is continuously set, when the double-sided printing of 10 sheets is processed. At this time, the temperature of the photosensitive drum 22 remains to be 44° C. Subsequently, the CRG access door is opened, the CRG 20 is exchanged for a new product with the same temperature as the room temperature, and the CRG access door is closed, and the double-sided printing of 10 sheets is performed again. In this case, the control portion 108 determines that the CRG 20 is exchanged to the new CRG 20 in accordance with the memory information, sets the double-sided count Cd to 0, and sets the target temperature Ttgt to 180° C. In the present example, since the exchange of the CRG 20 is detected and the target temperature Ttgt is set in accordance with the increase in the temperature of the photosensitive drum 22, an image defect does not occur in the series of double-sided printing.

Figure 29:
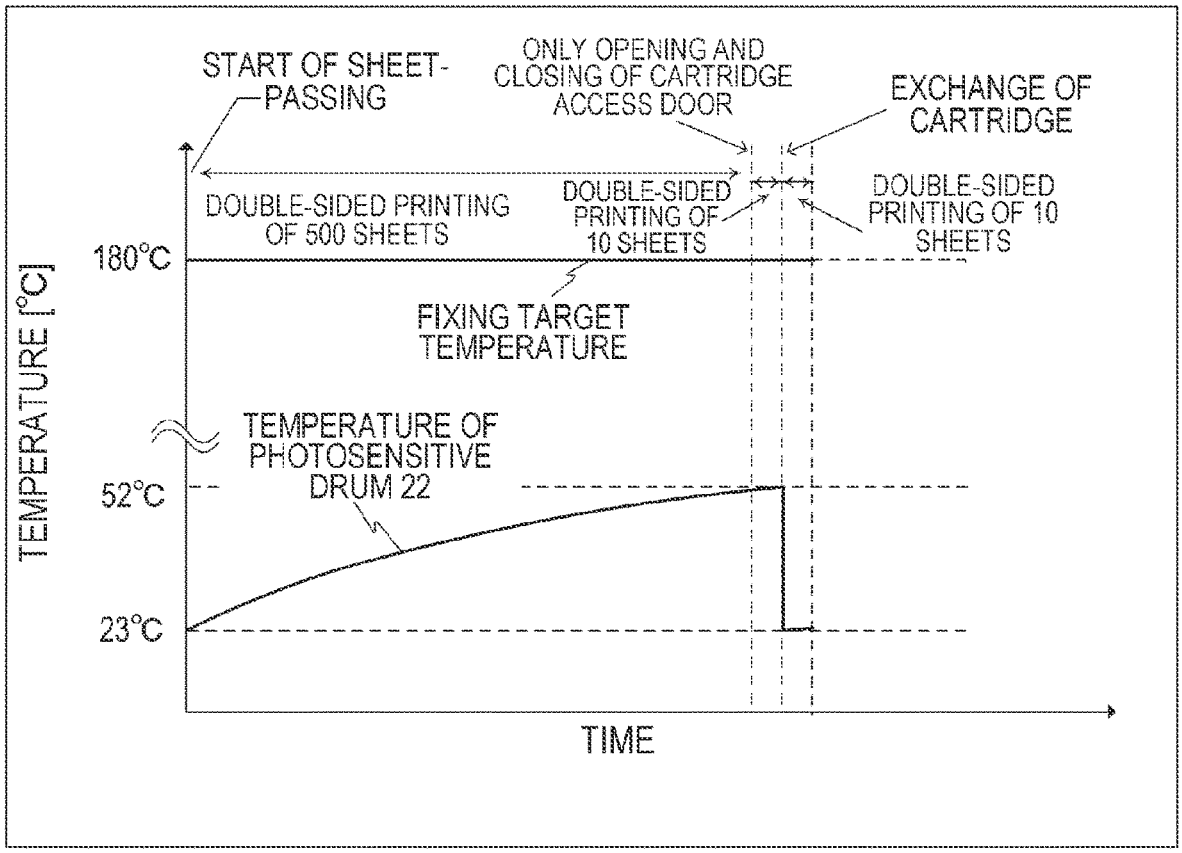
FIG. 29 is a diagram illustrating a result of an experiment when the control of a sixth comparative example is used.

FIG. 29 illustrates temporal transitions of the target temperature Ttgt and a temperatures of the photosensitive drum 22 according to the sixth comparative example. In the comparative example 6, irrespective of the temperature of the photosensitive drum 22, the target temperature Ttgt is set to the reference temperature Ta of 180° C. and the double-sided printing is all performed. In the latter half of the double-sided printing of 500 sheets, the temperature of the photosensitive drum 22 reaches 52° C. Therefore, in the latter half of the double-sided printing of 500 sheets and the double-sided printing after the CRG access door is opened and closed, the temperature of the recording material 11 is raised and a hot offset continues to occur in the printing of the second surface. However, in the double-sided printing after the CRG 20 is exchanged, the photosensitive drum 22 becomes the room temperature. Therefore, although fixing processing is performed at the reference temperature Ta, an image defect does not occur.

Figure 30:
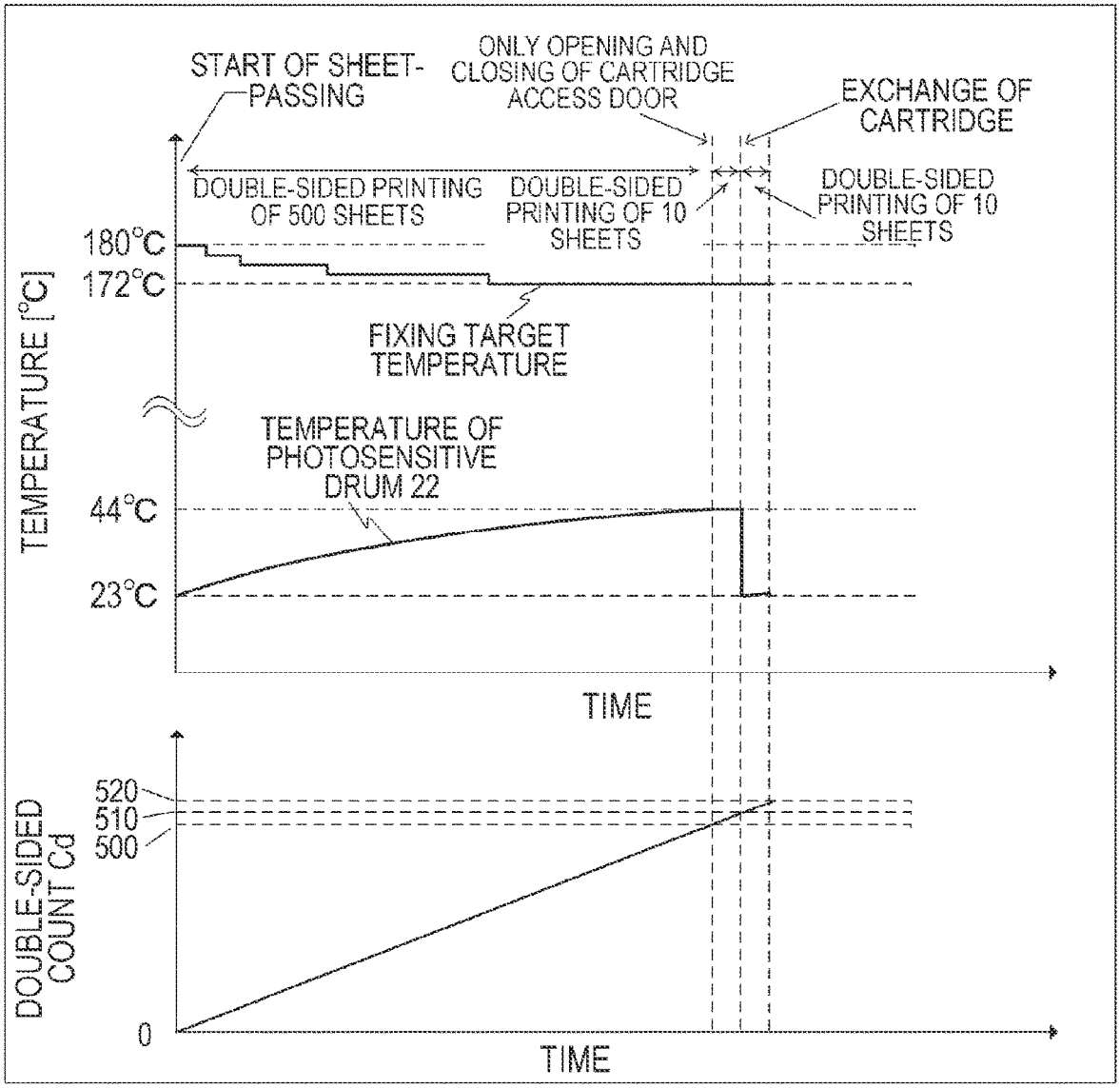
FIG. 30 is a diagram illustrating a result of an experiment when the control of a seventh comparative example is used.

FIG. 30 illustrates temporal transitions of the target temperature Ttgt and the temperature of the photosensitive drum 22 according to the seventh comparative example. In the seventh comparative example, as in the first example, the target temperature Ttgt is adjusted with the increase in the temperature of the photosensitive drum 22 using the double-sided count Cd. Therefore, in the double-sided printing of 500 sheets and the double-sided printing of 10 sheets after the CRG access door is opened and closed, an image defect does not occur. The transition of the temperature of the photosensitive drum 22 is similar to that of the sixth example. In the seventh comparative example, however, there is no structure in which the exchange of the CRG 20 is detected. Therefore, although the CRG 20 is exchanged, the double-sided count Cd is not reset. Therefore, in the double-sided printing of 10 sheets after the CRG 20 is exchanged, a value of the double-sided counter starts from 510 and the fixing processing is performed at the final target temperature Ttgt of 172° C. of the previous job. Since the temperature of the exchanged photosensitive drum 22 becomes the same temperature as the room temperature, the recording material 11 is not warmed by the photosensitive drum 22. Thus, when the fixing processing is performed at the target temperature Ttgt of 172° C., an amount of heat is insufficient and a cold offset occurs.

Figure 31:
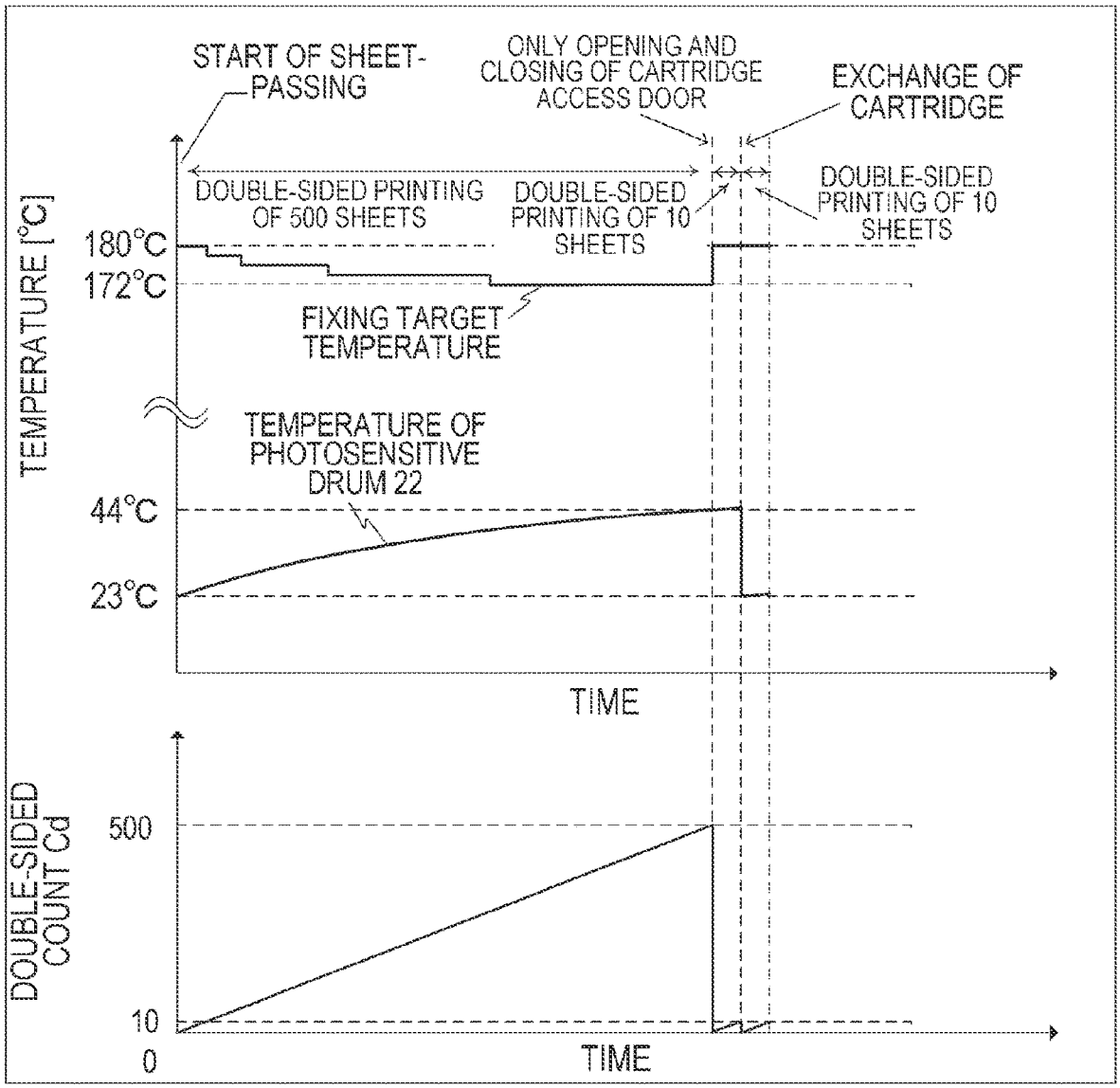
FIG. 31 is a diagram illustrating a result of an experiment when the control of an eighth comparative example is used.

FIG. 31 illustrates temporal transitions of the target temperature Ttgt and the temperature of the photosensitive drum 22 according to the eighth comparative example. In the eighth comparative example, as in the first example, since the target temperature Ttgt is adjusted with the increase in the temperature of the photosensitive drum 22 using the double-sided count Cd, an image defect does not occur in the double-sided printing of 500 sheets. However, after the CRG access door is opened and closed, the CRG 20 is determined to be exchanged and the double-sided count Cd is reset to 0. Therefore, the temperature of the photosensitive drum 22 remains high actually, but the target temperature Ttgt returns to the reference temperature Ta of 180° C. Therefore, an amount of heat given to the recording material 11 and toner images is excessive, and thus a hot offset occurs in the fixing processing of the second surface. In the double-sided printing of 10 sheets after the CRG 20 is exchanged for a new product, the double-sided count Cd starts from 0 again. However, since the photosensitive drum 22 becomes the room temperature, an image defect does not occur.

As described above, the control portion 108 sets the target temperature to be low as the number of sheets of the double printing increases. Further, the target temperature is set to be high from the printing right after the exchange of the CRG 20 is detected. In mass double-sided printing, by adjusting the target temperature based on the temperature of the photosensitive drum 22, it is possible to inhibit excessive heat supply to the recording material 11 and toner images and it is possible to inhibit a hot offset. However, when the CRG access door is opened and closed and whether the CRG 20 is exchanged cannot be correctly detected through the CRG exchange detection, it is difficult to set an appropriate target temperature. To inhibit a fixing defect, it is very important to reflect a result of the CRG exchange detection in the target temperature.

In the present example, the photosensitive drum 22, the charger 23, the cleaner 21, the development unit 26, and the toner container 25 are unitized as the CRG 20, as described above. However, the CRG 20 may have a configuration in which at least the photosensitive drum 22 is included. As a CRG exchange detection method, a method of bringing a memory chip mounted on the CRG 20 into contact with a contact connector of the body of the printer 1 for communication has been described, but a radio frequency tag (RF tag) may be mounted on the CRG 20 for contactless communication. A method of attaching a seal or the like on which a serial number such as a barcode or a 2-dimensional code is written to the CRG 20 and reading the seal with an optical sensor provided in the body of the printer 1 may be used. Such factors are similarly applied to other examples to be described below.

Seventh Example

In the sixth example, in the monochromic printer using a direct transfer scheme of directly transferring a toner image from the photosensitive drum 22 to the recording material 11, the fixing target temperature is set when the photosensitive drum 22 can be exchanged, as described above. A seventh example is an example in which a warming state of the printer is predicted in accordance with an activation situation of the printer and a fixing target temperature is set in a color printer 100 where a secondary transfer scheme is used and the intermediate transfer belt 28 can be exchanged. In the seventh example, the intermediate transfer belt 28, the support rollers (33*a*, 33*b*, and 33*c*), and the primary transfer rollers (27Y, 27M, 27C, and 27K) are unitized as an ITB unit 37 (intermediate transfer unit). The ITB unit 37 can be exchanged through an ITB unit access door (not illustrated). That is, the ITB unit 37 is equivalent to a transfer member that forms a transfer nip portion with the photosensitive drum 22 serving as an image bearing member.

Figure 32:
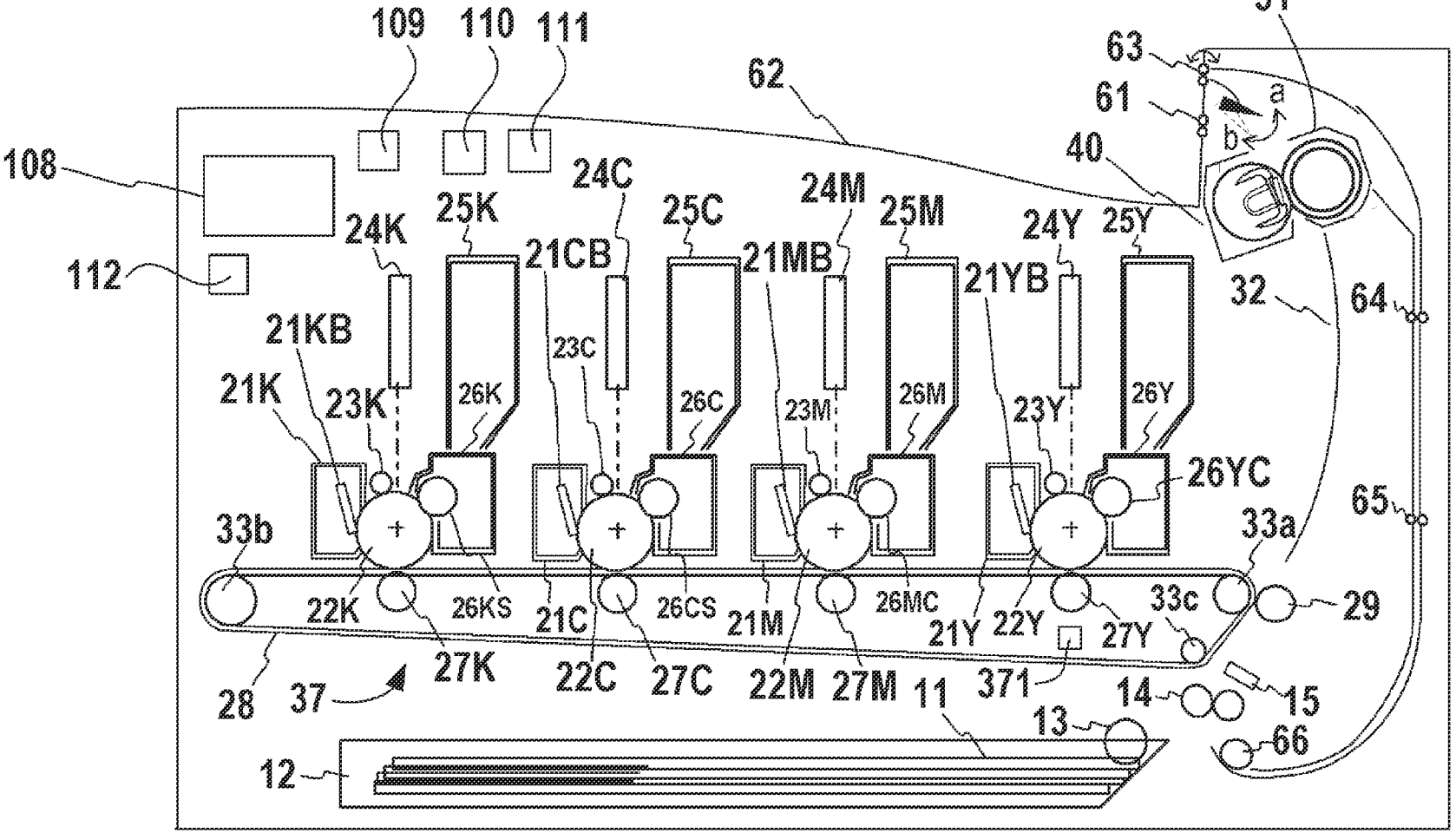
FIG. 32 is a sectional view illustrating an image forming apparatus according to a seventh example.

FIG. 32 is a sectional view illustrating an electrophotographic color printer according to the seventh example. The printer 100 includes CRGs (20Y, 20M, 20C, and 20K) including a plurality of photosensitive drums (22Y, 22M, 22C, and 22K) serving as a plurality of first exchangeable image bearing members and an intermediate transfer belt (intermediate transfer body) 28 serving as a second exchangeable image bearing member.

The photosensitive drum 22Y, the charger 23Y, the development unit 26Y, and the cleaner 21Y are unitized as a cartridge (CRG) 20Y. The CRG 20Y is exchangeable with respect to the body of the printer 100. For the other colors, a CRG 20M, a CRG 20C, and a CRG 20K are unitized and are each exchangeable with respect to the body of the printer 100 through a CRG access door (not illustrated). The CRGs 20Y, 20M, 20C, and 20K are each mounted on memory chips (not illustrated) similar to that of the first example. In the body of the printer 100, a contact connector (not illustrated) corresponding to the individual memory chip of each of the CRGs 20Y, 20M, 20C, and 20K is disposed so that communication is possible.

As described above, the intermediate transfer belt 28, the support rollers (33*a*, 33*b*, and 33*c*), the primary transfer rollers (27Y, 27M, 27C, and 27K) serving as first transfer members are unitized as the ITB unit 37. The ITB unit 37 is exchangeable via an ITB unit access door (not illustrated). A memory chip 371 serving as a storage is also mounted on the ITB unit 37. In the body of the printer 100, a contact connector (not illustrated) corresponding to the memory chip 371 of the ITB unit 37 is disposed so that communication is possible. Since a basic configuration and an operation of the image forming apparatus and the heating device other than the ITB unit 37 and the CRGs 20Y, 20M, 20C, and 20K are the same as those of the first example, description thereof will be omitted.

An image density detection toner patch is formed on the intermediate transfer belt 28. When a function of detecting the image density detection toner patch using an optical sensor is provided, a surface shape corresponding to one round of the intermediate transfer belt 28 is digitized by the optical sensor. Exchange of the ITB unit 37 may be detected by comparing the image density detection toner patch with a result of previous measurement. By using a fuse or the like that is mounted as a new product in the printer 100 and is broken at the time of first driving, it may be detected whether the ITB unit 37 is a new product in accordance with a method of sending a signal different from a normal signal at the time of first use. Irrespective of the detector, it may be detected whether the ITB unit is exchanged. An exchange detection scheme is not limited.

Method of Setting Target Temperature

Next, a method of setting a target temperature according to the seventh example will be described. In the sixth example, a double-sided counter that counts the number of sheets of the double-sided printing as a warming index of the photosensitive drum serving as an image bearing member has been used. In the monochromatic printer, control can be implemented by a number-of-sheets counter. However, in a color printer of a secondary transfer scheme, apart from the recording material 11, the four photosensitive drums 22Y, 22M, 22C, and 22K come into contact with the intermediate transfer belt 28 with which the recording material 11 comes into direct contact. Since the number of items having an influence on a temperature of the intermediate transfer belt 28 increases, the structure of the number-of-sheets counter is complicated. A temperature of the intermediate transfer belt 28 deviates from the number-of-sheets counter in some cases, and thus there is a possibility of the target temperature being not appropriately set. Accordingly, in the color printer of the secondary transfer scheme, it is necessary to ascertain an increase in the temperature in pre-printing, a decrease in the temperature in waiting, or the like in detail and predict a temperature of the intermediate transfer belt 28 in combination with an activation situation of the printer. When the temperature of the exchangeable intermediate transfer belt 28 is predicted, the intermediate transfer belt 28 also comes into contact with the four exchangeable photosensitive drums (22Y, 22M, 22C, and 22K). Therefore, it is necessary to also predict temperatures of the photosensitive drums (22Y, 22M, 22C, and 22K).

In the seventh example, a case in which the temperatures of the intermediate transfer belt 28 included in the exchangeable ITB unit 37 and the photosensitive drums (22Y, 22M, 22C, and 22K) included in the exchangeable CRGs (20Y, 20M, 20C, and 20K) are each predicted and the target temperature adjustment amount D is determined will be described.

An aspect of an increase in the temperature in the double-sided consecutive printing of the intermediate transfer belt 28, an aspect of an increase in the temperature during one-sided consecutive printing, and an aspect of a decrease in the temperature of the intermediate transfer belt 28 in body stopping are the same as those illustrated in FIGS. 12A to 12C described in the first example. A temperature of the intermediate transfer belt 28 in the three states is measured in advance.

Figure 33A:
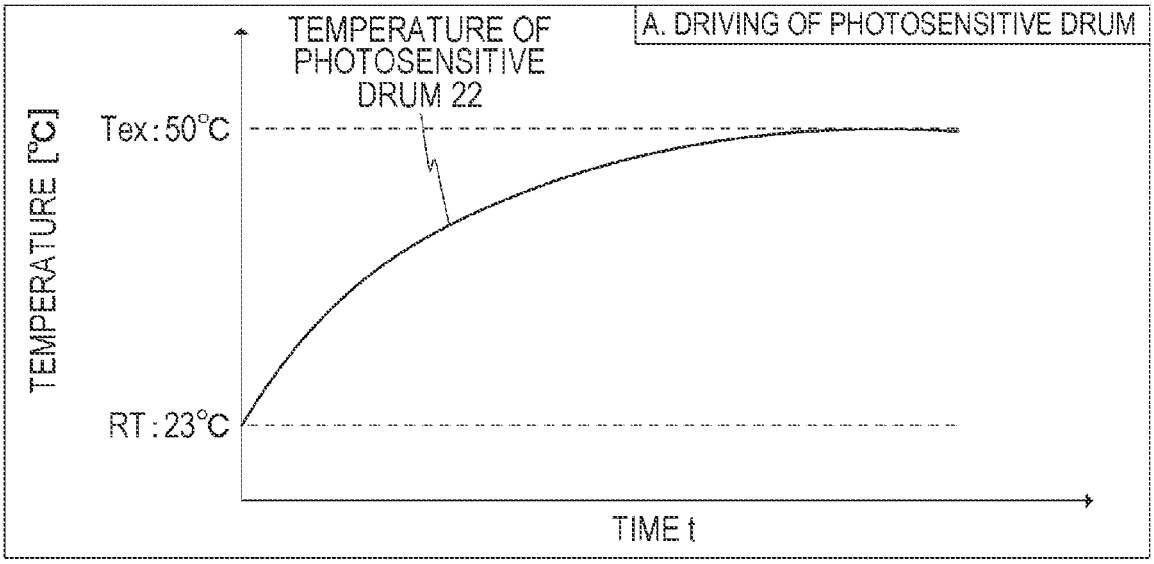
FIGS. 33A and 33B are diagrams illustrating a temperature transition of a photoreceptor (a photosensitive drum)
Figure 33B:
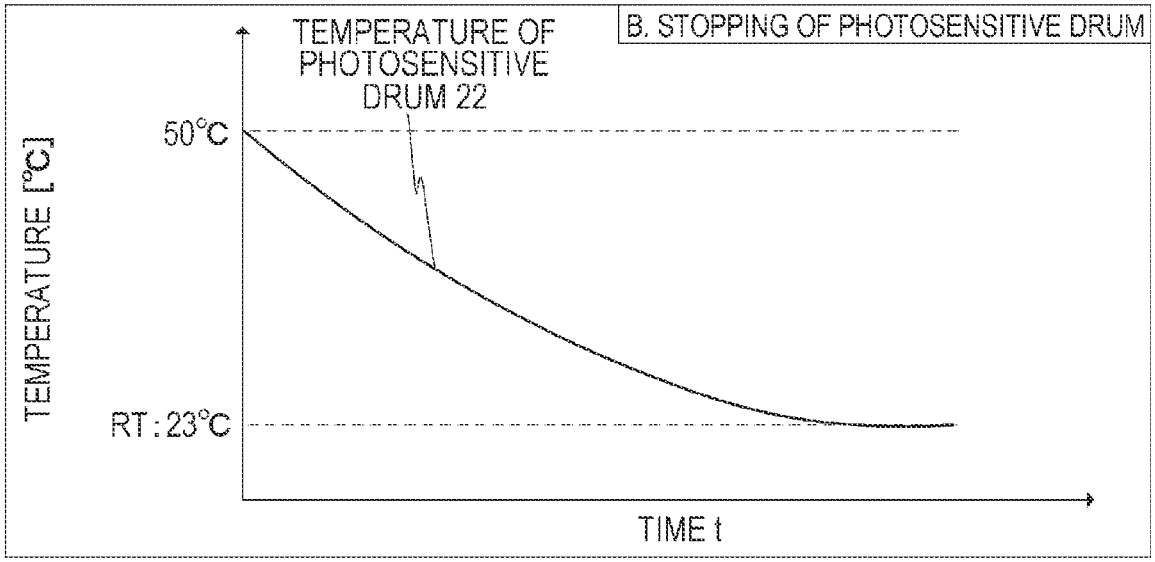

FIGS. 33A and 33B illustrate a temperature of one photosensitive drum (denoted by reference numeral 22) measured in advance in the following two states. FIG. 33A illustrates an aspect of a self-temperature increase by friction with a cleaning blade (denoted by reference number 21) when the photosensitive drum 22 is driven. The temperature of the photosensitive drum 22 is increased from the room temperature (RT) of 23° C. to a saturation temperature (Tex) of 50° C. FIG. 33B illustrates an aspect of a decrease in the temperature due to heat released to the atmosphere of the photosensitive drum 22 when the photosensitive drum is stopped. The temperature of the photosensitive drum 22 is decreased to a saturation temperature (Tfx) of 23° C. (room temperature) from a state of an increase in the temperature (50° C.).

At this time, a temperature Ti of the intermediate transfer belt 28 and a temperature Tj of each photosensitive drum 22 can be predicted by the following Prediction Expression (6), (7), (8), and (9)

$$Ti(t) = Ti(t-1) - \Delta Ti + \alpha[4Ti(t-1) - Ty(t-1) - Tm(t-1) - Tc(t-1) - Tk(t-1)] \quad (8)$$

$$Tj(t) = Tj(t-1) + \Delta Tj + \beta[Tj(t-1) - Ti(t-1)](j = y, m, c, k) \quad (7)$$

$$\Delta Ti = [Tdx - Ti(t-1)] \times Kd \times Ed + [Tsx - Ti(t-1)] \times Ks \times Es + [Twx - Ti(t-1)] \times Kw \times Ew \quad (8)$$

$$\Delta Tj = [Tex - Tj(t-1)] \times Ke \times Ee + [Tfx - Tj(t-1)] \times Kf \times Ef \quad (9)$$

The temperature of the intermediate transfer belt 28 can be expressed with exchange of heat of an atmosphere or the recording material 11 in a printing mode (one-sided printing or double-sided printing) and a stopping state and exchange of heat by a temperature difference from each photosensitive drum 22.

The temperature of the photosensitive drum 22 can be expressed with self-heating or exchange of heat released to an atmosphere in a driving state (in driving or stopping) and exchange of heat by a temperature difference from the intermediate transfer belt 28.

Here, Ti(t) indicates a predicted value of the temperature of the intermediate transfer belt 28 at a time t, and the time t is a time of every second. Tj(t)[j=y. MS, k] indicates a predicted value of the temperature of a photosensitive drum 22*j* [j=y, MS, k] at a time t. Ti(t−1) is a predicted value of the temperature of the intermediate transfer belt 28 at a time t−1. 4Ti(t−1)−Ty(t−1)−Tm(t−1)−Tc(t−1)−Tk(t−1) is a sum of differences of the temperatures of each photosensitive drum 22 and the intermediate transfer belt 28 at a time t−1, and a is a constant. Here, a is a constant determined with a thermal capacity difference between the intermediate transfer belt 28 and the photosensitive drum 22.

Tj(t−1) is a predicted value of the temperature of the photosensitive drum 22 at a time t−1. Tj(t−1)−Ti(t−1) is a difference between temperatures of the intermediate transfer belt 28 and the photosensitive drum 22 at a time t−1, and β is a constant. Here, β is a constant determined with a thermal capacity difference between the intermediate transfer belt 28 and the photosensitive drum 22.

ΔTi expresses exchange of heat with the recording material or an atmosphere in each print mode at a time t. Accordingly, ΔTi can be expressed with a saturation temperature (Tdx) in the double-sided consecutive printing, a saturation temperature (Tsx) in the one-sided consecutive printing, a difference between saturation temperatures (Twx) and Ti(t−1) in the body stopping, constants K (Kd, Ks, and Kw), and variables E (Ed, Es, and Ew).

Here, the variables E vary in accordance with an activation situation of the printer 100. In the double-sided printing, Ed=1, Es=0, and Ew=0 are set. On the other hand, in the one-sided printing, Ed=0. Es=1, and Ew=0 are set. In the body stopping, Ed=0, Es=0, and Ew=1 are set. That is, Expression (8) is divided into terms in the double-sided printing, the one-sided printing, and the body stopping. The variables E determine which term is valid. Each term is expressed with a difference between each saturation temperature (Tdx, Tsx, and Twx) and Ti(t−1).

ΔTj expresses self-heating or exchange of heat released to an atmosphere in a driving state (in driving or stopping). Accordingly, ΔTj can be expressed with a difference between a saturation temperature (Tex) in driving, a saturation temperature (Tfx) in stopping of the photosensitive drum 22, and Tj(t−1), constants (Ke and Kf), and variables E (Ee and Ef). Here, the variables E vary in accordance with a driving situation of the photosensitive drum. Ee=1 and Ef=0 are set in the driving, and Ee=0 and Ef=1 are set in the stopping. That is, Expression (9) is divided into terms in the driving of the photosensitive drum 22 and the stopping of the photosensitive drum 22. The variables E determine which term is valid. Each term is expressed with a difference between each saturation temperature (Tex, and Tfx) and Ti(t−1).

For example, when the double-sided printing continues for a long time, Ti(t−1) in Expression (8) is closed to Tdx and ΔTj≈0 is satisfied. Therefore, Ti(t) in Expression (6) is closed to the saturation temperature Tdx in the double-sided printing. This is also closed to Tsx and Twx when the one-sided printing and the body stopping continue for a long time. The constants K (Kd, Ks, and Kw) are constants for performing adjustment so that a predicted value and an actually measured value are matched in the double-sided printing, the one-sided printing, and the body stopping.

The temperature of the intermediate transfer belt 28 and the temperature of the photosensitive drum 22 have terms that have an influence on each other and work in a direction in which a temperature difference is reduced. Therefore, when the temperature difference increases, an influence of the term for reducing the temperature difference is also stronger.

Figure 34:
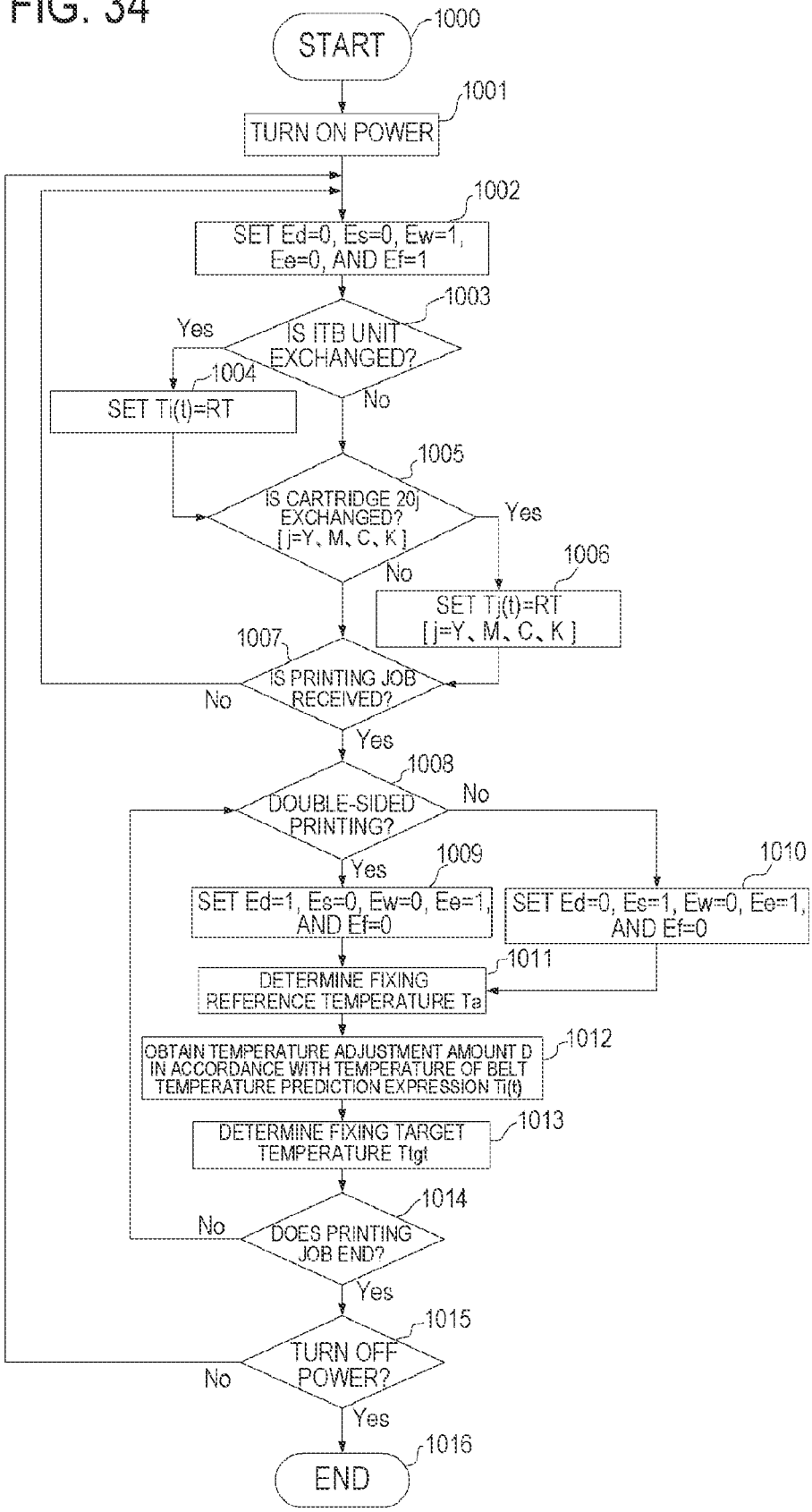
FIG. 34 is a flowchart illustrating a method of setting a target temperature according to the seventh example.

A method of setting the target temperature Ttgt in the seventh example will be described with reference to the flowchart of FIG. 34. When a power switch (not illustrated) of the printer 100 is turned on (1001), Ed=0, Es=0, Ew=1, Ee=0, and Ef=1 are set in the temperature prediction expression (belt temperature prediction expression) Ti(t) of the intermediate transfer belt 28 and a drum temperature prediction expression Tj(t). The belt temperature prediction expression Ti(t) is set in the prediction expression Tw(t) in the waiting and the drum temperature prediction expression Tj(t) is set in the prediction expression Tf in the waiting (1002). An initial value when power of the belt temperature prediction expression Ti(t) and the drum temperature prediction expression Tj(t) is turned on is set to the room temperature (RT).

Here, the room temperature is a detected temperature when a temperature sensor is mounted to detect the room temperature. When the temperature sensor is not mounted, for example, the room temperature may be a fixed value such as 23° C. The temperatures of the belt temperature prediction expression Ti(t) and the drum temperature prediction expression Tj(t) at the previous time of turning off power can be stored. When an elapsed time from the time of turning off power to the time of turning on power can be measured, the following determination may be made. That is, a belt temperature and a drum temperature at the time of turning on power may be calculated from the elapsed time using the foregoing Expressions (6) to (9).

Subsequently, ITB unit exchange is detected (1003). When the ITB unit is exchanged, the room temperature (RT) is set in Ti(t) (1004). Subsequently, the CRG exchange detection is performed (1005). When the exchange is detected, the room temperature (RT) is set in Tj(t) (1006). When a printing job is received (1007), it is determined whether a printing job is the double-sided printing (1008). When the printing job is the double-sided printing, Ed=1, Es=0, Ew=4), Ee=1, and Ef=0 are each set, the belt temperature prediction expression Ti(t) is set in the prediction expression Td(t) in the double-sided sheet-passing, and the drum temperature prediction expression Tj(t) is set in the prediction expression Te(t) in the driving (1009). When the printing job is the one-sided printing, Ed=0, Es=1, Ew=0, Ee=1, and Ef=0 are each set, the belt temperature prediction expression Ti(t) is set in the prediction expression Ts(t) in the one-sided sheet-passing, and the drum temperature prediction expression Tj(t) is set in the prediction expression Te(t) in the driving (1010).

Subsequently, the reference temperature Ta is determined (1011). A method of determining the reference temperature Ta is similar to that of the sixth example. The target temperature adjustment amount D in accordance with the temperature of the intermediate transfer belt 28 calculated with the belt temperature prediction expression Ti(t) is obtained (1012). The target temperature adjustment amount D is a parameter set in accordance with the temperature of the intermediate transfer belt 28, as illustrated in FIG. 15. As the temperature of the intermediate transfer belt 28 is higher, the target temperature adjustment amount D is larger. Specifically, whenever the temperature of the intermediate transfer belt 28 increases by 1° C. from the room temperature, the target temperature adjustment amount D is set to be larger by 1° C. Finally, the target temperature Ttgt is calculated with Expression (10) and determined (1013).

$$Ttgt = Ta - D \tag{10}$$

The processing of steps 1008 to 1013 is repeated until the printing job ends (1014). When the printing job ends, the processing of steps 1002 to 1014 is repeated until power is turned off (1015). When power is turned off, the flow ends (1016).

The setting of the variables E in accordance with the activation state of the printer 100 and detailed prediction of the temperature of the intermediate transfer belt 28 and the temperature of the photosensitive drum of each color by Expressions (6), (7), (8), and (9) are possible, and thus the appropriate target temperature Ttgt can be set.

Here, to check advantages when the exchange detection of the ITB unit 37 according to the present example, the exchange detection of the CRG, and target temperature control of the heating device based on the temperature of the intermediate transfer belt 28 in accordance with the belt temperature prediction expression Ti(t) are performed, the following experiment is carried out. Conditions of the experiment are that a conveying speed of the recording material is 300 mm/sec and a printing speed (throughput) is 60 ppm. A used recording material is an A4 size sheet of RedLabel manufactured by Canon Oce, a sheet basis weight is 80 g/m$^2$, and the reference temperature Ta is 180° C.

The experiment is preferably carried out in an environment managed under constant temperature and humidity conditions by air conditioning of an air conditioner or the like. In the present example, the experiment is carried out in an environment of a temperature of 23° C. and a relative humidity of 50%.

As printing conditions, double-sided printing of 500 sheets is performed, an ITB unit access door is once opened and closed, and the double-sided printing of 10 sheets is performed. Thereafter, after the ITB unit access door is opened again and the ITB unit is exchanged for a new product, the double-sided printing of 10 sheets is further performed. The experiment starts from a state in which the internal temperature becomes 23° C.

Figure 35:
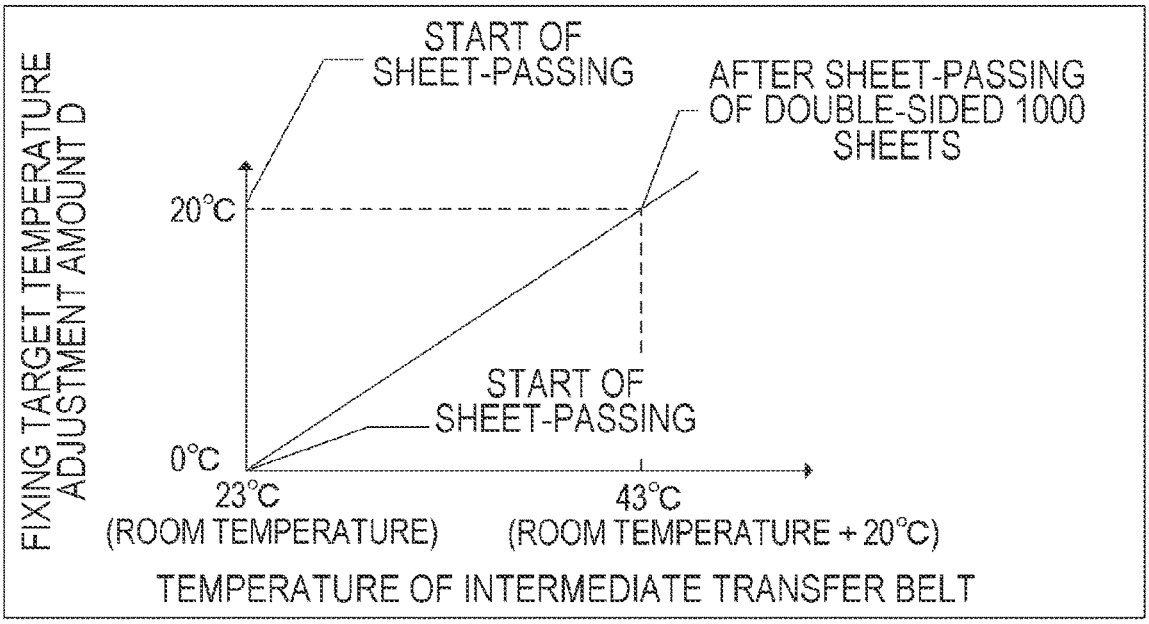
FIG. 35 is a diagram illustrating a relation between a temperature of an intermediate transfer body and an adjustment amount D of the target temperature.
Figure 36:
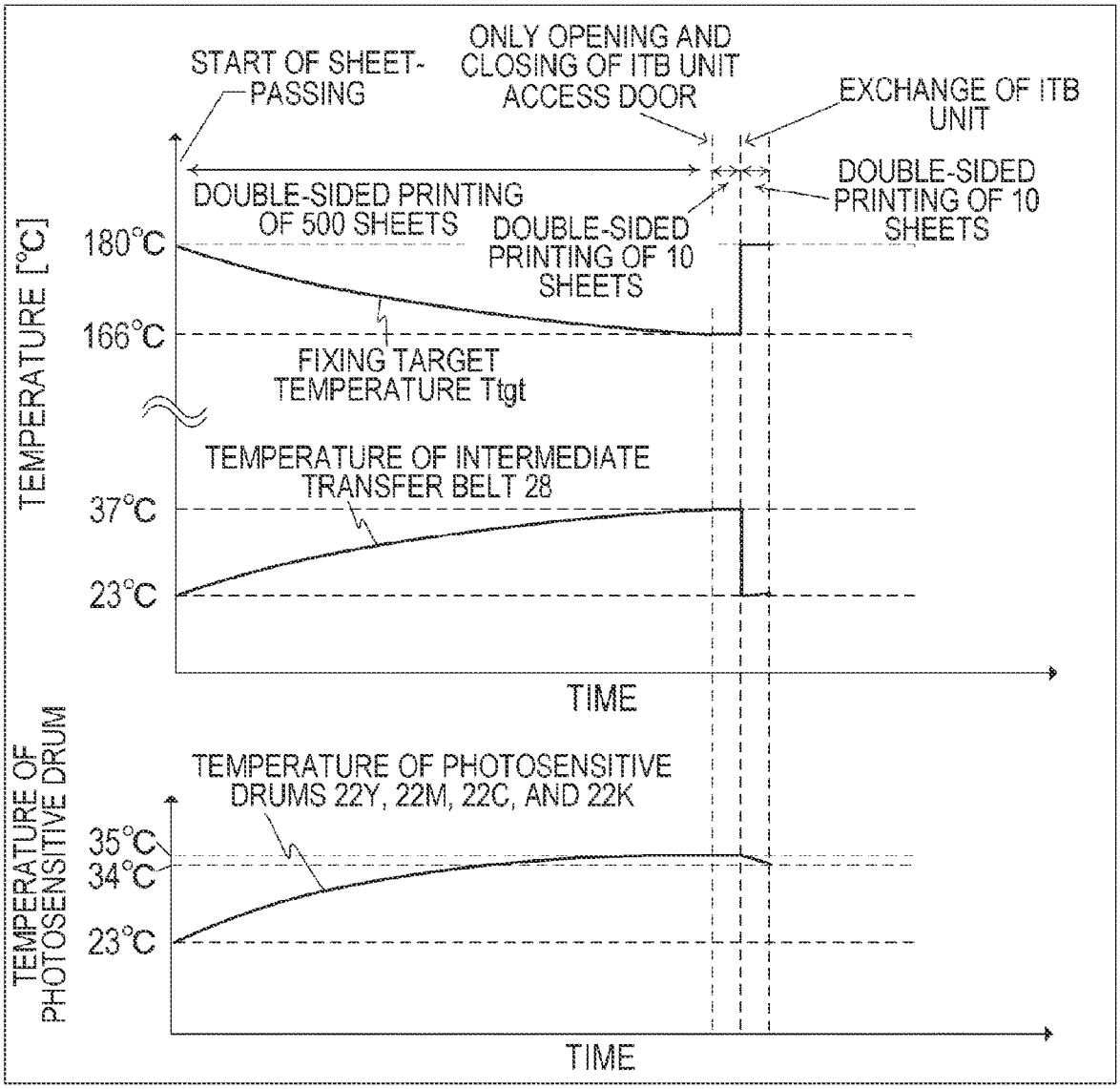
FIG. 36 is a diagram illustrating a result of an experiment when control of the seventh example is used.

FIG. 36 illustrates temporal transitions of the target temperature Ttgt, the temperature of the intermediate transfer belt 28 calculated from the belt temperature prediction expression Ti(t), and the temperature of the drum of each color calculated from the drum temperature prediction expression Tj(t) according to the present example in this experiment. Since the temperature of the intermediate transfer belt is 23° C. when the double-sided printing of 500 sheets starts, the target temperature adjustment amount D is also 0. The target temperature Ttgt is 180° C. which is the reference temperature Ta. At this time, the temperature of the photosensitive drum of each color is also the room temperature of 23° C. As the double-sided printing progresses, the temperature of the intermediate transfer belt 28 increases, the target temperature adjustment amount D increases according to the relation of FIG. 35, and the target temperature Ttgt is lowered. When the double-sided printing of 500 sheets ends, the temperature of the intermediate transfer belt 28 becomes 37° C. and the target temperature adjustment amount D is 14. Therefore, the target temperature Ttgt is 166° C. At this time, the temperature of the photosensitive drum of each color is 35° C.

Subsequently, after the ITB unit access door is opened and closed, the double-sided printing of 10 sheets is performed. At this time, since the exchange is not detected through ITB unit exchange detection, the temperature remains to be 37° C. in the belt temperature prediction expression Ti(t) without being reset to the room temperature. Accordingly, the target temperature Ttgt remains to be 166° C. in accordance with the temperature of the intermediate transfer belt 28. At this time, the temperature of the photosensitive drum remains to be 35° C.

Subsequently, the ITB unit access door is opened, the ITB unit is exchanged for a new product at the room temperature, the access door is closed, and the double-sided printing of 10 sheets is performed again. At this time, the exchange is detected through the ITB unit exchange detection before the printing starts. Therefore, the belt temperature prediction expression Ti(t) is reset to the room temperature of 23° C. When the printing starts, the temperature of the intermediate transfer belt 28 becomes 23° C. Therefore, the target temperature adjustment amount D becomes 0 and the target temperature Ttgt is set to 180° C. When the double-sided printing of 10 sheets ends, the temperature is lowered to 34° C. in the drum temperature prediction expression Tj(t) of the photosensitive drum of each color. This is because the heat of the photosensitive drum is deprived of by the temperature of the intermediate transfer belt 28 since the intermediate transfer belt 28 becomes the room temperature.

In this way, by detecting the exchange of the intermediate transfer belt 28 coming into direct contact with the recording material 11 through the ITB unit exchange detection and reflecting the exchange in the belt temperature prediction expression Ti(t), it is possible to inhibit a cold offset.

Figure 37:
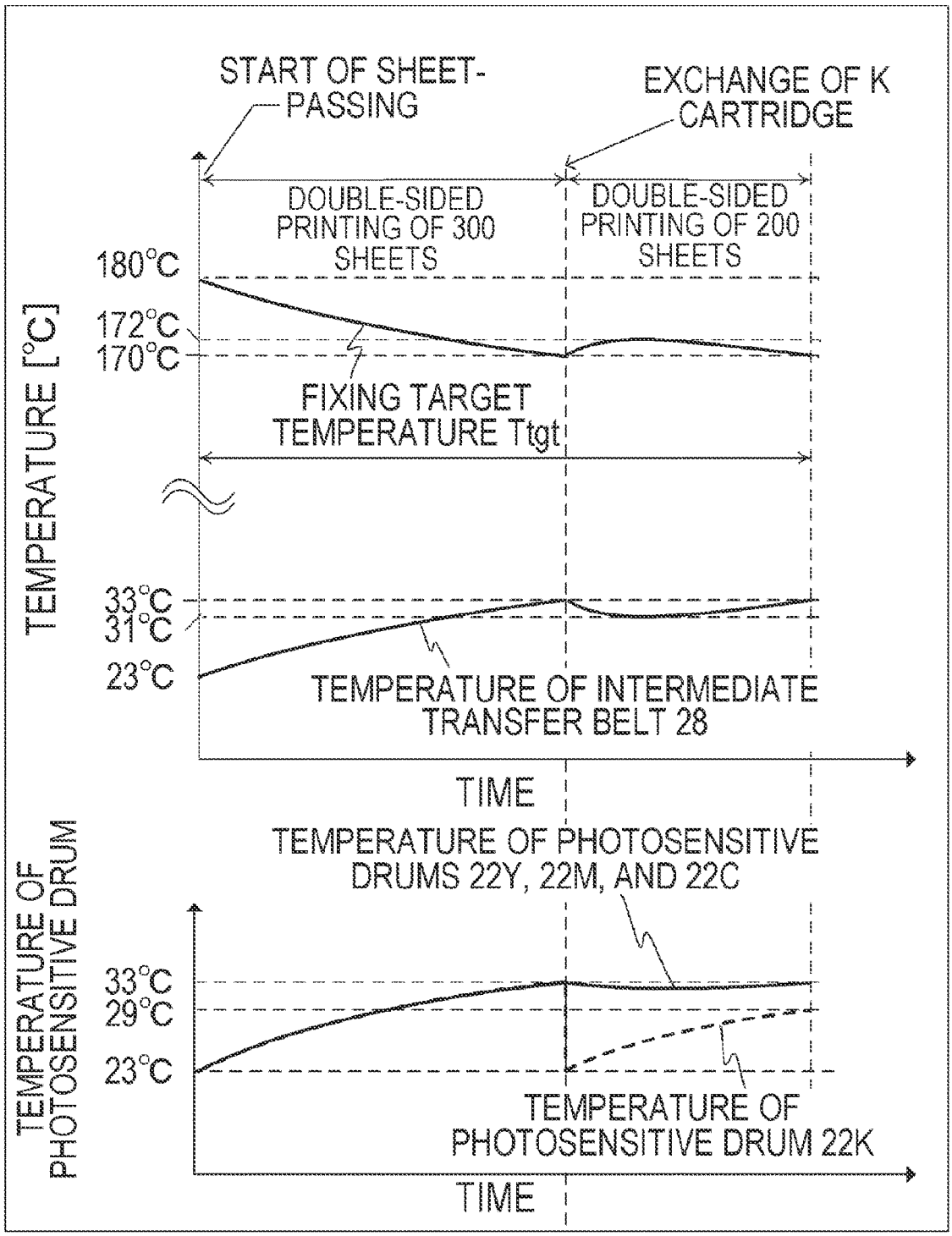
FIG. 37 is a diagram illustrating a result of an experiment when the control of the seventh example is used.
Figure 38:
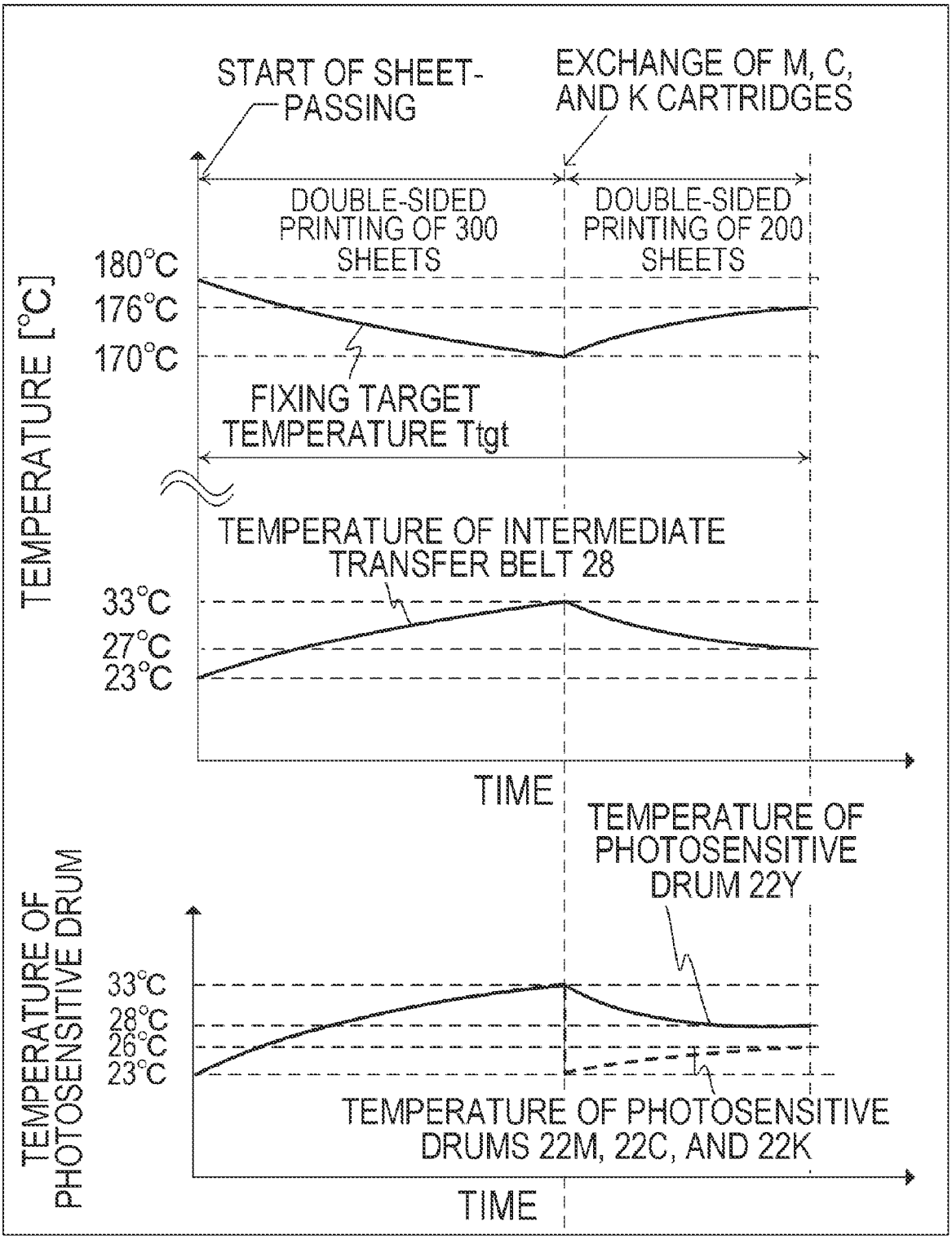
FIG. 38 is a diagram illustrating a result of an experiment when the control of the seventh example is used.

In a subsequent experiment, an operation of the target temperature Ttgt when the CRG is exchanged during the double-sided printing will be described. FIG. 37 illustrates a case in which the CRG 20K is exchanged through the CRG access door after the double-sided printing of 300 sheets, and then the double-sided printing of 200 sheets is performed. FIG. 38 illustrates temporal transitions of the target temperature Ttgt, the temperature of the intermediate transfer belt 28 by the belt temperature prediction expression Ti(t), and the temperature of the drum of each color by the drum temperature prediction expression Tj(t).

When the double-sided printing of 300 sheets ends, the temperature of the intermediate transfer belt 28 becomes 33° C. and the target temperature adjustment amount D is 10. Therefore, the target temperature Ttgt is 170° C. At this time, the temperature of the photosensitive drum of each color is 33° C. Thereafter, the CRG 20K is exchanged for a new product and the double-sided printing of 200 sheets starts. As the double-sided printing progresses, the temperature of the intermediate transfer belt 28 is lowered to 31° C. Thereafter, the temperature is changed to an increase. When the double-sided printing of 200 sheets ends, the temperature of the intermediate transfer belt 28 is raised to 33° C. This is because the drum temperature prediction expression Tk(t) of the photosensitive drum 22K is reset to the room temperature of 23° C. and a difference in temperature between the intermediate transfer belt 28 and the photosensitive drum 22K increases since the photosensitive drum 22K is exchanged for a new product. That is, the heat of the intermediate transfer belt 28 is deprived of by the photosensitive drum 22K. As the temperature of the photosensitive drum 22K is raised, a difference from the temperature of the intermediate transfer belt 28 also decreases. Therefore, the temperature of the intermediate transfer belt 28 is changed to an increase. At this time, the target temperature Ttgt also corresponds to a change in the temperature of the intermediate transfer belt 28 and the target temperature adjustment amount D is set. Therefore, in the double-sided printing of 200 sheets, the temperature is gradually raised from 170° C. to 172° C. and is lowered to 170° C. again.

FIG. 38 illustrates a case in which three CRGs 20M. 20C, and 20K are exchanged through the CRG access door after the double-sided printing of 300 sheets, and then the double-sided printing of 200 sheets is performed. FIG. 37 illustrates temporal transitions of the target temperature Ttgt, the temperature of the intermediate transfer belt by the belt temperature prediction expression Ti(t), and the temperature of the drum of each color by the drum temperature prediction expression Tj(t).

When the double-sided printing of 300 sheets ends, the temperature of the intermediate transfer belt 28 becomes 33° C. and the target temperature adjustment amount D is 10 similarly to the previous time. Therefore, the target temperature Ttgt is 170° C. At this time, the temperature of the photosensitive drum of each color is 33° C. Thereafter, the three CRGs 20M, 20C, and 20K are exchanged for new products and the double-sided printing of 200 sheets starts. As the double-sided printing progresses, the temperature of the intermediate transfer belt 28 is lowered. When the double-sided printing of 200 sheets ends, the temperature of the intermediate transfer belt 28 is lowered to 27° C. The reason why the temperature of the intermediate transfer belt 28 is lowered considerably more than the exchange case of one CRG 20K is that the heat of the intermediate transfer belt 28 is deprived of by the three photosensitive drums 22M, 22C, and 22K at the room temperature. Since the temperature of the unexchanged photosensitive drum 22Y or the intermediate transfer belt 28 is lowered, the heat is deprived of by the intermediate transfer belt 28 and the temperature is lowered from 33° C. to 28° C. At this time, the target temperature Ttgt also corresponds to a change in the temperature of the intermediate transfer belt 28 and the target temperature adjustment amount D is set. Therefore, in the double-sided printing of 200 sheets, the temperature is gradually raised from 170° C. to 176° C.

As described above, when the CRG is exchanged for anew product, the temperature of the intermediate transfer belt 28 is gradually lowered in accordance with an exchange number. When a temperature difference from the exchanged photosensitive drum is small, the temperature is changed to an increase again. The control portion 108 also adjusts the target temperature adjustment amount D in accordance with a change in the temperature of the intermediate transfer belt 28 by the belt temperature prediction expression Ti(t). Therefore, after the CRG is exchanged, the target temperature Ttgt is gradually raised.

In this way, the exchange detection of the ITB unit 37 including the intermediate transfer belt 28 and the exchange detection of the CRG including the photosensitive drum are performed, and an exchange detection result is reflected in the belt temperature prediction expression Ti(t) and the drum temperature prediction expression Tj(t). Thus, since a complicated temperature of the intermediate transfer belt 28 can be calculated and an appropriate target temperature can be set, it is possible to inhibit occurrence of a cold offset and a hot offset.

Eighth Example

As in the seventh example, when a temperature of the intermediate transfer belt 28 is predicted with the belt temperature prediction expression Ti(t), calculation stops at the time of turning off power or a sleeping state. For example, between the power OFF/sleeping state and power ON/sleeping return, an ambient temperature is considerably changed in some cases. Therefore, a predicted temperature predicted from a present room temperature deviates from an actual temperature of the intermediate transfer belt in some cases. When the ITB unit 37 is exchanged, a predicted temperature of the intermediate transfer belt after the change is set in a printer installation environment temperature. However, when the ITB unit 37 is stored in an environment with a temperature different from that of a printer installation place, the actual temperature of the intermediate transfer belt 28 is likely to deviate from the predicted temperature.

In the eighth example, an example of a method capable of correcting a temperature deviation right after power ON or at the time of exchanging of the ITB unit at which deviation from the predicted temperature easily occurs will be described.

A constant current is applied from a high-voltage circuit (not illustrated) to at least one of the primary transfer rollers (27Y, 27M, 27C, and 27K) when an image is not formed. Alternatively, a transfer voltage application unit 109 illustrated in FIG. 32 applies a constant voltage (transfer bias), and a voltage detecting unit 110 detects a voltage value at that time or a transfer current detecting unit 111 detects a current value (a transfer current value). By monitoring such detected results and causing a transfer calculation processing unit 112 to calculate a resistance value of the primary transfer portion, it is possible to measure a resistance value of a primary transfer portion configured by the photosensitive drums 22, the intermediate transfer belt 28, and the primary transfer rollers 27. A result of the resistant measurement is used to determine an optimum voltage to be applied to the primary transfer roller when an image is formed.

Figure 39:
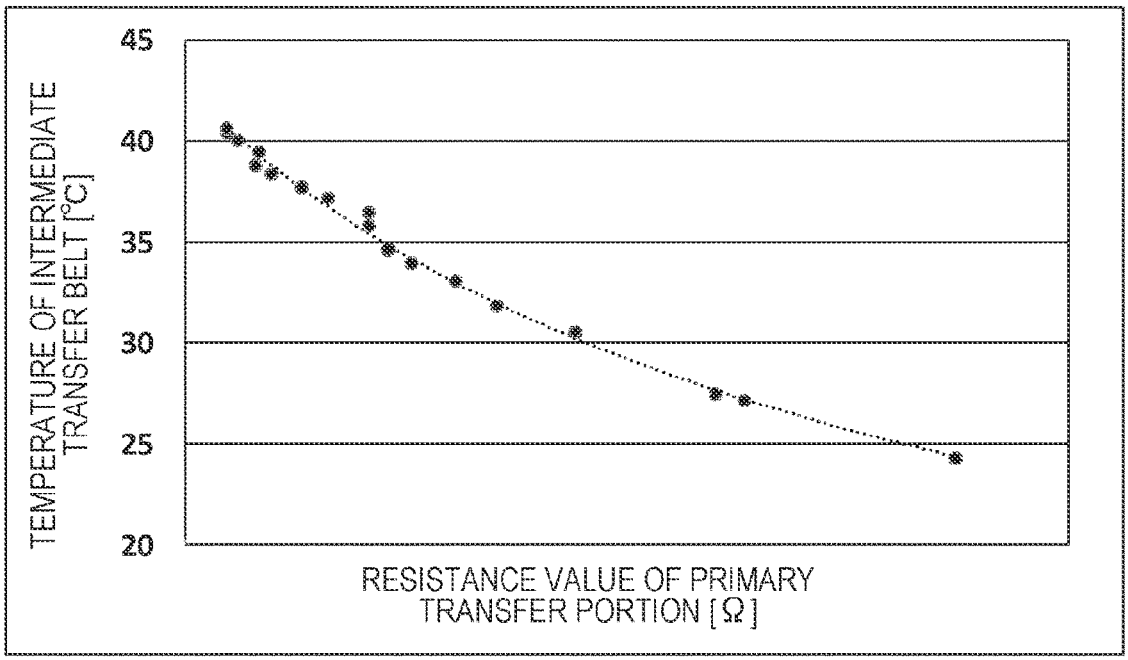
FIG. 39 is a diagram illustrating a resistance temperature feature of an intermediate transfer belt according to an eighth example.

As an examination result, it can be understood that the resistance value measured in the primary transfer portion can have correlation with the temperature of the intermediate transfer belt 28. FIG. 39 illustrates a relation between a resistance value in the primary transfer portion and a temperature of the intermediate transfer belt 28. It can be understood that the resistance value and the temperature of the intermediate transfer belt 28 have strong correlation. This is because the intermediate transfer belt 28 has a resistance temperature feature in which resistance is lowered as the temperature is higher. Since the resistance temperature feature is a feature changed in accordance with a kind or an amount of a conductive material providing conductivity, a dispersion state of the conductive material, or the like, there is a difference in the configuration of the intermediate transfer belt. For the resistance temperature feature, a belt predicted temperature of the temperature prediction expression Ti(t) can be corrected by measuring resistance of a representative intermediate transfer belt in advance, storing the resistance as a resistance temperature conversion table in the control portion 108, and calculating a temperature of the intermediate transfer belt 28 from a resistance value.

Figure 40:
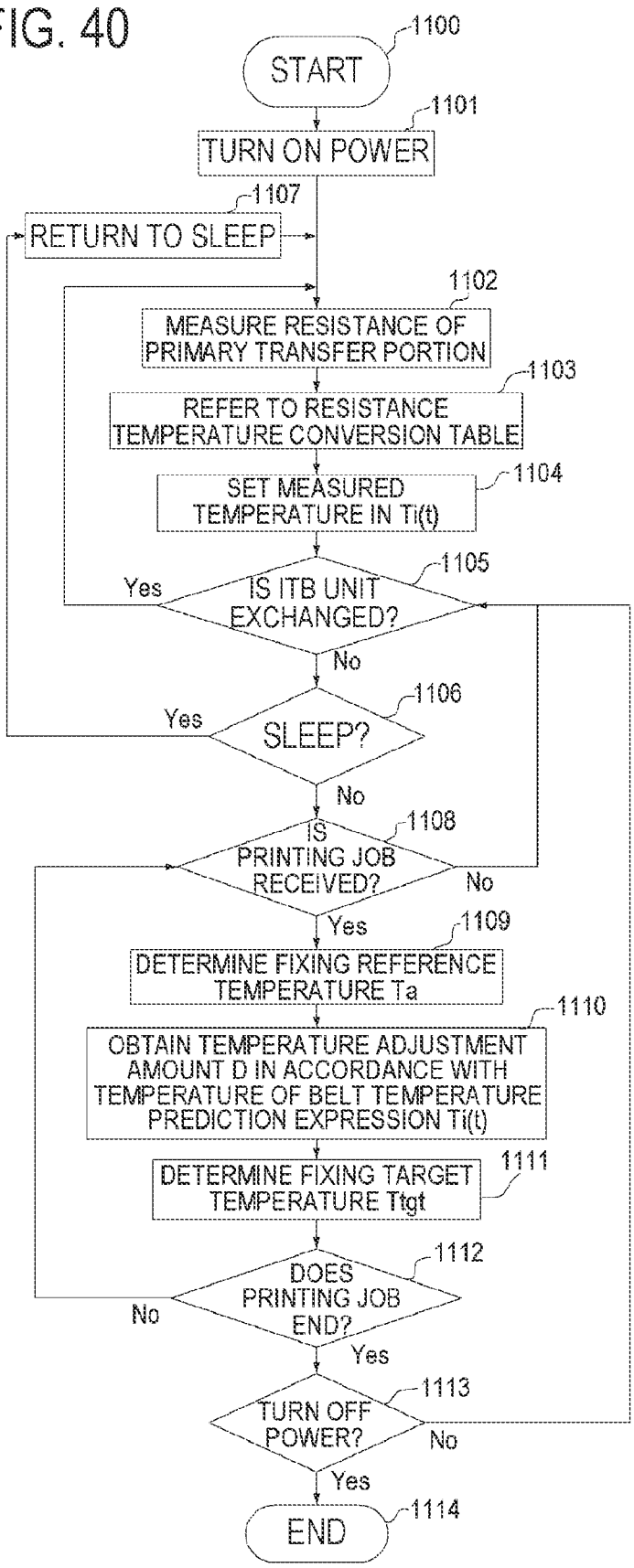
FIG. 40 is a flowchart illustrating a method of setting a target temperature according to an eighth example.

A method of correcting the belt temperature prediction expression Ti(t) according to the eighth example will be described with reference to the flowchart of FIG. 40. When a power switch (not illustrated) of the printer 100 is turned on (1101), resistance in the primary transfer portion is measured (1102). A resistance temperature conversion table in which measured resistance values are stored in the control portion 108 is referred to (1103) and a temperature of the intermediate transfer belt calculated from resistance is set in the belt temperature prediction expression Ti(t) (1104). Since content of the belt temperature prediction expression Ti(t) is the same as that of the seventh example, description thereof will be omitted. Subsequently, exchange of the ITB unit is detected (1105). When the ITB unit is exchanged, a resistance value in the primary transfer portion is measured (1102) and a temperature of the intermediate transfer belt calculated from the resistance value is set in the belt temperature prediction expression Ti(t) (1104). When a sleeping operation is entered (1106), a resistance value in the primary transfer portion at the time of sleeping return is measured (1102) and the temperature of the intermediate transfer belt calculated from the resistance value is set in the belt temperature prediction expression Ti(t) (1104). When a printing job is received (1108), the fixing reference temperature Ta is determined (1109). The temperature adjustment amount D is determined in accordance with the belt temperature prediction expression Ti(t) in which calculation starts using the temperature calculated from the resistance value as an origin (1110) and the fixing target temperature Ttgt is determined (1111). The processing of steps 1108 to 1111 is repeated until the printing job ends (1112). When the printing job ends, the processing of steps 1105 to 1112 is repeated until power is turned off (1113). When power is turned off, the flow ends (1114).

As described above, after power ON, at the time of sleeping return, or at the time of changing of the ITB unit at which an actual temperature of the intermediate transfer belt 28 easily deviates from a predicted temperature of the belt temperature prediction expression Ti(t), the belt temperature prediction expression Ti(t) is updated to a temperature calculated from the resistance value of the primary transfer portion so that the deviation in the temperature can be solved. By performing such updating, a deviation between the actual temperature of the intermediate transfer belt and the belt temperature prediction expression Ti(t) can be suppressed and the appropriate fixing target temperature Ttgt can be set. Therefore, it is possible to inhibit a cold offset or a hot offset.

In the present example, the method of storing the resistance temperature feature of the representative intermediate transfer belt 28 as the resistance temperature conversion table (resistance temperature feature information) in the control portion 108 and referring to a resistance value of the primary transfer portion has been described. However, when the memory chip 371 is provided in the ITB unit 37, the resistance temperature conversion table obtained by individually measuring the intermediate transfer belt 28 in the ITB unit may be written in the memory chip 371. In this case, there is no influence of a simplex variation, and thus highly precise updating is possible.

The relation between the resistance value of the primary transfer portion and the temperature of the intermediate transfer belt is affected by humidity of a printer installation environment or a durability state of the photosensitive drum, the intermediate transfer belt, or the primary transfer roller configuring the primary transfer portion, and thus the deviation may occur from the relation of the resistance temperature feature obtained in advance. In this case, an amount changed by the humidity or the durability of the representative intermediate transfer belt is measured in advance, and the degree of each influence formed as a coefficient in a table is retained in the control portion 108. By adding a coefficient obtained in the table from an actual durability state of the printer or humidity (humidity information) of an installed environment detected by a humidity sensor to the resistance value and referring to the resistance temperature conversion table, it is possible to update a temperature more accurately.

When a printer is connected to a network, a resistance value at the time of resistance measurement of the primary transfer portion, a temperature and humidity of an installation environment of the printer, an activation status of the printer, and the like are stored in a server on the network. Data of a plurality of printers connected to a network can be stored, statistical processing is performed on the data by averaging, a regression formula, or the like, an influence of durability or humidity can be excluded from the measured resistance value in accordance with the analysis result. By referring to the resistance temperature conversion table with the processed resistance value, it is possible to update the temperature accurately.

In the present example, the updating of the predicted temperature of the intermediate transfer belt through the measurement of the resistance in the primary transfer portion has been described as an example of power ON, the sleeping return, and the ITB unit exchange in which the deviation in the temperature easily occurs. However, since the resistance measurement of the primary transfer portion is generally performed before an image is formed at the time of printing start for each printing job, the updating of the predicted temperature may be performed for each printing. The temperature may be updated whenever an accumulated printing number exceeds a given number, when a given time is exceeded, or when a deviation amount between the temperature of the belt temperature prediction expression Ti(t) and the temperature calculated from the resistance measurement exceeds a given temperature. The temperature may be updated when the CRG is exchanged.

Without using the belt temperature prediction expression Ti(t), the fixing target temperature Ttgt can also be determined using only the temperature of the intermediate transfer belt 28 calculated from the resistance value of the primary transfer portion. However, when resistance is measured only once before formation of an image in mass continuous double-sided printing or the like and the double-sided consecutive printing progresses, the temperature is raised more than a temperature measured in the beginning of the printing and a hot offset easily occurs. When a frequency of the resistance measurement increases during consecutive printing, a downtime increases, and thus productivity may deteriorate. Accordingly, by using both the temperature of the intermediate transfer belt 28 calculated from the resistance value of the primary transfer portion and the belt temperature prediction expression Ti(t), it is possible to achieve both the setting of the appropriate target temperature and high productivity.

In the present example, the updating of the temperature in accordance with the resistance measurement result in the primary transfer portion of the color printer using the secondary transfer scheme has been described as an example, but the temperature may be corrected in accordance with a resistance measurement result in the secondary transfer portion. When a temperature of the drum in a monochromatic printer is calculated with a prediction expression, a predicted temperature of the drum may be corrected in accordance with a resistance measurement result in the transfer portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2020-198739, filed on Nov. 30, 2020, No. 2021-089217, filed on May 27, 2021, and No. 2021-165701, filed on Oct. 7, 2021, which are hereby incorporated by reference herein in their entirety.

What is claimed is:

1. An image forming apparatus comprising:

an image bearing member that carries a developer image;

a transfer member that forms a transfer nip portion with the image bearing member and transfers the developer image in the transfer nip portion from the image bearing member to a recording material;

a fixing portion that includes a heater and fixes the developer image to the recording material using heat of the heater;

a temperature detection portion that detects a temperature of the fixing portion; and a control portion that controls power supplied to the heater such that the temperature detected by the temperature detection portion becomes a predetermined control target temperature;

wherein an acquisition portion is provided that acquires a temperature of the image bearing member or the transfer member, and wherein the control target temperature is changed based on the temperature acquired by the acquisition portion and is changed to a lower temperature as the temperature acquired by the acquisition portion is higher.

2. The image forming apparatus according to claim 1, wherein the control target temperature is changed from a reference target temperature to a temperature from which a temperature change amount based on the temperature acquired by the acquisition portion is subtracted.

3. The image forming apparatus according to claim 2, wherein the reference target temperature is set based on a kind of the recording material.

4. The image forming apparatus according to claim 1, wherein the acquisition portion includes a temperature detection member that detects a temperature of the image bearing member or the transfer member.

5. The image forming apparatus according to claim 1, wherein the acquisition portion acquires a predicted temperature of the image bearing member or the transfer member predicted based on information including an activation situation of the image forming apparatus.

6. The image forming apparatus according to claim 1, wherein, in the image forming apparatus, in a double-sided fixing operation of performing first heating in a state in which the developer image is transferred to only one surface of the recording material where images are formed on both surfaces and subsequently performing second heating in a state in which the developer image is also transferred to the other surface, in a case where the double-sided fixing operation is continuously performed on a plurality of recording materials, the fixing portion is able to perform a double-sided consecutive fixing operation of performing the second heating on a preceding recording material after performing the first heating of a subsequent recording material.

7. The image forming apparatus according to claim 1, wherein the image bearing member is one of a photosensitive drum on which the developer image is carried by developing an electrostatic latent image to be carried or an intermediate transfer body on which the developer image is carried by transferring the developer image from the photosensitive drum.

8. The image forming apparatus according to claim 1, wherein the fixing portion includes a cylindrical film, the heater provided in an internal space of the film, and a pressurization roller coming into contact with an outer circumferential surface of the film, and a fixing nip portion in which the recording material is pinched and conveyed is formed by the heater and the pressurization roller with the film interposed therebetween.

9. An image forming apparatus comprising:

an image bearing member that carries a developer image;

a transfer member that forms a transfer nip portion with the image bearing member and transfers the developer image in the transfer nip portion from the image bearing member to a recording material;

a fixing portion that includes a heater and fixes the developer image to the recording material using heat of the heater;

a temperature detection portion that detects a temperature of the fixing portion; and a control portion that controls power supplied to the heater such that the temperature detected by the temperature detection portion becomes a predetermined control target temperature;

wherein an acquisition portion is provided that acquires a temperature of the image bearing member or the transfer member, and wherein the control target temperature is changed based on a first temperature change amount which is based on the temperature acquired by the acquisition portion, a second temperature change amount which is based on a supply time of power to the heater, and a predetermined coefficient.

10. The image forming apparatus according to claim 9, wherein the predetermined coefficient is acquired based on at least one piece of information among a plurality of pieces of information including an operation condition of an image forming operation, a kind of the recording material, and environment information of the image forming apparatus.

11. The image forming apparatus according to claim 9, wherein the control target temperature is changed from a reference target temperature to a temperature from which the first temperature change amount multiplied by the predetermined coefficient and the second temperature change amount multiplied by the predetermined coefficient is subtracted.

12. The image forming apparatus according to claim 9, wherein the first temperature change amount is larger as the temperature acquired by the acquisition portion is higher.

13. The image forming apparatus according to claim 9, wherein the second temperature change amount is larger as the supply time is longer in a case where there is no recording material in the fixing portion, is smaller as the supply time is longer in a case where there is a recording material in the fixing portion, and is smaller as a time in which power is not supplied to the heater is longer.

14. An image forming apparatus comprising:

an image bearing member that carries a developer image;

a transfer member that forms a transfer nip portion with the image bearing member and transfers the developer image in the transfer nip portion from the image bearing member to a recording material;

a fixing portion that includes a heater and fixes the developer image to the recording material using heat of the heater;

a temperature detection portion that detects a temperature of the fixing portion; and a control portion that controls power supplied to the heater such that the temperature detected by the temperature detection portion becomes a predetermined control target temperature;

wherein an acquisition portion is provided that acquires a temperature of the image bearing member or the transfer member, wherein the control target temperature is changed based on a larger temperature change amount between a first temperature change amount which is based on the temperature acquired by the acquisition portion and a second temperature change amount which is based on a supply time of power to the heater.

15. The image forming apparatus according to claim 14, wherein the control target temperature is changed from a reference target temperature to a temperature from which the larger temperature change amount between the first temperature change amount and the second temperature change amount is subtracted.

16. An image forming apparatus comprising:

an image bearing member that carries a developer image;

a transfer portion that includes a transfer member that forms a transfer nip portion with the image bearing member and transfers the developer image in the transfer nip portion from the image bearing member to a recording material;

a fixing portion that includes a heater and fixes the developer image to the recording material using heat of the heater;

a temperature detection portion that detects a temperature of the fixing portion; and a control portion that controls power supplied to the heater such that the temperature detected by the temperature detection portion becomes a predetermined control target temperature, wherein in the image forming apparatus, the fixing portion is able to perform a one-sided fixing operation of heating a first recording material where an image is formed only on one surface and a double-sided fixing operation of heating a second recording material where images are formed on both surfaces, the double-sided fixing operation of performing first heating in a state in which the developer image is transferred to only one surface of the second recording material and subsequently performing second heating in a state in which the developer image is also transferred to the other surface, and wherein the control target temperature is changed based on a larger temperature change amount between a third temperature change amount which is based on an operation time of the double-sided fixing operation repeatedly performed and a second temperature change amount which is based on a supply time of power to the heater.

17. The image forming apparatus according to claim 16, wherein the control target temperature is changed from a reference target temperature to a temperature from which the larger temperature change amount between the third temperature change amount and the second temperature change amount is subtracted.

18. The image forming apparatus according to claim 16, wherein the third temperature change amount is larger as a time in which the double-sided fixing operation is performed is longer, and is smaller as a time in which the double-sided fixing operation is not performed is longer.

19. The image forming apparatus according to claim 18, wherein the third temperature change amount is smaller as a time in which the one-sided fixing operation is performed is longer, and is smaller as a time in which a fixing operation is not performed is longer.

20. An image forming apparatus comprising:

an exchangeable image bearing member;

a transfer portion that transfers a developer image formed on the image bearing member to a recording material coming into contact with the image bearing member;

a fixing portion that fixes the developer image transferred to the recording material to the recording material and is controlled such that a predetermined control target temperature is maintained during fixing processing; and a double-sided printing mechanism that also forms the developer image on a rear surface of the recording material by reversing front and rear surfaces of the recording material passing through the fixing portion, wherein the control target temperature is set in accordance with the number of double-sided prints and exchange detection of the image bearing member.

21. The image forming apparatus according to claim 20, wherein the image forming apparatus sets the control target temperature to be low as the number of double-sided prints increases.

22. The image forming apparatus according to claim 21, wherein the image forming apparatus sets the control target temperature to be high from immediately subsequent print of the exchange detection of the image bearing member.

23. An image forming apparatus comprising:

an exchangeable first image bearing member;

an exchangeable second image bearing member;

a first transfer portion that transfers a developer image formed on the first image bearing member to the second image bearing member;

a second transfer portion that transfers the developer image from the second image bearing member to a recording material coming into contact with the second image bearing member;

a fixing portion that fixes the developer image transferred to the recording material and is controlled such that a predetermined target temperature is maintained during fixing processing; and a double-sided printing mechanism that also forms the developer image on a rear surface of the recording material by reversing front and rear surfaces of the recording material passing through the fixing portion, wherein the image forming apparatus sets the control target temperature in accordance with the number of double-sided prints and exchange detection of the first image bearing member and the second image bearing member.

24. The image forming apparatus according to claim 23, wherein the image forming apparatus sets the control target temperature to be low as the number of double-sided prints increases.

25. The image forming apparatus according to claim 24, wherein the image forming apparatus sets the control target temperature to be high from immediately subsequent print of the exchange detection of the second image bearing member.

26. An image forming apparatus comprising:

an image bearing member that carries a developer image;

a transfer member that forms a transfer nip portion with the image bearing member;

a transfer voltage application unit that applies, to the transfer member, a transfer bias for transferring the developer image from the image bearing member to a recording material;

a transfer current detecting unit that measures a transfer current value generated in the application of the transfer bias;

a transfer calculation processing unit that calculates a resistance value of the transfer nip portion to which the voltage is applied by the transfer voltage application unit from a detection result of the transfer current detecting unit;

a fixing portion that includes a heater and fixes the developer image to the recording material using heat of the heater;

a temperature detection portion that detects a temperature of the fixing portion;

a control portion that controls power supplied to the heater such that the temperature detected by the temperature detection portion becomes a predetermined control target temperature; and an acquisition portion that acquires a predicted temperature of the image bearing member predicted based on information including an activation situation of the image forming apparatus, wherein the control target temperature is changed based on the resistance value and the predicted temperature acquired by the acquisition portion.

27. The image forming apparatus according to claim 26, wherein the transfer member includes a storage unit that stores individual resistance temperature feature information measured in advance.

28. The image forming apparatus according to claim 26, further comprising:

a humidity sensor that detects humidity information of an installation environment; and a memory that stores an activation situation of the image forming apparatus, wherein the control target temperature is changed based on the resistance value, the humidity information, and the activation situation of the image forming apparatus.

29. An image forming apparatus comprising:

a first image bearing member;

a second image bearing member;

a first transfer member that forms a first transfer nip portion with the first image bearing member via the second image bearing member and transfers a developer image formed on the first image bearing member to the second image bearing member;

a second transfer member that forms a second transfer nip portion with the second image bearing member and transfers a developer image formed on the second image bearing member to a recording material when the recording material passes through the second transfer nip portion;

a fixing portion that includes a heater and fixes the developer image to the recording material using heat of the heater;

a temperature detection portion that detects a temperature of the fixing portion;

a control portion that controls power supplied to the heater such that the temperature detected by the temperature detection portion becomes a predetermined control target temperature;

an acquisition portion that acquires a predicted temperature of the second image bearing member predicted based on information including an activation situation of the image forming apparatus;

the image forming apparatus further comprising:

a transfer voltage application unit that applies a voltage for transferring developer to at least one of the first transfer member or the second transfer member;

a transfer current detecting unit that measures a transfer current value generated by allowing the transfer voltage application unit to apply the voltage; and a transfer calculation processing unit that calculates a resistance value of the transfer nip portion to which the voltage is applied by the transfer voltage application unit from a detection result of the transfer current detecting unit, wherein the control target temperature is changed based on the resistance value and the predicted temperature acquired by the acquisition portion.

30. The image forming apparatus according to claim 29, wherein at least the second image bearing member and the first transfer member are configured as one intermediate transfer unit, and the intermediate transfer unit includes a storage unit that stores individual resistance temperature feature information obtained by measurement in advance.

* * * * *